US005968715A

United States Patent [19]

Ueda et al.

[11] Patent Number: 5,968,715

[45] Date of Patent: Oct. 19, 1999

[54] METHOD FOR PROCESSING SILVER HALIDE PHOTOGRAPHIC LIGHT-SENSITIVE MATERIAL

[75] Inventors: Yutaka Ueda; Masao Ishikawa; Satoru Kuse, all of Hino, Japan

[73] Assignee: Konica Corporation, Japan

[21] Appl. No.: 08/895,488

[22] Filed: Jul. 16, 1997

Related U.S. Application Data

[63] Continuation-in-part of application No. 08/551,721, Nov. 1, 1995, abandoned, which is a continuation of application No. 08/604,081, Feb. 20, 1996, abandoned.

[30] Foreign Application Priority Data

| | | | |
|---|---|---|---|
| Nov. 11, 1994 | [JP] | Japan | 6-277983 |
| Feb. 28, 1995 | [JP] | Japan | 7-040050 |
| Mar. 24, 1995 | [JP] | Japan | 7-066058 |
| Mar. 31, 1995 | [JP] | Japan | 7-076103 |

[51] Int. Cl.[6] ..... G03C 7/30

[52] U.S. Cl. ..... 430/372; 430/429; 430/455; 430/458

[58] Field of Search ..... 430/372, 393, 430/400, 428, 429, 455, 458

[56] References Cited

U.S. PATENT DOCUMENTS 5,275,923 1/1994 Fyson ..... 430/455

(List continued on next page.)

FOREIGN PATENT DOCUMENTS 329086 8/1989 European Pat. Off. .

(List continued on next page.)

OTHER PUBLICATIONS

Copy of Japanese document No. 61–15424 of Apr. 24, 1986.

T.H. James, The Theory of the Photographic Process, Macmillan Publishing Co., Inc., New York, 4th Ed. 1977 pp. 437–461.

*Primary Examiner*—Hoa Van Le

*Attorney, Agent, or Firm*—Jordan B. Bierman; Bierman, Muserlian and Lucas

[57] ABSTRACT

A method for processing a silver halide photographic light-sensitive material is disclosed. The method comprises the steps of fixing a silver halide photographic light-sensitive material with a fixing solution containing a compound represented by Formula I, II, III, IV or V and stabilizing said light-sensitive material just after the fixing step with a stabilizing solution which contains substantially no formaldehyde;

Formula I

Formula II

Formula III

Formula IV

-continued

Formula V

.

13 Claims, 2 Drawing Sheets

U.S. PATENT DOCUMENTS

| | | | |
|---|---|---|---|
| 5,278,033 | 1/1994 | Hagiwara et al. | 430/429 |
| 5,316,898 | 5/1994 | Ueda et al. | 430/400 |
| 5,338,648 | 8/1994 | Kojima et al. | 430/393 |
| 5,362,609 | 11/1994 | Kuwae et al. | 430/372 |
| 5,424,177 | 6/1995 | Kobayashi et al. | 430/463 |

FOREIGN PATENT DOCUMENTS

| | | |
|---|---|---|
| 476434 | 3/1992 | European Pat. Off. . |
| 530832 | 3/1993 | European Pat. Off. . |
| 546778 | 6/1993 | European Pat. Off. . |
| 594053 | 4/1994 | European Pat. Off. . |
| 611987 | 8/1994 | European Pat. Off. . |
| 1261640 | 10/1989 | Japan . |
| 4124662 | 4/1992 | Japan . |

METHOD FOR PROCESSING SILVER HALIDE PHOTOGRAPHIC LIGHT-SENSITIVE MATERIAL

This application is a continuation-in-part of application Ser. No. 08/551,721, filed Nov. 1, 1995 now abandoned which is a continuation of application Ser. No. 08/604,081, filed Feb. 20, 1996, now abandoned.

FIELD OF THE INVENTION

The present invention relates to a method for processing a silver halide photographic light-sensitive material, particularly relates to a method for processing a silver halide photographic light-sensitive material which is effective to reduce the amount of waste liquid of photographic processing effluent.

BACKGROUND OF THE INVENTION

Recently, makers of photographic material have made efforts for reducing the amount of waste liquid formed in a photographic processing to a limit relating to a tendency of environment protection.

On the other hand, C-41RA Processing of Eastman Kodak Co., Ltd., which is a processing most widely used in-shop laboratories or mini-labo's, is composed of 4 steps, and the replenishing amounts per roll of 135 size, 24 exp. film are 23 ml for color developing step, 5 ml for bleaching step, 33 ml for fixing step and 40 ml for stabilizing step, respectively. The replenishing amount for the stabilizing solution is largest in these steps. Therefore, reducing in the replenishing amount of the stabilizing solution has been demanded.

However, when the replenishing amount of the stabilizing solution is simply reduced, a fixing agent such as thiosulfate, a component of a fixing solution, is accumulated in the stabilizing solution. The fixing agent is carried into the stabilizing solution from the previous fixing bath by a light-sensitive material processed on which the fixing agent is adhered. The accumulated fixing agent causes formation of a stain on the back surface of the light-sensitive material. The satin appears on a printed picture from the light-sensitive material and causes a serious defect destroying the commercial value of the print. Further, the renewing ratio of the stabilizing solution is lowered by the reduction of the replenishing amount, which causes an extension of time for oxidation of the stabilizing solution by air. As a result of that, a problem of formation of defects caused by sulfurization is apt to raise. Further, formaldehyde is usually contained in the stabilizing solution for preventing stain formation in a unexposed area of the processed light sensitive material during storage and discoloration of color image by blocking the reactive site of a unreacted magenta coupler remained in the light-sensitive material. The formaldehyde reacts and forms an adduct with sulfite, which is carried over from the fixing solution accompanied with the thiosulfate to the stabilizing solution. As a result of that, the effect of formaldehyde improving the stability of dye is lost and a serious problem of acceleration of sulfurizaton in the stabilizing solution is raised.

Recently, solidifying a processing composition for a silver halide light-sensitive material is tried from the view point of reducing environment pollution and improving working load for preparating a processing solution. For instance, Japanese Patent Publication Open to Public Inspection (JP O.P.I.) Nos. 5-119454/1993, 5-165174/1993 and 5-232656/1993 each describe a technology in which a solid processing composition containing thiosulfate is directly supplied into a solution having a fixing ability.

It would be unquestionable that reducing the use of plastic bottles for bottling a replenisher solution kit and lowering working load at the time of preparation of a replenisher solution can be attained by applying the technology disclosed in the above publications. However, it has been found that the problems mentioned below cannot be solved by the above technology only.

In the above-mentioned patent publications, a fixing time of 90 seconds for color negative film is disclosed as an embodiment of the technology. Generally, it is necessary to increase the concentration of thiosulfate in a processing solution to a certain level for attaining such rapidness of the processing. In the case in which thiosulfate concentration is made higher, it is apt to occur a problem, when daily cleaning of transferring rollers arranged between the first and the second fixing tank or a fixing tank and next tank such as a stabilizing tank or a washing tank is failed, that a hydrophobic decomposition substance of thiosulfate is formed by drying and air-oxidizing of drops of the processing solution adhered on the rollers by a light-sensitive material processed. The hydrophobic substance is tightly fixed on the surface of the rollers by hydrophilic bonding. The hydrophobic substance tightly adhered on the surfaces of the rollers may causes an irrevocable defect such as scratches on the light-sensitive material.

Further, it has been found, in the relation between concentration of thiosulfate and fixing property, that although the fixing property is raised with increasing the thiosulfate concentration until a certain value, the fixing property is lowered in reverse when the concentration exceeds the certain value. The thiosulfate concentration for enabling the above-mentioned rapid processing corresponds to the above critical concentration. Accordingly, when the amount of light-sensitive material to be processed per day is small, the thiosulfate concentration in the processing solution is apt to raised by evaporation of the solution. The raising in the thiosulfate concentration causes a problem that the fixing property of the solution is degraded. Further, crystals of thiosulfate are precipitated and grown in the processing solution when such the concentrated processing solution as described above is stood under a low temperature condition such as in a closing term in winter. The precipitation of thiosulfate causes blocking of circulation of the processing solution and degrades the property of the processing solution due to lowering the effective amount of thiosulfate in the processing solution.

On the other hand, in a case that a solid processing composition is stored for a prolonged period on the deck of a ship when the composition is transported by a ship, a yellow water-insoluble sulfurous substance is formed in a thiosulfate-containing solid composition for fixer or bleach-fixer during the storage under a such high temperature condition. The insoluble sulfurous substance adheres to a filter stalled in the fixing tank or bleach-fixing tank of processor and causes blocking of the filter. As a result of that, photographic properties of the processing solution are degraded due to in sufficient circulation of the processing solution. Further, it has been found that the precipitated sulfurous substance adheres on the surface of the processed light-sensitive material and considerably spoils the commercial value of the processed light-sensitive material.

In case of the solid composition is in a form of granule or tablet, the formation of sulfurous substance by decomposition of thiosulfate causes lowering the combining force between components of the composition around the sulfrous substance in the granule or the tablet. As a result of this, the solid composition is easily powdered by vibration or friction.

A solution for processing a silver halide photographic light-sensitive material having a fixing ability such as a fixier or a bleach-fixer contains compound which is capable of forming a water-soluble complex salt by reaction with silver halide for example, a thiosulfate such as potassium thiosulfate, sodium thiosulfate or ammonium thiosulfate, a thiocyanate such as potassium thiocyanate, sodium thiocyanate or ammonium thiocyanate, thiourea or a thioether is usually contained as a fixing agent. Among them, thiosulfate particularly ammonium thiosulfate has been frequently used by reason of that the compound is superior in the processing property, stability and solubility thereof.

However, a strong odor of evaporated ammonia is generated when ammonium ions are contained in a processing solution. It has been tried, therefore, to reduce the using amount of ammonium salt for improvement of working environment.

However, the solubility of potassium thiosulfate or sodium thiosulfate is lower than that of ammonium thiosulfate. Accordingly, the fixing agent is easily precipitated in a concentrated solution at low temperature when these thiosulfates are used instead of ammonium salt. The concentration of the solution is particularly occurred in a mini-labo when the amount of light-sensitive material to be processed is small. Further, in a system with a small amount of replenishing, it is required to increase the concentration of thiosulfate to compensate degradation in processing ability and stability of the processing solution. It has been found that the increasing in the thiosulfate concentration causes adhering sulfur on transferring rollers exposed to air, particularly on rollers for transferring provided at a position between a processing tank and the next processing tank (inter-tank rollers).

SUMMARY OF THE INVENTION

This invention has been made on the above-mentioned background. The first object of the invention is to provide a method for processing a silver halide photographic light-sensitive material in which a stain formed on the back surface of the light-sensitive material is prevented when a replenishing amount of a stabilizing solution provided after a fixing solution is reduced. The second object of the invention is to provide a method for processing a silver halide photographic light-sensitive material in which a storage stability of a stabilizing solution is improved and a processing can be stably performed for a prolonged period. The third object of the invention is to provide a method for processing a silver halide photographic light-sensitive material in which reduction of waste liquid formed in the photographic processing can be realized, and the method fits to the requirement of environment protection. The fourth object of the invention is to provide a solid processing composition for a silver halide photographic light-sensitive material which does not adhere to transferring rollers and maintains a stable fixing ability when the amount of light-sensitive material processed per day is small. The fifth object of the invention is to provide a solid processing composition for a silver halide photographic light-sensitive material which maintains a good storage ability under a high temperature condition for a prolonged period. The sixth object of the invention is to provide a processing method of a liver halide photographic light-sensitive material in which the ammonium ion concentration can be lowered without precipitation of fixing agent and adhering of in soluble sulfurous substans on inter-tank transferring rollers. Other objects of the invention would be self-explanatory appeared in the specification.

The above-mentioned objects of the invention can be achieved by a method for processing a silver halide photographic light-sensitive material comprising the steps of fixing a silver halide photographic light-sensitive material with a fixing solution containing a compound represented by Formula I, II, III, IV or V and stabilizing said light-sensitive material immediately after the fixing step with a stabilizing solution which contains substantially no formaldehyde;

Formula I

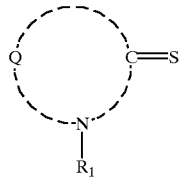

wherein Q is a group of atoms necessary for forming a nitrogen-containing heterocyclic ring, including one being condensed with a five- or six-member unsaturated ring; $R_1$ is a hydrogen atom, an alkyl group having 1 to 6 carbon atoms, a cycloalkyl group, an aryl group, a heterocyclic group, including one being condensed with a five- or six-member unsaturated ring, or an amino group.

Formula II

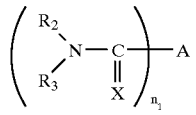

wherein $R_2$ and $R_3$ are each a hydrogen atom, an alkyl group having 1 to 6 carbon atoms, a hydroxyl group, a carboxyl group, an amino group, an acyl group having 1 to 3 carbon atoms, an aryl group or an alkenyl group; A is

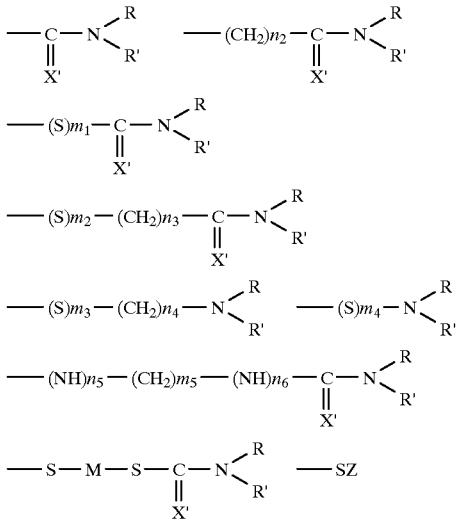

or an $n_1$ valent-residue of heterocyclic ring including one being condensed with a five- or six-member unsaturated ring; X is =S, =O or =NR"; in the above R and R' are synonymous with $R_2$ and $R_3$, respectively; X' is synonymous with X, Z is a hydrogen atom, an alkali metal atom, an ammonium group, an amino group, a residue of heterocyclic ring, an alkyl group or an —S—B—Y—($R_4$) ($R_5$) group; M is a divalent metal atom; R" is a hydrogen atom, an alkyl group having 1 to 6 carbon atoms, a cycloalkyl group, an aryl group, a residue of heterocyclic ring including one being condensed with a five- or six-member unsaturated ring, or an amino group; $n_1$ through $n_6$ and $m_1$ through $m_5$ are each an integer of 1 to 6; B is an alkylene group having 1 to 6 carbon atoms; Y is an —N<, —C< or —CH< group; $R_4$ and $R_5$ are synonymous with $R_2$ and $R_3$, respectively, provided that $R_4$ and $R_5$ each may be a —B—SZ group; $R_2$ and $R_3$, R and R', or $R_4$ and $R_5$ may be linked to form a ring; and a compound represented by the above formula include alcoholized one and salt thereof.

Formula III

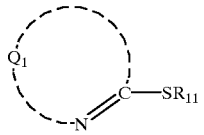

wherein $Q_1$ is a group of atoms necessary for forming a nitrogen-containing heterocyclic ring including one being condensed with a five- or six-member saturated or unsaturated ring; $R_{11}$ is a hydrogen atom or an alkali metal atom

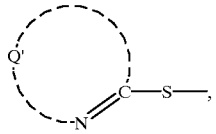

or an alkyl group; and Q' is synonymous with $Q_1$.

Formula IV

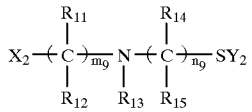

wherein $X_2$ is —COOM', —H, —OH, —$SO_3$M', —$CONH_2$, —$SO_2NH_2$, —$NH_2$, —SH, —CN, —$CO_2R_{16}$, —$SO_2R_{16}$, —$OR_{16}$, —$NR_{16}R_{17}$, —$SR_{16}$, —$SO_3R_{16}$, —$NHCOR_{16}$, —$NHSO_2R_{16}$, —$OCOR_{16}$ or —$SO_2R_{16}$; $Y_2$ is

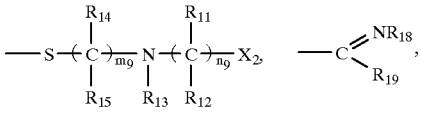

or a hydrogen atom; $m_9$ and $n_9$ are each an integer of 1 to 10; $R_{11}$, $R_{12}$, $R_{13}$, $R_{14}$, $R_{15}$, $R_{16}$, $R_{17}$ and $R_{18}$ are each a hydrogen atom, an alkyl group having 1 to 3 carbon atoms, an acyl group or

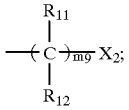

$R_{19}$ is —$NR_{20}R_{21}$, —$OR_{22}$ or —$SR_{22}$; $R_{20}$ and $R_{21}$, are each a hydrogen atom or an alkyl group having 1 to 3 carbon atoms; $R_{22}$ is a group of atoms necessary for forming a ring by linking with $R_{18}$; $R_{20}$ or $R_{21}$ each may form a ring by linking with $R_{18}$; and M' is a hydrogen atom or a cation.

Formula V

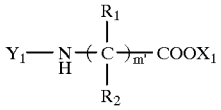

wherein $X_1$ is a hydrogen atom or an alkali metal atom; $Y_1$ is a hydrogen atom, an alkyl group or an acyl group; $R^1$ and $R^2$ are each a hydrogen atom, an alkyl group or an aryl group and at least one of them contains a sulfur atom, $R^1$ and $R^2$ may be the same or different; and m' is an integer of 1 to 5.

BREIF DESCRIPTION OF THE DRAWINGS

DETAILED DESCRIPTION OF THE INVENTION

Figure 1:
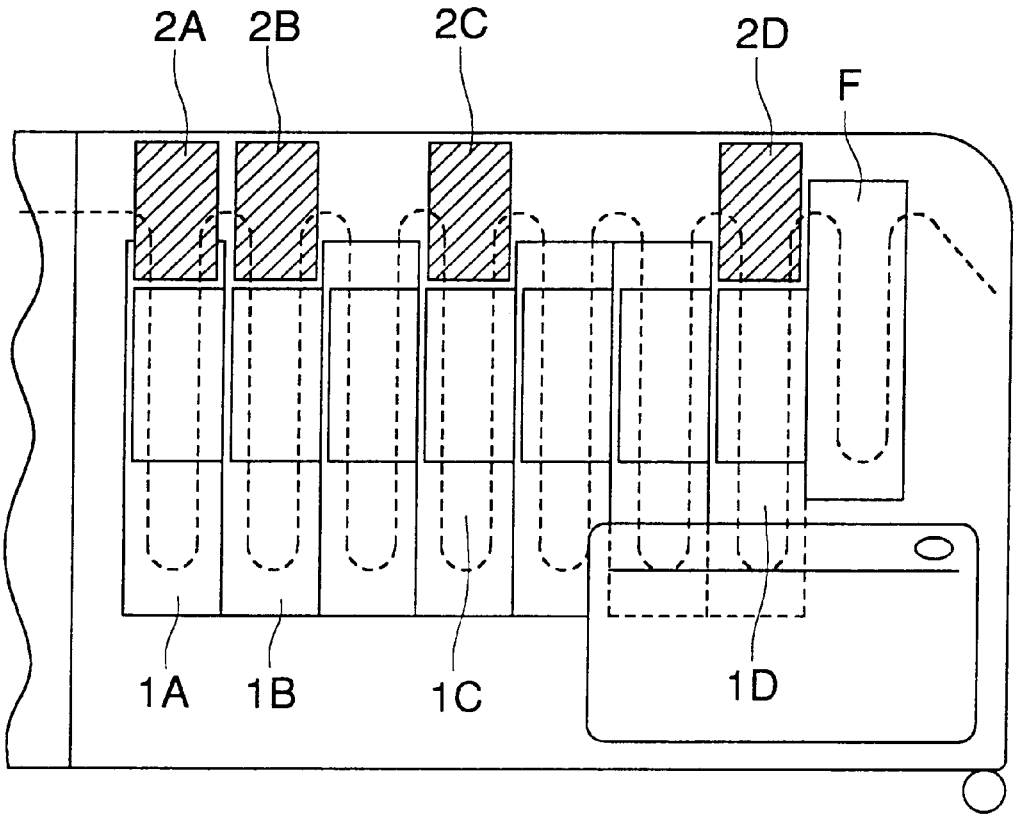
FIG. 1 is a structural drawing showing the position of an auto processing machine at which a solid processing composition supplying device

The inventors found out that the concentration of thiosulfate salt necessary for completing a fixing reaction can be reduced by adding at least one compound represented by Formula I, II, III, IV or V (hereinafter also referred as "compound of the invention") into a fixing solution, and that the replenishing amount of a stabilizing solution can be reduced without formation of a stain on the back surface of a light-sensitive material processed and sulfurization or formation of a water-insoluble sulfurous substance in the stabilizing solution by substantially omitting formaldehyde which is reactive with sulfite carried over from the fixing solution.

The amount of thiosulfate necessary to complete a fixing reaction can be reduced by addition of a compound represented by Formula I, II, III, IV or V to a solid processing composition containing thiosulfate. By the reduction in the amount of thiosulfate, adhesion of the decomposition substance of thiosulfate on the surface of the inter-tank transferring rollers can be prevented and the fixing ability of the processing solution can be stably maintained when the amount of the light-sensitive material to be processed per day is small and the solution is concentrated.

The processing solution can maintain a stable fixing ability by the use of the above compound even when the concentration of thiosulfate in the processing solution is varied.

The inventors further found out that the concentration of thiosulfate salt necessary for completing a fixing reaction can be decreased by adding at least one compound represented by Formulas I to V into a fixing solution, and that the processing ability of a fixing solution can be maintained without raising the thiosulfate ion concentration by optimizing the ratio of the amount of ammonium thiosulfate to the amount of potassium thiosulfate and/or sodium thiosulfate. Thus the present invention has been accomplished.

A processing method has been known in which a mercapto heterocyclic compound is added to a processing solution. The method includes, for example, a method in which the compound is added to a fixing solution such as described in Japanese Patent Publication Open for Public Inspection (JP O. P. I.) No. 1-261640/1989, a method in which the compound is added to a solution of prebath for a bleaching solution such as described in JP O. P. I. No. 54-52534/1979, and a method in which the compound is added to a bleach-fixing solution such as described in British Patent No. 1,138,842. However, these publication does not describe with respect to any stabilizing solution containing no formaldehyde to be used in the following step, and the technical concept of the invention is not expected from the description therein.

The compound represented by Formula I to IV or V is known as a bleach accelerating agent to be used in a bleaching process in which metallic silver is oxidized (refer JP O.P.I. 61-250646/1986). However, it is surprising fact that the compound has a fixing accelerating effect. The compound accelerates a fixing process which is applied after the bleaching step, and silver ions are dissolved and removed from the light-sensitive material in this process. The effect is a novel fact which is found by the inventors as a result of try-and-error experiments carried out by the inventors.

The solubility of the solid processing composition can be stably maintained and the precipitation of sulfurous substance formed from thiosulfate can be prevented by the use of a compound represented by Formula I to IV or V even when the composition is stored under a high temperature condition of 40 to 50° C. for a prolonged period.

When the solid processing composition is in a form of granule or tablet, the powdering of the composition after storage under a high temperature condition can be prevented by adding at least one compound represented by Formula I to IV or V in the solid processing composition.

The present invention would be described below.

A compound of the invention represented by Formula I to IV or V will be described.

In the above-mentioned Formula I, Q represents a group of atoms necessary to form a nitrogen-containing heterocyclic ring, including one condensed with a five- or six-member unsaturated ring, such as imidazoline ring, thiazoline ring, triazoline ring. $R_1$ represents a hydrogen atom, an alkyl group having 1 to 6 carbon atoms such as an ethyl group, a cycloalkyl group such as a cyclohexyl group, an aryl group such as a phenyl group, a heterocyclic group including one condensed with a five- or six-member unsaturated ring such as a pyridyl group, an imidazolyl group or a thiazolyl group, or an amino group.

In the above-mentioned Formula II, $R_2$ and $R_3$ represent each a hydrogen atom, an alkyl group having 1 to 6 carbon atoms such as an ethyl group, a hydroxyl group, a carboxyl group, an amino group, an acyl group, an aryl group such as a phenyl group, or an alkenyl group such as an allyl group or a butenyl group.

A represents —(C=X')—N(R)(R'), —$(CH_2)n_2$—(C=X')—N(R)(R'), —(S)$m_1$—(C=X')—N(R)(R'), —(S)$m_2$—$(CH_2)n_3$—(C=X')—N(R)(R'), —(S)$m_3$—$(CH_2)n_4$—N(R)(R'), —(S)$m_4$—N(R) (R'), —(NH)$n_5$—$(CH_2)m_5$—(NH)$n_6$—(C=X')—N(R)(R'), —S—M—S—(C=X')—N(R) (R'), —SZ or a mono-valent residue of heterocyclic ring, including one condensed with a five- or six-member unsaturated ring, such as a residue of pyridine ring or a residue of imidazole ring, X represents =S, =0 or =NR". In the above, R and R' are each synonymous with $R_2$ and $R_3$, respectively; X' is synonymous with X; Z represents a hydrogen atom, an alkali metal atom, an ammonium group, an amino group, a nitrogen-containing heterocyclic group including one condensed with a five- or six-member unsaturated ring, such as a residue of pyridine or a residue of imidazole, an alkyl group such as a methyl group or an ethyl group or —S—B—Y($R_4$)($R_5$); M represents an oxygen atom or a sulfur atom; R" represents a hydrogen atom, an alkyl group having 1 to 6 carbon atoms such as an ethyl group, a cycloalkyl group, an aryl group such as a phenyl group, a heterocyclic group including one condensed with a five- or six-member unsaturated ring, such as a resdue of pyridyine or a residue of imidazole, or an amino group; and $n_1$ through $n_6$ and $m_1$ through $m_5$ represent each an integer of 1 to 6.

B represents an alkylene group having 1 to 6 carbon atoms such as an ethylene group; Y represents —N<, =C< or —CH<; $R_4$ and $R_5$ are each synonymous with $R_2$ and $R_3$, provided that $R_4$ and $R_5$ each may represent —B—SZ, and $R_2$ and $R_3$, $R_4$ and $R_5$ are each may be linked to form a ring.

Compounds represented by Formula II include ethanolized ones and salts thereof.

In Formula III, $Q_1$ represents a group of atoms necessary to form a heterocyclic ring including one condensed with a five- or six-member unsaturated ring, such as a thiazole ring, a thiadiazole ring, an imidazole ring, a pyrimidine ring, a triazole ring, a pyrazine ring, a triazine ring or an oxodiazole ring; $R_{11}$ represents a hydrogen atom, an alkali metal atom, a group represented Formula III from which $R_{11}$ is removed or an alkyl group. Q' is synonymous with $Q_1$.

In Formula IV, $X_2$ represents —COOM', —H, —OH, —$SO_3$M', —$CONH_2$, —$SO_2NH_2$, —$NH_2$, —SH, —CN, —$CO_2R_{16}$, —$SO_2R_{16}$, —$OR_{16}$, —$NR_{16}R_{17}$, —$SR_{16}$, —$SO_3R_{16}$, —$NHCOR_{16}$, —$NHSO_2R_{16}$, —$OCOR_{16}$ or —$SO_2R_{16}$; $Y_2$ represents —S—[C($R_{14}$) ($R_{15}$)]$n_9$—N($R_{13}$)—[C($R_{11}$) ($R_{12}$)]$m_9$—, —C(=$NR_{18}$) ($R_{19}$) or a hydrogen atom; $m_9$ and $n_9$ represent each an integer of 1 to 10. $R_{11}$, $R_{12}$, $R_{13}$, $R_{14}$, $R_{15}$, $R_{16}$, $R_{17}$ and $R_{18}$ represent each a hydrogen atom, a lower alkyl group, an acyl group or —[C($R_{11}$) ($R_{12}$)]$m_9$—$X_2$; $R_{18}$ represents a lower alkyl group such as a methyl group or an ethyl group; $R_{19}$ represents —$NR_{20}R_{21}$, —$OR_{22}$ or —$SR_{22}$; $R_{20}$ and $R_{21}$ represent each a hydrogen atom or a lower alkyl group such as a methyl group or an ethyl group; $R_{22}$ represents a group of atoms necessary to form a ring bonding with $R_{18}$. $R_{20}$ or $R_{21}$ may be linked with $R_{18}$ for forming a ring. M' is a hydrogen atom or a cation.

In Formula V, $X_1$ represents a hydrogen atom or an alkali metal atom; $Y_1$ represents a hydrogen atom, an alkyl group such as an ethyl group or an acyl group; $R^1$ and $R^2$ represent each a hydrogen atom, an alkyl group such as a methyl group or an ethyl group, or an allyl group such as a phenyl group and at least one of them contains a sulfur atom. $R^1$ and $R^2$ may be the same or different. m' represents an integer of 1 to 5.

Concrete compounds represented by Formulas I to V of the invention are exemplified below. However, the present invention is not be limited to the following compounds.

(I-1)

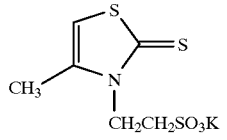

-continued
(I-2)
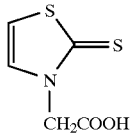
(I-3)
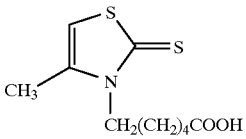
(I-4)
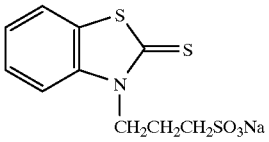
(I-5)
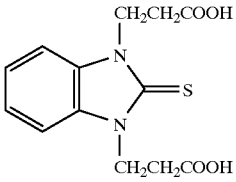
(I-6)
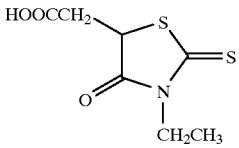
(I-7)
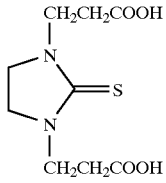
(I-8)
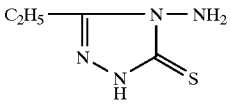
(I-9)
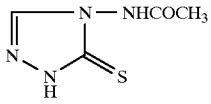
(I-10)
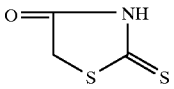
II-1
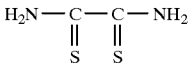
II-2
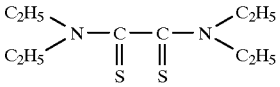
-continued
II-3
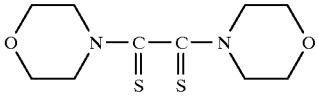
II-4
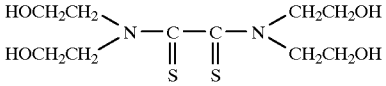
II-5
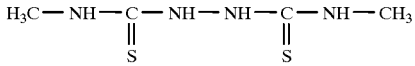
II-6
II-7
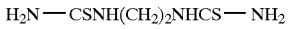
II-8
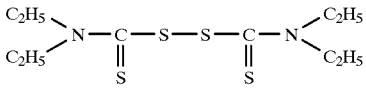
II-9
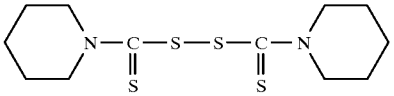
II-10
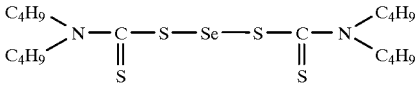
II-11
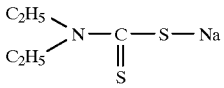
II-12
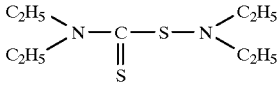
II-13
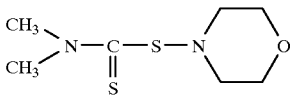
II-14
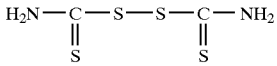
II-15
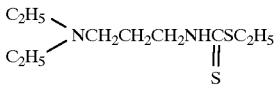
II-16
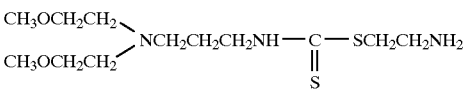
II-17
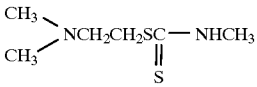

-continued
II-18
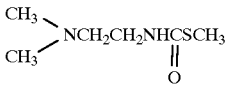
II-19
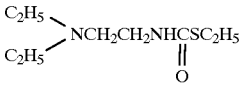
II-20
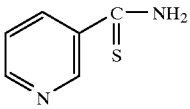
II-21
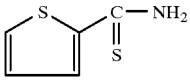
II-22
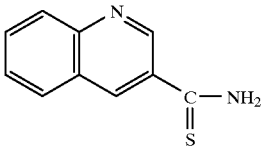
II-23
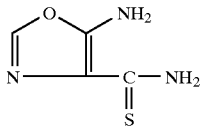
II-24
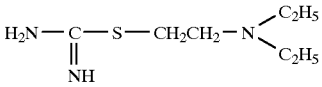
II-25
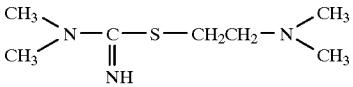
II-26
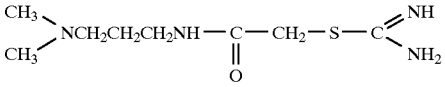
II-27
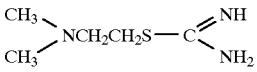
(III-1)
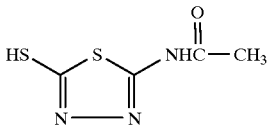
(III-2)
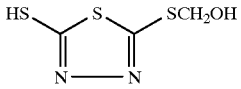
(III-3)
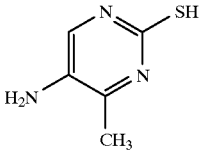
-continued
(III-4)
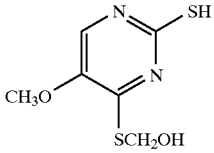
(III-5)
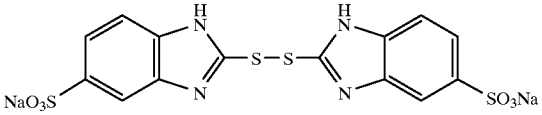
(III-6)
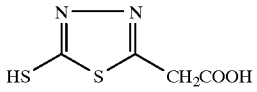
(III-7)
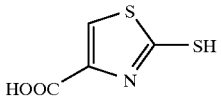
(III-8)
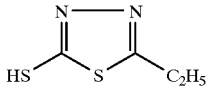
(III-9)
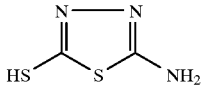
(III-10)
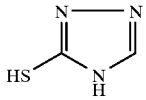
(III-11)
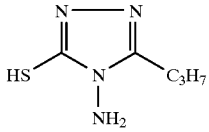
(III-12)
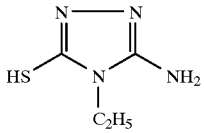
(III-13)
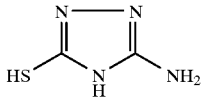
(III-14)
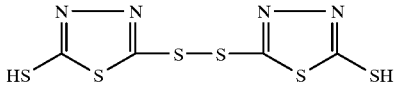
(III-15)
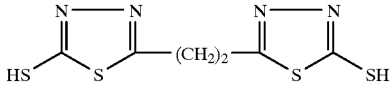

-continued
(III-16)
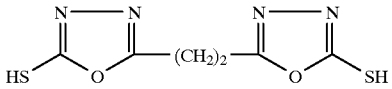
(III-17)
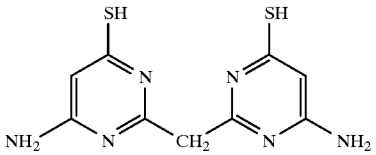
(III-18)
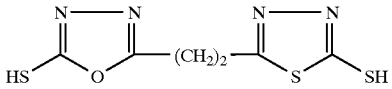
(III-19)
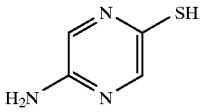
(III-20)
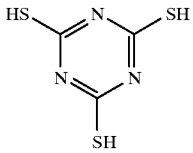
(III-21)
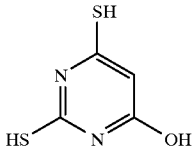
(III-22)
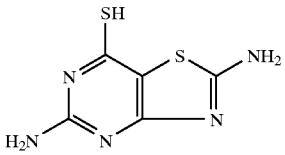
(III-23)
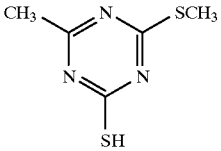
(III-24)
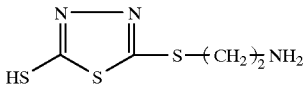
(III-25)
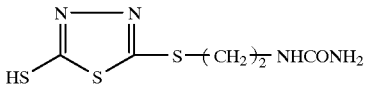
(III-26)
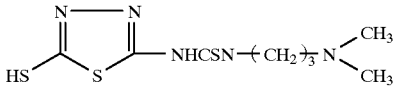
-continued
(III-27)
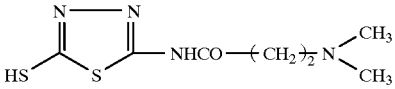
(III-28)
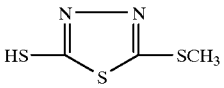
(III-29)
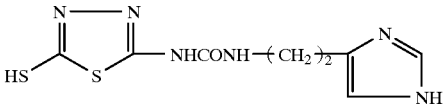
(III-30)
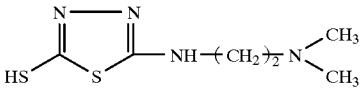
(III-31)
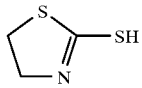
(III-32)
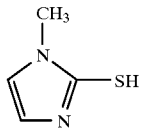
(III-33)
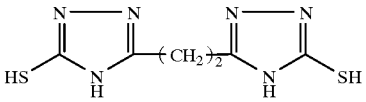
(III-34)
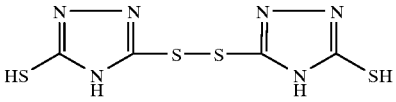
(IV-1)
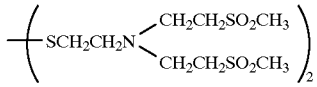
(IV-2)
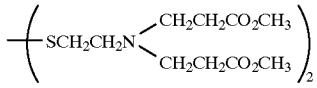
(IV-3)
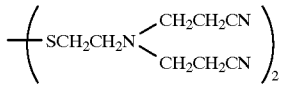
(IV-4)
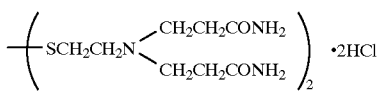
(IV-5)
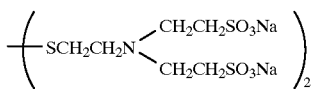

-continued (IV-6)

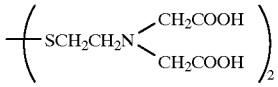

(IV-7)

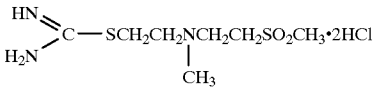

(IV-8)

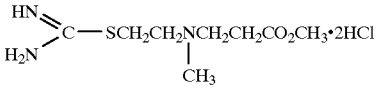

(IV-9)

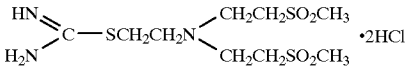

(IV-10)

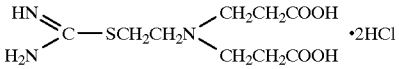

(IV-11)

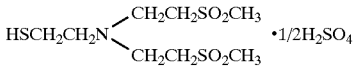

(IV-12)

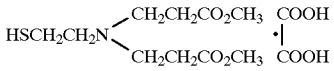

(IV-13)

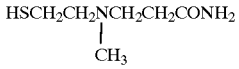

(IV-14)

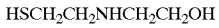

(IV-15)

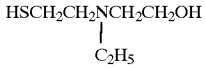

(V-1)

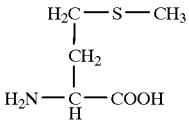

(V-2)

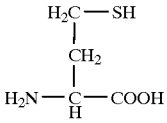

(V-3)

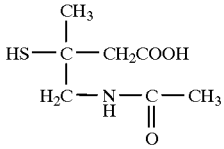

(V-4)

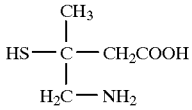

-continued (V-5)

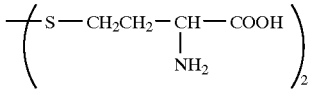

(V-6)

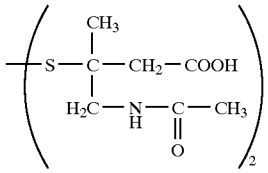

Among the above-mentioned compounds, I-2, II-6, III-9, III-10, III-13, III-31, IV-7, V-1, V-3 and V-5 are preferably to be used to attain the object of the invention. Compounds represented by Formula III or V are particularly preferable. As specifically preferable compounds, III-10, III-13 and V-3 can be cited.

In the present invention, the stabilizing soluton contains substantially no formaldehyde. For blocking the reactive site of a unreacted magenta coupler, it is preferable that the stabilizing solution or a replenishing solution for the stabilizing solution contains at least one compound represented by Formulas (F-1) to (F-13).

Formula F-1

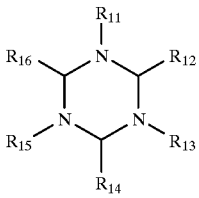

wherein $R_{11}$ to $R_{16}$ represent each a hydrogen atom or a monovalent organic group.

Formula F-2

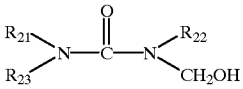

Formula F-3

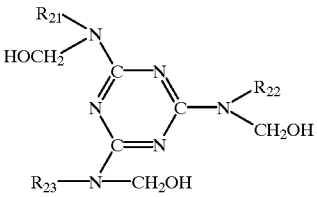

Formula F-4

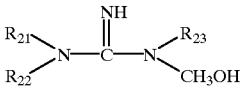

wherein $R_{21}$ to $R_{23}$ represent each a hydrogen atom or a methylol group.

Formula F-5

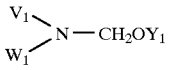

Formula F-6

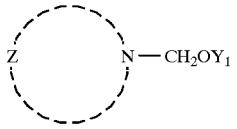

wherein $V_1$ and $W_1$ represent each an electron withdrawing group, $V_1$ and $W_1$ may be link with together to form a 5- or 6-member nitrogen-containing heterocyclic ring. $Y_1$ represents a hydrogen atom or a group capable of releasing by a hydrolysis reaction. Z represents a group of atoms necessary to form a single or condensed nitrogen-containing heterocyclic ring together with the nitrogen atom.

Formula F-7

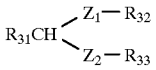

wherein $R_{31}$ represents a hydrogen atom or an aliphatic group; $R_{32}$ and $R_{33}$ represent each an aliphatic group or an aryl group, $R_{32}$ and $R_{33}$ may be linked with together to form a ring. $Z_1$ and $Z_2$ represent each an oxygen atom, a sulfur atom or —N($R_{34}$)—, provided that $Z_1$ and $Z_2$ are not oxygen atoms or —N($R_{34}$)— groups at the same time. $R_{34}$ represents a hydrogen atom, a hydroxyl group, an aliphatic group or an aryl group.

Formula F-8

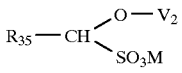

Formula F-9

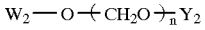

Formula F-10

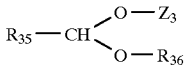

wherein $R_{35}$ represents a hydrogen atom or an aliphatic hydrocarbon group; $V_2$ represents a group capable of releasing by a hydrolysis reaction; M represents a cation; $W_2$ and $Y_2$ represent each a hydrogen atom or a group capable of releasing by a hydrolysis reaction; n represents an integer of 1 to 10; $Z_3$ represents a hydrogen atom, an aliphatic hydrocarbon group, an aryl group or a group capable of releasing by a hydrolysis reaction; $R_{36}$ represents an aliphatic hydrocarbon group or an aryl group. $Z_3$ may be linked with $R_{36}$ to form a ring.

Formula F-11

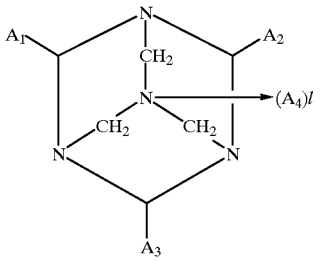

wherein $A_1$ to $A_4$ represent each a hydrogen atom, an alkyl group, an alkenyl group or a pyridyl group. 1 represents 0 or 1.

Formula F-12

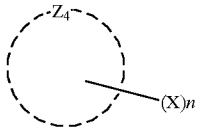

wherein $Z_4$ is a group of atoms necessary to form a hydrocarbon ring or a heterocyclic ring; and X represents an aldehyde group,

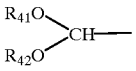

or

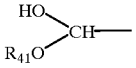

in which $R_{41}$ and $R_{42}$ represent each a lower alkyl group; n represents an integer of 1 to 4.

Formula F-13

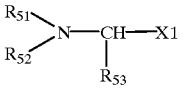

wherein $R_{51}$ to $R_{53}$ represent each a hydrogen atom, an alkyl group or an aryl group; X represents a nitrogen-containing heterocyclic group.

In Formula (F-1), $R_{11}$ to $R_{16}$ represent each a hydrogen atom or a monovalent organic group. The monovalent organic group includes an alkyl group, an aryl group, an alkenyl group, an aralkyl group, an amino group, an alkoxyl group, a hydroxyl group, an acyl group, a sulfonyl group, an alkylthio group, an arylthio group, a heterocyclic residue, a carbamoyl group, a sulfamoyl group and an alkylamino group.

These monovalent groups each may have a substituent such as a hydroxyl group, an acyl group, a sulfonyl group, a halogen atom, an amino group or a carboxyl group. Among them, a hydroxyl group and a halogen atom are preferable. The total number of carbon atoms included in the group represented $R_{11}$ to $R_{16}$ is preferably not more than 10.

Although the group consisting of $R_{11}$, $R_{13}$ and $R_{15}$, and the group consisting of $R_{12}$, $R_{14}$ and $R_{16}$ may be the same or different, it is preferable that the groups consisting the one of these groups are hydrogen atoms.

Examples of the compound represented by Formula (F-1) are described below. However, the compounds usable in the invention are not limited thereto.
F-1-1
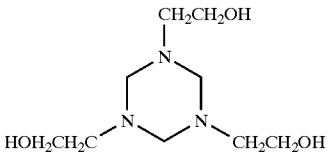
F-1-2
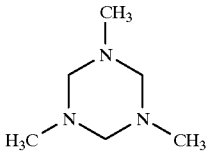
F-1-3
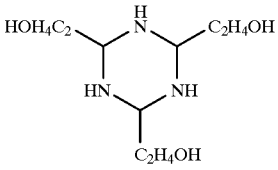
F-1-4
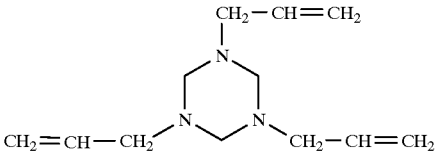
F-1-5
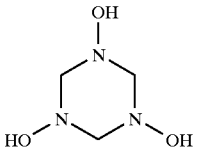
F-1-6
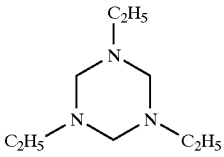
F-1-7
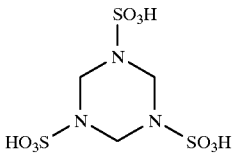
F-1-8
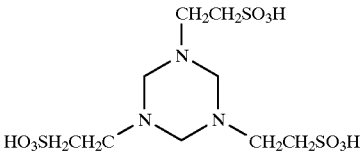
-continued
F-1-9
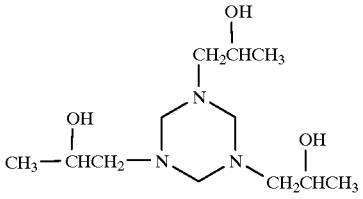
F-1-10
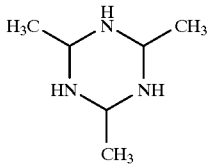
F-1-11
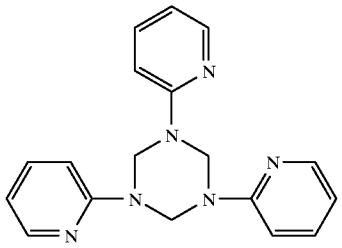
F-1-12
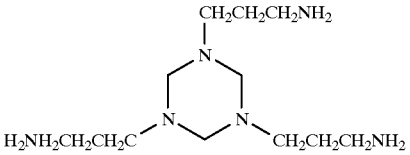
F-1-13
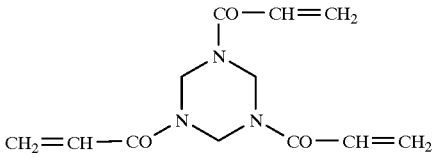
F-1-14
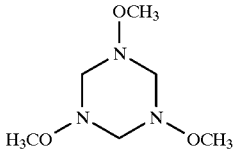
F-1-15
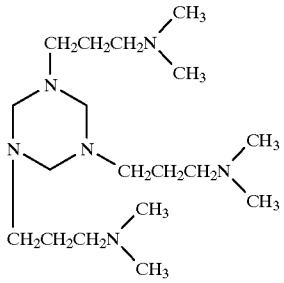

-continued

F-1-16

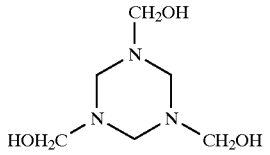

The triazine compound represented by Formula (F-1) is preferably used within the range of 0.05 to 50 g, more preferably 0.1 to 20 g, per liter of the processing solution.

Examples of methylol compound represented by (F-2), (F-3) or (F-4) include the followings.

(F-2-1) Dimethylolurea
(F-2-2) Trimethylolurea
(F-3-1) Trimethylolmelamine
(F-3-2) Tetramethylolmelamine
(F-3-3) Pentamethylolmelamine
(F-3-4) Hexamethylolmelamine
(F-4-1) Dimethylolguanidine
(F-4-2) Methylolguanidine
(F-4-3) Trimethylolguanidine Each of these compounds is preferably used within the range of 0.05 to 20 g, more preferably 0.1 to 10 g, per liter of the processing solution.

In Formula (F-5) and (F-6), an electron withdrawing group represented by $V_1$ or $W_1$ is selected from the groups having a positive $\sigma_p$ value of Hammett (Lange's Handbook of Chemistry 12th ed. Vol, 3, C. Hansch & A. Leo, Substituents for Constants for Correlation Analysis in Chemistry and Biology (Jone Wily & Sons, New York 1979)). Such group includes a an acyl group such as an acetyl group, benzoyl group or monochloroacetyl group, an alkoxycarbonyl group such as an ethoxycarbonyl group or methoxycarbonyl group, an aryloxycarbonyl group such as phenoxycarbonyl group or p-chlorophenoxycarbonyl group, a carbamoyl group such as N-methycarbamoyl group, N,N-tetramethylenecarbamoyl group or N-phenylcarbamoyl group, a cyano group, an alkylsulfonyl group such as methanesulfonyl group or ethanesulfonyl group, an arylsulfonyl group such as benzenesulfonyl group or p-toluenesulfonyl group, and a sulfamoyl group such as sulfamoyl group, N-methylsulfamoyl group or N,N-pentamethylene-sulfamoyl group.

The group capable of releasing by a hydrolysis reaction represented by $Y_1$ is includes a trialkyl-substituted silyl group such as trimethylsilyl group, an acyl group such as acetyl group, monochloroacetyl group or trichloroacetyl group, a sulfate group, an aminocarbonyl group such as N,N-dimethylcarbonyl group, N-methylcatbonyl group or N-phenylcarbonyl group, and a sulfonate group such as methanesulfonate, benzensulfonate or p-toluenesulfonate.

The nitrogen-containing 5- or 6-member heterocyclic group represented by Z includes single ring compounds each having an element composition of $[C_1N_4]$, $[C_2N_3]$, $[C_3N_2]$, $[C_4N]$, $[C_2N_4]$, $[C_3N_3]$, $[C_4N_2]$, $[C_5N]$, $[C_2N_2O]$, $[C_3NO]$, $[C_3N_2O]$ $[C_4NO]$, $[C_2N_2S]$, $[C_3NS]$, $[C_3N_2S]$, $[C_2N_2Se]$, $[C_3NSe]$ or $[C_3NTe]$, and condensed ring compounds each having an element composition of $[C_3N_2—C_6]$, $[C_4N—C_6]$, $[C_4N—C_3N_2]$, $[C_3N_2—C_3N_2]$, $[C_3N_2S—C_6]$, $[C_5N—C_5N]$, $[C_5N—C_6]$ or $[C_4N_2—C_6]$. These rings each may have a substituent, for example, an alkyl group such as methyl group, ethyl group, p-methoxyethyl group, benzyl group, carboxymethyl group or sulfopropyl group, an aryl group such as phenyl group or p-methoxyphenyl group, a hydroxyl group, an alkoxyl group such as methoxy group, ethoxy group or methoxyethoxy group, an aryloxy group such as phenoxy group or p-carboxyphenyl group, a carboxyl group, a sulfo group, an alkoxycarbonyl group such as methoxycarbonyl group or ethoxycarbonyl group, an aryloxycarbonyl group such as phenoxycarbonyl group, an amino group such as N,N-dimethyamino group, N-ethylamino group or N-phenylamino group, an acylamido group such as aceotamido group or benzamido group, a carbamoyl group such as carbamoyl group, N-methylcarbamoyl group or N,N-tetramethylenecarbamoyl group, a sulfonamido group such as methanesulfonamido group or benzenesulfonamido group, a sulfamoyl group such as N-ethylsulfamoyl group or N,N-dimethylsufamoyl group, an alkylsufonyl group such as methanesulfonyl group or ethanesulfonyl group, an arylsulfonyl group such as benzenesulfonyl group or p-toluenesulfonyl group, or an acyl group such as acetyl group or benzoyl group.

In formula (F-5), a 5- or 6-member heterocyclic ring formed through divalent electron withdrawing groups represented by $V_1$ and $W_1$ includes ones represented by the following Formula (F-5-a).

Formula (F-5-a)

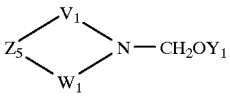

In the above formula, $V_1$ and $W_1$ represent each —CO—, —CO—O—, —SO—, —$SO_2$— or —CS—; $Z_5$ represents a group of non-metal atoms necessary to form a 5- or 6-member simple ring or condensed ring linking with $V_1$ and $W_1$.

The 5- or 6-member simple or condensed ring formed by $Z_5$ may have a substituent, for example, an alkyl group such as methyl group, ethyl group, methoxyethyl group, benzyl group, carboxymethyl group or sulfopropyl group, an aryl group such as phenyl group or p-methoxyphenyl group, a hydroxyl group, an alkoxyl group such as methoxy group, ethoxy group or methoxyethoxy group, an aryloxy group such as phenoxy group or p-carboxyphenyl group, a carboxyl group, a sulfo group, an alkoxycarbonyl group such as methoxycarbonyl group or ethoxycarbonyl group, an aryloxycarbonyl group such as phenoxycarbonyl group, an amino group such as N,N-dimethyamino group, N-ethylamino group or N-phenylamino group, an acylamido group such as aceotamido group or benzamido group, a carbamoyl group such as carbamoyl group, N-methylcarbamoyl group or N,N-tetramethylenecarbamoyl group, a sulfonamido group such as methanesulfonamido group or benzenesulfonamido group, a sulfamoyl group such as N-ethylsulfamoyl group or N,N-dimethylsufamoyl group, an alkylsufonyl group such as methanesulfonyl group or ethanesulfonyl group, an arylsulfonyl group such as benzenesulfonyl group or p-toluenesulfonyl group, or an acyl group such as acetyl group or benzoyl group.

Examples of the compound represented by Formula (F-5) or (F-6) are described below. However, the compounds are not limited thereto.

F-5-1
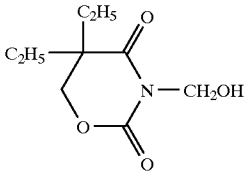
F-5-2
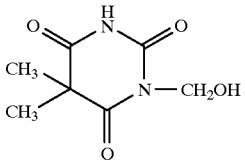
F-5-3
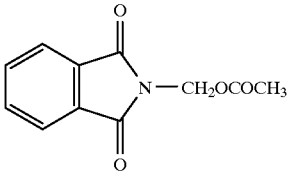
F-5-4
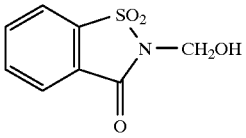
F-5-5
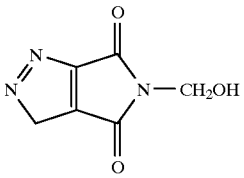
F-5-6
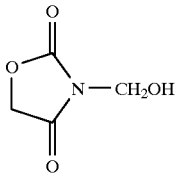
F-5-7
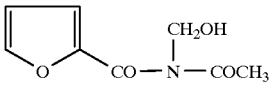
F-5-8
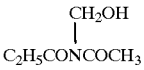
F-6-1
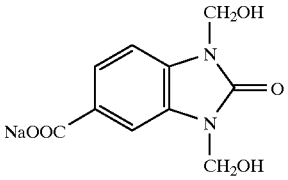
-continued
F-6-2
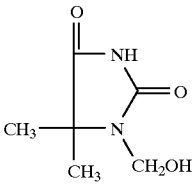
F-6-3
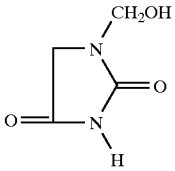
F-6-4
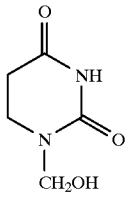
F-6-5
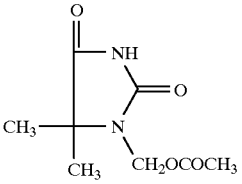
F-6-6
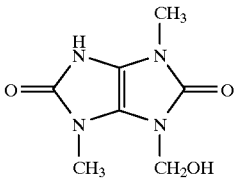
F-6-7
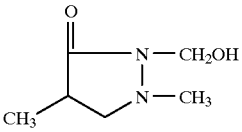
F-6-8
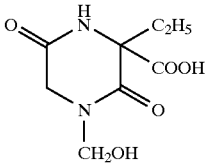
F-6-9
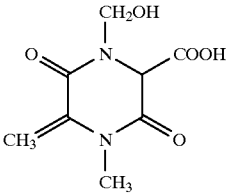

-continued

F-6-10

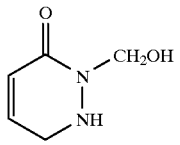

F-6-11

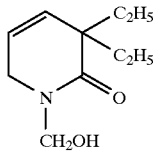

F-6-12

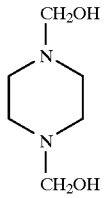

F-6-13

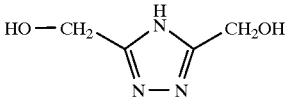

The adding amount of the compound represented by Formula (F-5) or (F-6) is approximately 0.01 to 20 g, preferably 0.03 to 15 g, more preferably 0.05 to 10 g, per liter of the processing solution.

In Formula (F-7), the aliphatic group represented by $R_{31}$, $R_{32}$ or $R_{33}$ includes a saturated alkyl group, i.e., a unsubstituted alkyl group such as methyl group, ethyl group or butyl group or a substituted alkyl grape such as benzyl group, carboxymethyl group hydroxymethyl group or methoxyethyl group, a unsaturated alkyl group such as ally group or 2-butenyl group, and a cycloalkyl group such as cyclopentyl group or cyclohexyl group.

The aryl group represented by $R_{31}$, $R_{32}$ or $R_{33}$ includes ones substituted and unsubstituted. The substituent of the aryl group is, for example, an alkyl group such as methyl group, ethyl group, methoxyethyl group, benzyl group, carboxymethyl group or sulfopropyl group, an aryl group such as phenyl group or p-methoxyphenyl group, a hydroxyl group, an alkoxyl group such as methoxy group, ethoxy group or methoxyethoxy group, an aryloxy group such as phenoxy group or p-carboxyphenyl group, a carboxyl group, a sulfo group, an alkoxycarbonyl group such as methoxycarbonyl group or ethoxycarbonyl group, an aryloxycarbonyl group such as phenoxycarbonyl group, an amino group such as N,N-dimethyamino group, N-ethylamino group or N-phenylamino group, an acylamido group such as aceotamido group or benzamido group, a carbamoyl group such as carbamoyl group, N-methylcarbamoyl group or N,N-tetramethylenecarbamoyl group, a sulfonamido group such as methanesulfonamido group or benzenesulfonamido group, a sulfamoyl group such as N-ethylsulfamoyl group or N,N-dimethylsufamoyl group, an alkylsufonyl group such as methanesulfonyl group or ethanesulfonyl group, an arylsulfonyl group such as benzenesulfonyl group or p-toluenesulfonyl. group, or an acyl group such as acetyl group or benzoyl group.

A 5- to 8-member ring formed by linking $R_{32}$ with $R_{33}$ includes ones in which a part of carbon atoms of linking chain is replace by a hetero-atom.

As $R_{33}$, a hydrogen atom is preferable.

Examples of the compound represented by Formula (F-7) are described below. However, the compounds are not limited thereto.

F-7-1

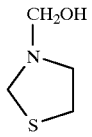

F-7-2

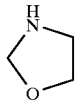

F-7-3

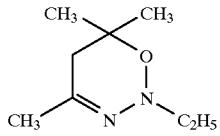

F-7-4

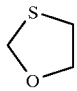

F-7-5

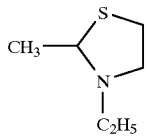

F-7-6

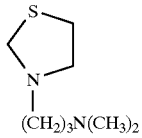

F-7-7

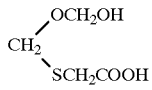

F-7-8

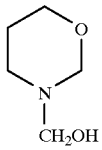

F-7-9

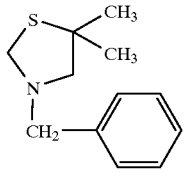

F-7-10

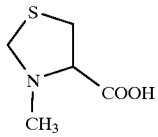

The adding amount of the compound represented by Formula (F-7) is approximately 0.01 to 20 g, preferably 0.03 to 15 g, more preferably 0.05 to 10 g, per liter of the processing solution.

In Formulas (F-8) to (F-10), the aliphatic hydrocarbon group represented by $R_{35}$, $R_{36}$ and $Z_3$ are each, for example, a saturated alkyl group, i.e., a unsubstituted alkyl group such as methyl group, ethyl group or butyl group or a substituted alkyl grape such as benzyl group, carboxymethyl group hydroxymethyl group or methoxyethyl group, a unsaturated alkyl group such as ally group or 2-butenyl group, or a cycloalkyl group such as cyclopentyl group or cyclohexyl group. The aryl group represented by $R_{36}$ or $Z_3$ may have a substituent, for example, an alkyl group such as methyl group, ethyl group, methoxyethyl group, benzyl group, carboxymethyl group or sulfopropyl group, an aryl group such as phenyl group or p-methoxyphenyl group, a hydroxyl group, an alkoxyl group such as methoxy group, ethoxy group or methoxyethoxy group, an aryloxy group such as phenoxy group or p-carboxyphenyl group, a carboxyl group, a sulfo group, an alkoxycarbonyl group such as methoxycarbonyl group or ethoxycarbonyl group, an aryloxycarbonyl group such as phenoxycarbonyl group, an amino group such as N,N-dimethyamino group, N-ethylamino group or N-phenylamino group, an acylamido group such as aceotamido group or benzamido group, a carbamoyl group such as carbamoyl group, N-methylcarbamoyl group or N,N-tetramethylenecarbamoyl group, a sulfonamido group such as methanesulfonamido group or benzenesulfonamido group, a sulfamoyl group such as N-ethylsulfamoyl group or N,N-dimethylsufamoyl group, an alkylsufonyl group such as methanesulfonyl group or ethanesulfonyl group, an arylsulfonyl group such as benzenesulfonyl group or p-toluenesulfonyl group, or an acyl group such as acetyl group or benzoyl group.

The group capable of releasing by a hydrolysis reaction represented by $V_2$, $W_2$ and $Z_3$ each are, for example, an acyl group such as acetyl group, benzoyl group, trifluoroacetyl group or monochloroacetyl group, or trialkylsilyl group such as trimethylsilyl group.

The ring formed by linking $R_{36}$ with $Z_3$ is a 5- to 8-member simple ring or condensed ring including ones in which a part of carbon atoms of liking chain is replaced by a hetero-atom. As concrete examples of them are 1,2-dioxane- cyclopentane, m-dioxin, trioxane, teraoxane and benzdioxorane.

The cation represented by M includes, for example, a hydrogen ion, an alkali metal ion such as an ion of lithium, sodium or potassium, an alkali earth metal ion such as an ion of magnesium or calcium, an ammonium ion, an organic ammonium ion such as an ion of triethyl ammonium, tripropyl ammonium or tetramethyl ammonium, and a pyridinium ion.

The aliphatic hydrocarbon group represented by $R_{35}$ is preferably a lower alkyl group having 1 or 2 carbon atoms. It is further preferable that $R_{35}$ is a hydrogen atom.

Examples of the compound represented by Formulas (F-8) to (F-10) are described below. However, the compounds are not limited thereto.

F-8-1

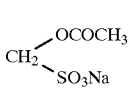

F-8-2

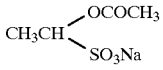

-continued

F-8-3

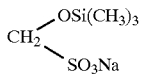

F-8-4

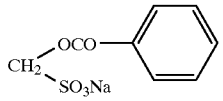

F-9-1

$CH_3COO(CH_2O)_3COCH_3$

F-9-2

$CH_3COO(CH_2O)_2COCH_3$

F-9-3

$CH_3COO(CH_2O)_4COCH_3$

F-9-4

$HO(CH_2O)_{10}H$

F-9-5

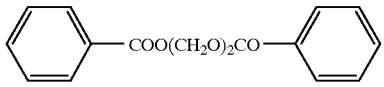

F-9-6

$CH_3OCH_2OH$

F-9-7

$ClH_2COO(CH_2O)_4COCH_2Cl$

F-10-1

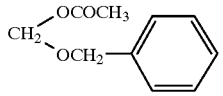

F-10-2

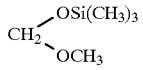

F-10-3

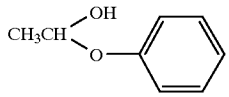

F-10-4

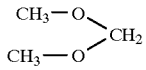

F-10-5

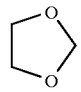

F-10-6

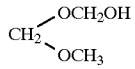

F-10-7

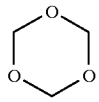

F-10-8

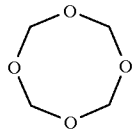

-continued

F-10-9

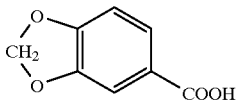

The adding amount of the compound represented by Formulas (F-8) to (F-10) is approximately 0.01 to 20 g, preferably 0.03 to 15 g, more preferably 0.05 to 10 g, per liter of the processing solution.

As a salt of the compound represented by Formula (F-11), an inorganic salt such as a hydrochloride, sulfate or nitrate, an organic salt such as a phenol salt, a double salt or complex salt with a metal salt, a hydrated salt and an intramolecular salt are described.

As the compound represented by Formula (F-11). those described in Beilsteins Hndbuch der Organischen Chemie, Vol. 26 of $2^{nd}$ revised edition, p.p. 200 to 212 are cited. Among them water-soluble ones are preferable. Examples of those are described below.

F-11-1

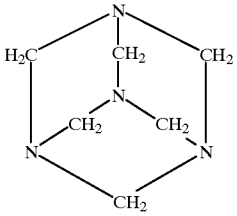

F-11-2

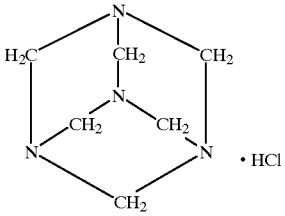

F-11-3

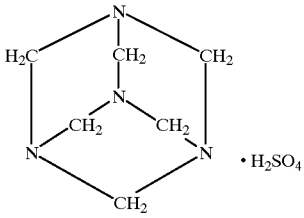

F-11-4

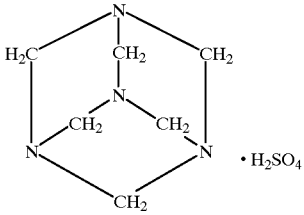

-continued

F-11-5

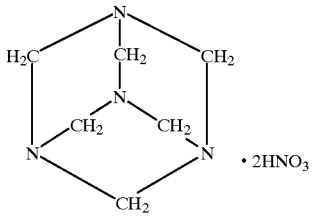

F-11-6

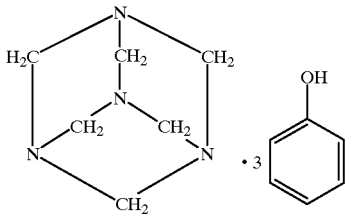

F-11-7

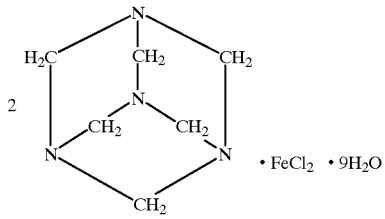

F-11-8

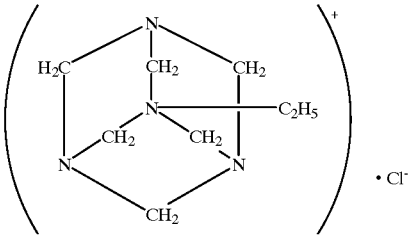

F-11-9

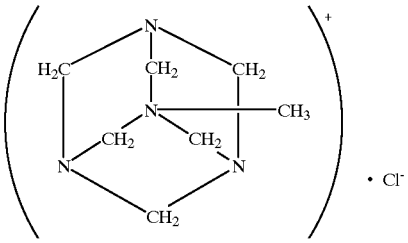

F-11-10

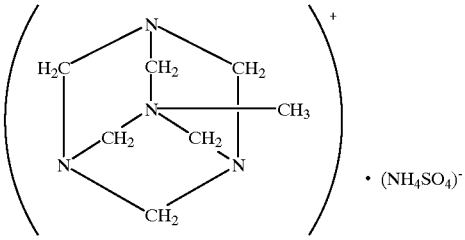

-continued
F-11-11
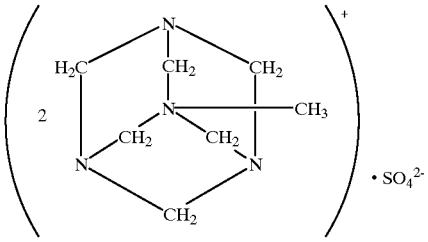
F-11-12
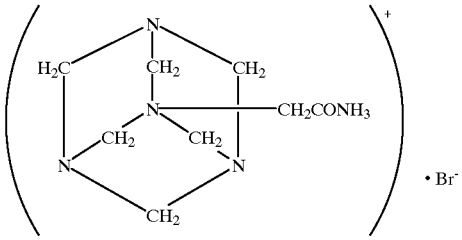
F-11-13
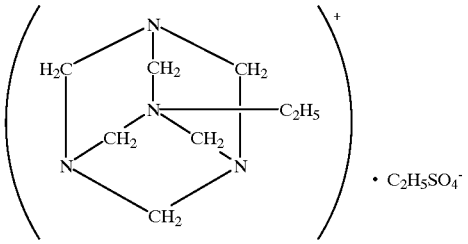
F-11-14
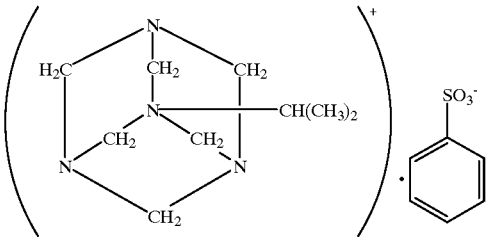
F-11-15
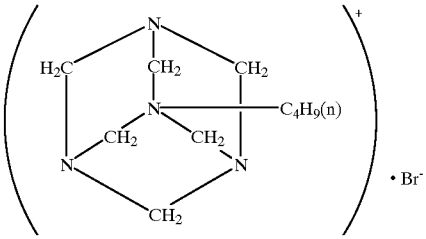
F-11-16
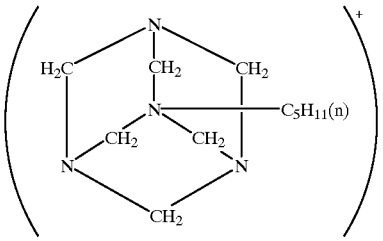
-continued
F-11-17
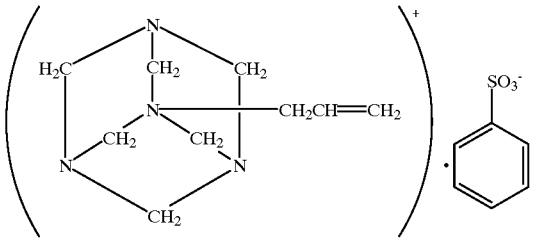
F-11-18
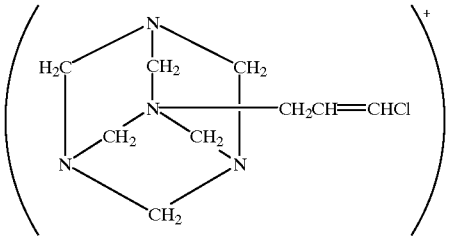
F-11-19
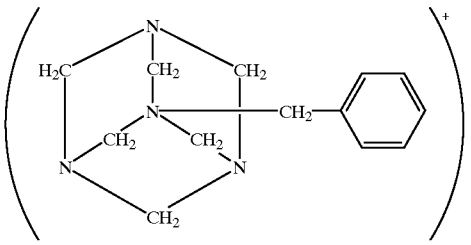
F-11-20
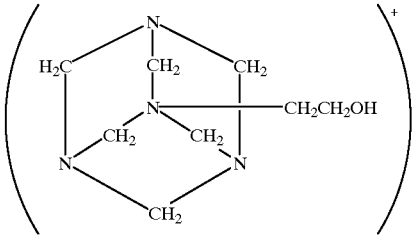
F-11-21
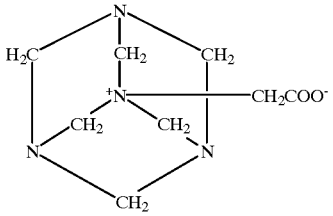
F-11-22
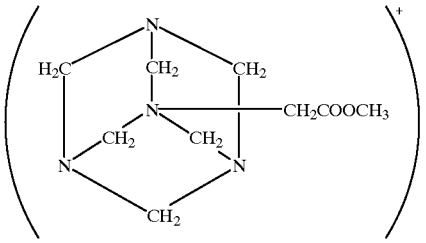

-continued

F-11-23

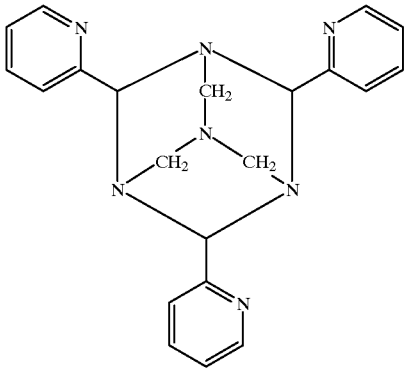

F-11-24

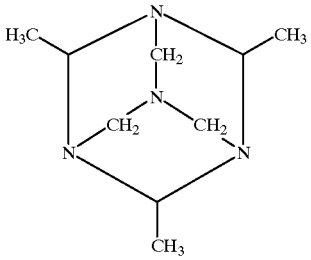

F-11-25

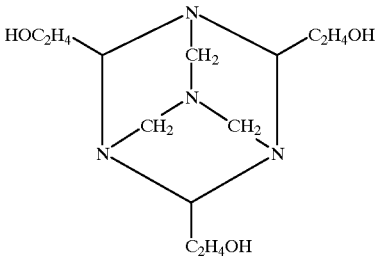

The preferable adding amount of the compound represented by Formula (F-11) is approximately 0.01 to 20 g per liter of the processing solution.

In formula (F-12), $Z_4$ represents a group of atoms necessary to form a substituted or unsubstituted carbon ring or a substituted or unsubstituted heterocyclic ring. The carbon ring and the heterocyclic ring may be a simple ring of a condensed ring. It is preferable that $Z_4$ is an aromatic hydrocarbon ring or a heterocyclic ring each having a substituent. It is preferable that the substituent of $Z_4$ is an aldehyde group, a hydroxyl group, an alkyl group such as methyl group, ethyl group, methoxyethyl group, benzyl group, carboxymethyl group or sulfopropyl group, an aralkyl group, an alkoxyl group such as methoxy group, ethoxy group or methoxyethoxy group, a halogen atom, a nitro group, a sulfo group, a carbonyl group, an amino group such as N,N-dimethyamino group, N-ethylamino group or N-phenylamino group, a hydroxyalkyl group, an aryl group such as phenyl group or p-methoxyphenyl group, a cyano group, an aryloxy group such as phenoxy group or p-carboxyphenyl group, an acyloxy group, an acylamino group, a sulfonamido group, a sulfamoyl group such as N-ethylsulfamoyl group or N,N-dimethylsufamoyl group, a carbamoyl group such as carbamoyl group, N-methylcarbamoyl group or N,N-tetramethylenecarbamoyl group, or a sulfonyl group such as methanesulfonyl group, ethanesulfonyl group, benzenesulfonyl group or p-toluenesulfonyl group.

The carbon ring represented by $Z_4$ is preferably a benzene ring, and the heterocyclic ring represented by $Z_4$ is preferably a 5-or 6-member heterocyclic ring. The 5-member ring includes, for example, a ring of thiophene, pyrrole, furane, thiazole, imidazole, succinimide, triazole, and tetrazole and the 6-member ring includes, for example, a ring of pyridine, pyrimidine , triazine and thiadiazine.

As the condensed ring, a ring of naphthalene, benzofurane, indol, thionaphthalene, bezimidazole and quinoline are described.

Preferable examples of the compound represented by Formula (F-12) are described below.

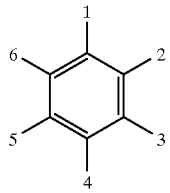

Exemplified compounds (F-12-1) to (F-12-52) are obtained by inserting a substituent to 1- to 6-position of the above formula as mentioned in the following table.

| No. | 1 | 2 | 3 | 4 | 5 | 6 |
|---|---|---|---|---|---|---|
| (C-12-1) | —CHO | H | H | H | H | H |
| (C-12-2) | —CHO | H | H | —OH | H | H |
| (C-12-3) | —CHO | H | —OH | H | H | |
| (C-12-4) | —CHO | —OH | H | H | H | H |
| (C-12-5) | —CHO | —OH | H | —OH | H | H |
| (C-12-6) | —CHO | H | —OH | H | —OH | H |
| (C-12-7) | —CHO | —OH | —OH | H | H | H |
| (C-12-8) | —CHO | H | —CHO | H | —OH | H |
| (C-12-9) | —CHO | H | —CHO | H | H | —OH |
| (C-12-10) | —CHO | —OH | —CHO | H | H | H |
| (C-12-11) | —CHO | H | —CHO | H | —CHO | H |
| (C-12-12) | —CHO | —OH | —CHO | H | —CHO | H |
| (C-12-13) | $—CH(OCH_3)_2$ | H | —OH | H | H | H |
| (C-12-14) | $—CH(OCH_3)_2$ | H | H | —OH | H | H |
| (C-12-15) | $—CH(OCH_3)_2$ | H | —OH | H | —OH | H |
| (C-12-16) | —CHO | H | $—NO_2$ | H | H | H |
| (C-12-17) | —CHO | H | H | $—NO_2$ | H | H |
| (C-12-18) | —CHO | $—NO_2$ | H | H | H | H |

-continued

| No. | 1 | 2 | 3 | 4 | 5 | 6 |
|---|---|---|---|---|---|---|
| (C-12-19) | —CHO | H | —$NO_2$ | H | —$NO_2$ | H |
| (C-12-20) | —CHO | H | H | —$OCH_3$ | H | H |
| (C-12-21) | —CHO | H | —$OCH_3$ | H | —OH | H |
| (C-12-22) | —CHO | H | —OH | —$OCH_3$ | H | H |
| (C-12-23) | —CHO | H | —$OCH_3$ | —OH | H | H |
| (C-12-24) | —CHO | H | —OH | —$OCH_3$ | —OH | H |
| (C-12-25) | —CHO | H | Cl | H | H | H |
| (C-12-26) | —CHO | H | H | Cl | H | H |
| (C-12-27) | —CHO | H | Cl | H | Cl | H |
| (C-12-28) | —CHO | H | —COOH | —COOH | H | H |
| (C-12-29) | —CHO | H | Br | H | H | H |
| (C-12-30) | —CHO | H | H | Br | H | H |
| (C-12-31) | —CHO | H | —OH | —$SO_3H$ | H | H |
| (C-12-32) | —CHO | H | H | —$NH_2$ | H | H |
| (C-12-33) | —CHO | H | H | —$N(CH_3)_2$ | H | H |
| (C-12-34) | —CHO | H | H | —$N(C_2H_5)_2$ | H | H |
| (C-12-35) | —CHO | H | H | —$CONH_2$ | H | H |
| (C-12-36) | —CHO | H | H | —$SO_2NH_2$ | H | H |
| (C-12-37) | —CHO | H | H | —$SO_3H$ | H | H |
| (C-12-38) | —CHO | H | H | —CN | H | H |
| (C-12-39) | —CHO | H | H | —$COOCH_3$ | H | H |
| (C-12-40) | —CHO | H | H | —COOH | H | H |
| (C-12-41) | —CHO | H | —$SO_3H$ | H | H | H |
| (C-12-42) | —CHO | H | —COOH | H | H | H |
| (C-12-43) | —CHO | H | —CN | H | H | H |
| (C-12-44) | —CHO | H | —$COOCH_3$ | H | H | H |
| (C-12-45) | —CHO | H | —$CONH_2$ | H | H | H |
| (C-12-46) | —CH(OH)—$OCH_3$ | H | —OH | H | H | H |
| (C-12-47) | —CH(OH)—$OCH_3$ | H | H | —OH | H | H |
| (C-12-48) | —CHO | H | —OH | —$CH_3$ | H | H |
| (C-12-49) | —CHO | —$SO_3Na$ | H | H | H | H |
| (C-12-50) | —CHO | H | —$O(CH_2)_3SO_3Na$ | H | H | H |
| (C-12-51) | —CHO | H | —$CH_2SO_3Na$ | H | H | H |
| (C-12-52) | —CHO | —OH | —OH | —CHO | H | H |

(F-12-53)

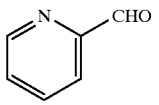

(F-12-54)

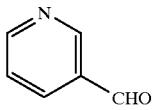

(F-12-55)

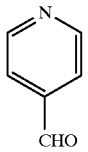

(F-12-56)

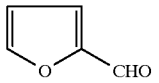

(F-12-57)

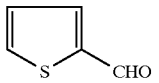

-continued
| No. | 1 | 2 | 3 | 4 | 5 | 6 |
|---|---|---|---|---|---|---|
| (F-12-58) | | | 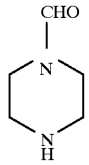 | | | |
| (F-12-59) | | | 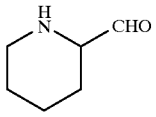 | | | |
| (F-12-60) | | | 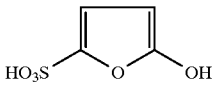 | | | |
| (F-12-61) | | | 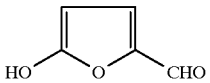 | | | |
| (F-12-62) | | | 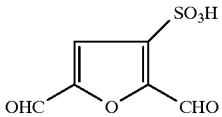 | | | |
| (F-12-63) | | | 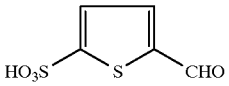 | | | |
| (F-12-64) | | | 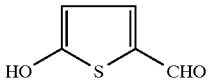 | | | |
| (F-12-65) | | | 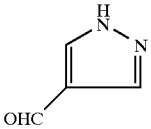 | | | |
| (F-12-66) | | | 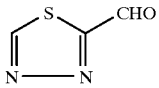 | | | |
| (F-12-67) | | | 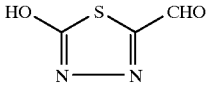 | | | |
| (F-12-68) | | | 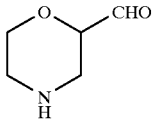 | | | |
| (F-12-69) | | | 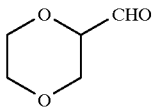 | | | |

-continued

| No. | 1 | 2 | 3 | 4 | 5 | 6 |
|---|---|---|---|---|---|---|
| (F-12-70) | | | | | | |
| (F-12-71) | | | | | | |
| (F-12-72) | | | | | | |
| (F-12-73) | | | | | | |
| (F-12-74) | | | | | | |
| (F-12-75) | | | | | | |
| (F-12-76) | | | | | | |
| (F-12-77) | | | | | | |

Among the exemplified compounds represented by Formula (F-12), (F-12-2), (F-12-3), (F-12-4), (F-12-6), (F-12-23), (F12-24) and (F-12-52) are preferable, and (F-12-3) is most preferable.

The compounds represented by Formula (F-12) are easily available on the market.

The adding amount of the compound represented by Formula (F-12) is preferably 0.05 to 20 g, more preferably 0.1 to 15 g, further preferably 0.5 to 10 g, per liter of the processing solution.

In formula (F-13), $R_{51}$, $R_5$2, and $R_{53}$ represent each a hydrogen atom, an alkyl group which may have a substituent such as methyl group, ethyl group, methoxyethyl group, benzyl group, carboxymethyl group, sufloprpyl group, hydroxyethyl group, n-propyl group, iso-propyl group, chloromethyl group or carboxyethyl group, or an aryl group such as phenyl group, p-methoxyphenyl group, m-sulfophenyl group or m-carboxyphenyl group; X represents a heterocyclic ring which may have a substituent such as a ring of pyrrol, imidazole, piperidine, pyrazole, succinimide, triazole, tetrazole thiadiazine, thiadiazoline, morpholine, piperadine, thiamorpholine, indole, indazole, benzimidazole, benzotriazole, pyrrolydine, pyrazoline, hydantoine or urazole.

Exemplified compounds if the compound represented by Formula (F-13) are described below.

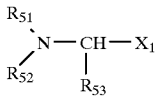
| No. | $R_{51}$ | $R_{52}$ | $R_{53}$ | $X_1$ |
|---|---|---|---|---|
| F-13-1 | $-CH_3$ | $-CH_3$ | —H | 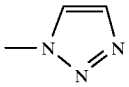 |
| F-13-2 | $-CH_3$ | $-CH_3$ | —H | 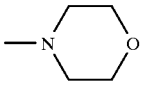 |
| F-13-3 | $-CH_3$ | $-CH_3$ | —H | 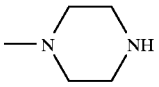 |
| F-13-4 | $-CH_3$ | —H | —H | 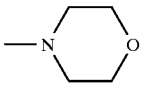 |
| F-13-5 | $-CH_3$ | $-C_2H_5$ | —H | 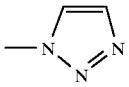 |
| F-13-6 | $-C_2H_5$ | $-C_2H_5$ | —H | 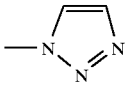 |
| F-13-7 | $-CH(CH_3)CH_3$ | $-CH(CH_3)CH_3$ | —H | 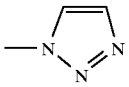 |
| F-13-8 | $-CH_3$ | —H | —H | 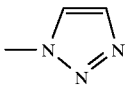 |
| F-13-9 | $-CH_3$ | $-C_2H_5$ | —H | 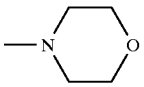 |
| F-13-10 | $-C_2H_5$ | $-C_2H_5$ | —H | 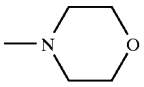 |
| F-13-11 | $-CH_3$ | —H | —H | 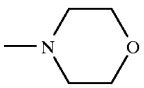 |

-continued
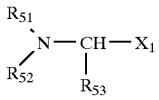
| No. | $R_{51}$ | $R_{52}$ | $R_{53}$ | $X_1$ |
|---|---|---|---|---|
| F-13-12 | —CH(CH$_3$)CH$_3$ | —CH(CH$_3$)CH$_3$ | —H | 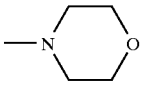 |
| F-13-13 | 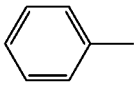 | —H | —H | 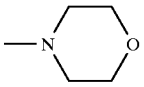 |
| F-13-14 | —CH$_3$ | —C$_2$H$_5$ | —H | 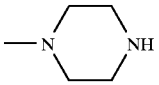 |
| F-13-15 | —H | —H | —H | 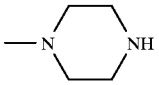 |
| F-13-16 | —CH$_3$ | —CH(CH$_3$)CH$_3$ | —H | 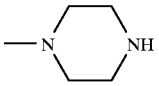 |
| F-13-17 | —CH(CH$_3$)CH$_3$ | —CH(CH$_3$)CH$_3$ | —H | 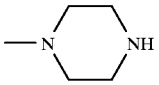 |
| F-13-18 | —CH$_3$ | —CH$_3$ | 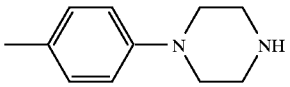 | |
| F-13-19 | —C$_2$H$_5$ | —C$_2$H$_5$ | —H | 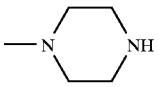 |
| F-13-20 | —CH$_3$ | —CH$_3$ | —H | 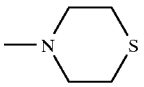 |
| F-13-21 | —CH$_3$ | —C$_2$H$_5$ | —H | 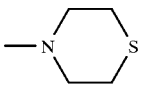 |
| F-13-22 | —C$_2$H$_5$ | —C$_2$H$_5$ | —H | 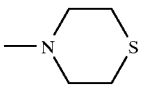 |

-continued
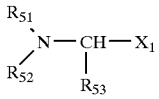
| No. | $R_{51}$ | $R_{52}$ | $R_{53}$ | $X_1$ |
|---|---|---|---|---|
| F-13-23 | $—CH_3$ | $—CH_3$ | —H | 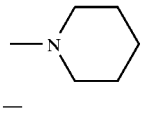 |
| F-13-24 | $—CH_3$ | $—CH_3$ | —H | 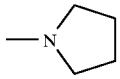 |
| F-13-25 | 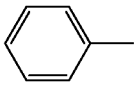 | $—CH_3$ | $—CH_3$ | 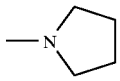 |
| F-13-26 | 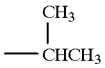 | $—CH_3$ | —H | 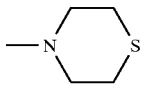 |
| F-13-27 | $—CH_3$ | —H | —H | 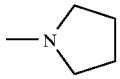 |
| F-13-28 | $—CH_3$ | $—C_2H_5$ | —H | 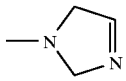 |
| F-13-29 | $—CH_3$ | $—CH_3$ | —H | 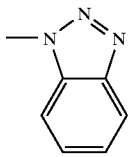 |
| F-13-30 | $—CH_3$ | —H | —H | 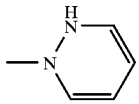 |
| F-13-31 | $—CH_3$ | $—CH_3$ | 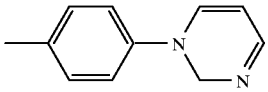 | |
| F-13-32 | $—CH_3$ | —H | —H | 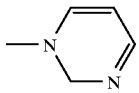 |

-continued
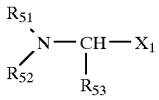
| No. | $R_{51}$ | $R_{52}$ | $R_{53}$ | $X_1$ |
|---|---|---|---|---|
| F-13-33 | —$CH_3$ | —$CH_3$ | —H | 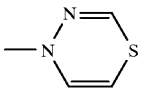 |
| F-13-34 | 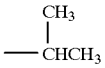 | —H | —H | 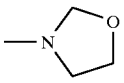 |
| F-13-35 | —$CH_3$ | —$CH_3$ | —H | 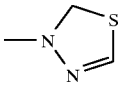 |
| F-13-36 | —$CH_3$ | —$CH_3$ | —H | 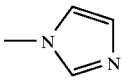 |
| F-13-37 | —$CH_3$ | —$CH_3$ | —H | 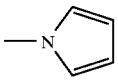 |
| F-13-38 | —$CH_3$ | —$CH_3$ | —H | 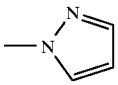 |
| F-13-39 | —$CH_3$ | —$CH_3$ | —H | 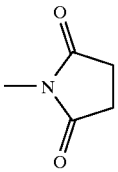 |
| F-13-40 | —$CH_3$ | —$CH_3$ | —H | |
| F-13-41 | —$C_2H_5$ | —$C_2H_5$ | | |
| F-13-42 | —$CH_3$ | —H | —H | |
| F-13-43 | —$CH_3$ | —H | OH | |
| F-13-44 | —$C_2H_5$ | —$C_2H_5$ | —H | |
| F-13-45 | —$CH_3$ | —$CH_3$ | —$CH_3$ | |
| F-13-46 | —$CH_3$ | —$CH_3$ | —H | |
| F-13-47 | —$CH_3$ | —$CH_3$ | —H | |
| F-13-48 | —$CH_3$ | —$CH_3$ | —H | |
| F-13-49 | —$CH_3$ | —$CH_3$ | —H | |
| F-13-50 | —$CH_3$ | —$CH_3$ | —H | |

-continued
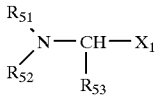
| No. | $R_{51}$ | $R_{52}$ | $R_{53}$ | $X_1$ |
|---|---|---|---|---|
| F-13-51 | $—CH_3$ | $—CH_3$ | —H | 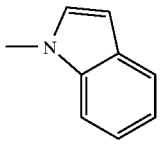 |
| F-13-52 | $—CH_3$ | $—CH_3$ | —H | 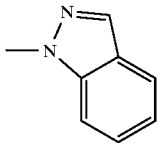 |
| F-13-53 | $—CH_3$ | $—CH_3$ | —H | 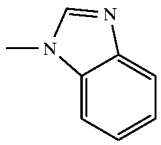 |
| F-13-54 | $—CH_3$ | $—CH_3$ | —H | 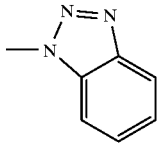 |
| F-13-55 | $—CH_3$ | $—CH_3$ | —H | 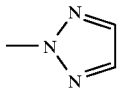 |
| F-13-56 | $—CH_3$ | $—CH_3$ | —H | 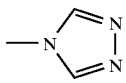 |
| F-13-57 | $—CH_3$ | $—CH_3$ | —H | 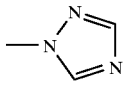 |
| F-13-58 | $—CH_3$ | $—C_2H_5$ | —H | 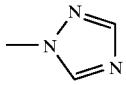 |
| F-13-59 | $—C_2H_5$ | $—C_2H_5$ | —H | 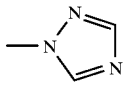 |

-continued
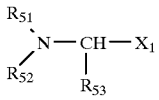
| No. | $R_{51}$ | $R_{52}$ | $R_{53}$ | $X_1$ |
|---|---|---|---|---|
| F-13-60 | —CH(CH$_3$)—CH$_3$ | —CH$_3$ | —H | 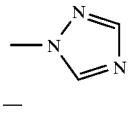 |
| F-13-61 | —CH$_3$ | —CH$_3$ | —H | 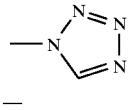 |
| F-13-62 | —C$_2$H$_5$ | —CH$_3$ | —H | 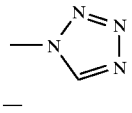 |
| F-13-63 | —C$_2$H$_5$ | —C$_2$H$_5$ | —H | 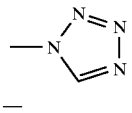 |
| F-13-64 | —CH(CH$_3$)—CH$_3$ | —C$_2$H$_5$ | —H | 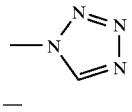 |
| F-13-65 | —CH$_2$CH$_2$OH | —CH$_2$CH$_2$OH | —H | 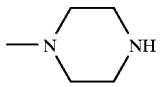 |
| F-13-66 | —CH$_2$OH | —CH$_2$OH | —H | 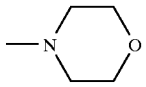 |
| F-13-67 | —CH$_2$COOH | —CH$_2$COOH | —H | 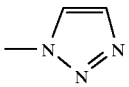 |
| F-13-68 | —CH$_3$ | —CH$_3$ | —CH$_3$ | 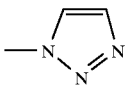 |
| F-13-69 | —C$_2$H$_4$OH | —C$_2$H$_4$OH | —H | 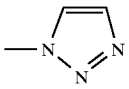 |
| F-13-70 | —CH$_3$ | —CH$_3$ | —H | 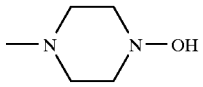 |

-continued

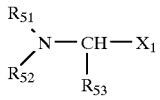

| No. | $R_{51}$ | $R_{52}$ | $R_{53}$ | $X_1$ |
|---|---|---|---|---|
| F-13-71 | $—C_2H_4SO_3H$ | $—C_2H_4SO_3H$ | —H | 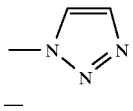 |
| F-13-72 | $—C_2H_4OH$ | $—C_2H_4OH$ | —H | 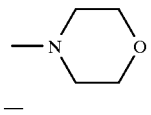 |
| F-13-73 | $—C_2H_4OH$ | $—C_2H_4OH$ | —H | 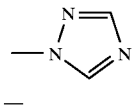 |
| F-13-74 | $—C_2H_4OH$ | $—C_2H_4OH$ | $—C_2H_4OH$ | 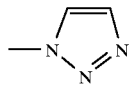 |
| F-13-75 | $—C_2H_4OH$ | $—C_2H_4OH$ | $—C_2H_4OH$ | 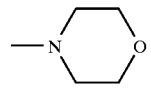 |
| F-13-76 | $—CH_3$ | $—CH_3$ | $—CH_2CH_2OH$ | 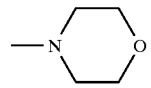 |

Among these compounds represented by Formula (F-13), (F13-1), (F-13-2), (F-13-3), (F-13-8), (F-13-10), (F-13-10), (F13-14), (F-13-35), (F-13-36), (F-13-39), (F-13-45), (F-13-55), (F-13-60), (F-13-65), (F-13-67), (F-13-68), (F-13-69), (F-13-72) and (F-13-74) are preferable.

The compounds represented by Formula (F-13) are easily available on the market.

Among compounds represented by the above-mentioned Formulas F-1 through F-13, those represented by Formulas F-3, F-4, F-6 or F-12 are preferable, and those represented by Formula F-12 are more preferable.

The adding amount of the compound represented by Formula (F-13) is preferably 0.05 to 20 g, more preferably 0.1 to 15 g, further preferably 0.5 to 10 g, per liter of the processing solution.

It is preferable embodiment of the invention the stabilizing solution contains a compound represented by Formula (2) or (3).

Formula (2)

$$R_{54}—O—(R_{55}—O)_m—X_2$$

In the formula, $R_{54}$ represent an organic group; $R_{55}$ represents an ethylene group, a trimethylene group of a propylene group; m represents an integer of 4 to 50. $X_2$ represents a hydrogen atom, $—SO_3M_1$ or $—PO_3M_2$, in which $M_1$ and $M_2$ represent each a hydrogen atom, an alkali metal atom or an ammonium group.

Formula (3)

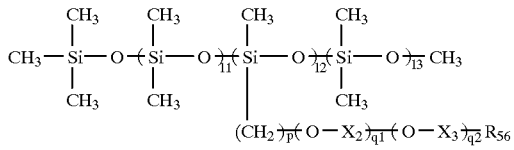

In the formula, $R_{56}$ represents a hydroxyl group, a lower alkyl group, an alkoxyl group,

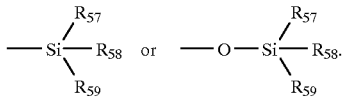

$R_{57}$, $R_{58}$ and $R_{59}$ represent each a hydrogen atom, a lower alkyl group, preferably an alkyl group having 1 to 4 carbon atoms such as a methyl group, ethyl group or propyl group; $R_{57}$, $R_{58}$ and $R_{59}$ may be the same or different. $l_1$ to $l_3$ represent each an integer of 1 to 30; p, $q_1$ and $q_2$ represent each an integer of 0 or 1 to 30. $X_3$ and $X_4$ represent each an ethylene group, trimethylene group,

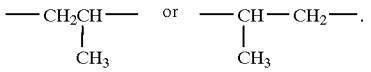

The compound of the above Formula (2) is further described below. $R_{45}$ in the formula is a monovalent organic group, for example, an alkyl group having 4 to 30, preferably 6 to 20 carbon atoms such as a hexyl group, heptyl group, octyl group, nonyl group, decyl group, undecyl group or dodecyl group, or an aryl group substituted with an alkyl group having 3 to 20 carbon atoms. The preferable substituent of the aryl group is an alkyl group having 3 to 12 carbon atoms such as a propyl group, butyl group, pentyl group, hexyl group, heptyl group, octyl group, decyl group, undecyl group or dodecyl group. The above aryl group includes a phenyl group, tolyl group, xynyl group, biphenyl group and naphthyl group, and a phenyl group and tolyl group are preferable. The alkyl group may be bonded at any of ortho-, meta- and parapositions of the aryl group. $R_{55}$ represents an ethylene group or a trimethylene group, both of them may have a substituent; m represents an integer of 4 to 50; $X_2$ represents a hydrogen atom, $—SO_3M_1$ or $—PO_3M_2$, in which $M_1$ and $M_2$ represent each a hydrogen atom, an alkali metal atom such as Na, K or Li, or $NH_4$.

Exemplified compounds represented by Formula (2) are described below.

(Exemplified compounds)

$C_{12}H_{25}O(C_2H_4O)_{10}H$ 2-1

$C_8H_{17}O(C_3H_6O)_{15}H$ 2-2

$C_9H_{19}O(C_2H_4O)_4SO_3Na$ 2-3

$C_{10}H_{21}O(C_2H_4O)_{15}PO_3Na_2$ 2-4

2-5

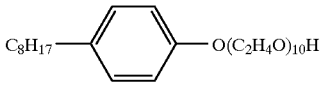

2-6

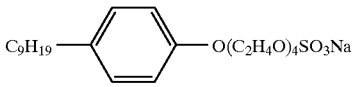

2-7

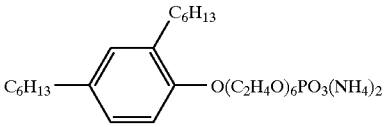

2-8

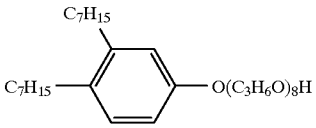

-continued 2-9

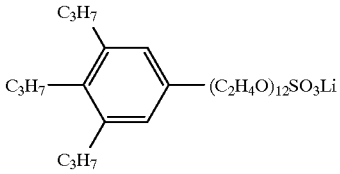

2-10

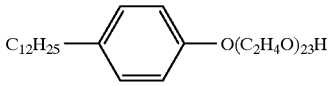

2-11

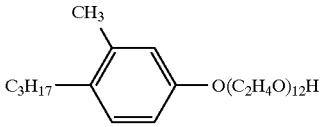

2-12

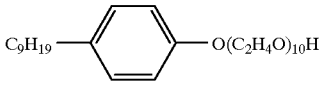

2-13

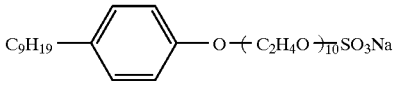

2-14

$C_{13}H_{27}O(C_2H_4O)_{10}H$ 2-15

$C_{15}H_{31}O(C_2H_4O)_{12}H$ 2-16

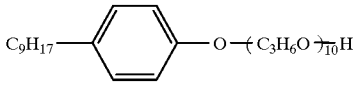

2-17

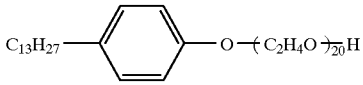

2-18

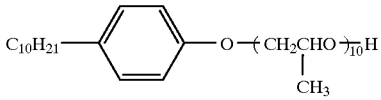

2-19

$C_{10}H_{21}O(C_2H_4O)_{10}H$

These compounds represented by Formula (2) can be used in an amount of 0.1 to 40 g, preferably 0.3 to 20 g, per liter of the stabilizing solution.

Exemplified compounds represented by Formula (3) are described below.

(Water-soluble organic siloxane compounds)

3-1

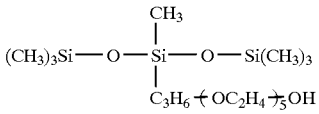

3-2

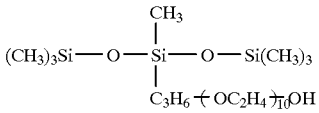

3-3

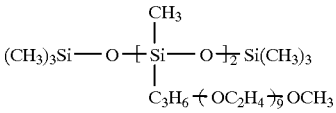

3-4

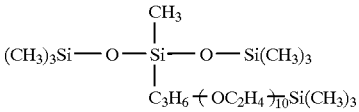

3-5

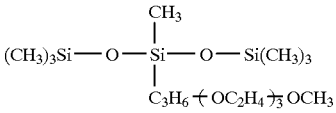

3-13

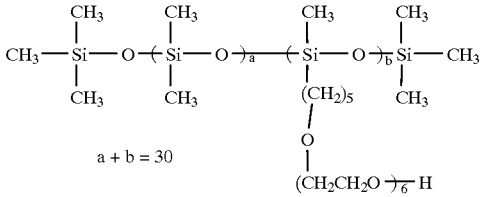

a + b = 30

3-14

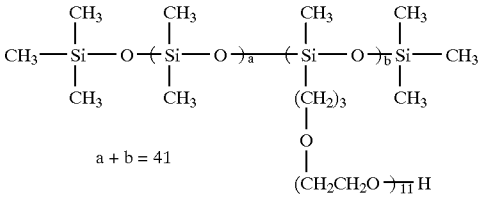

a + b = 41

3-15

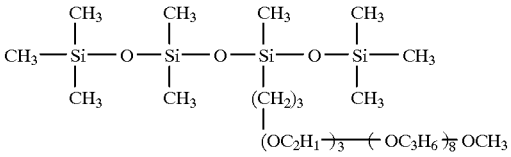

3-16

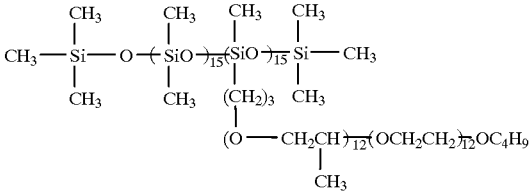

-continued 3-17

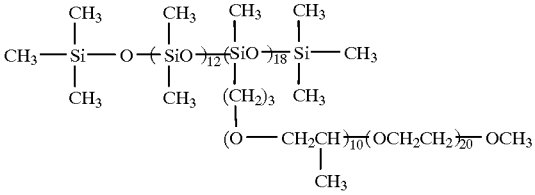

Effects of the water-soluble siloxane compound having a polyoxyalkylene group is enhanced when the compound is used in an amount of within the range of 0.01 to 20 g per liter of the stabilizing solution. The compound is particularly effective to prevent formation of precipitation formation and that of scratch marks.

The above-mentioned water-soluble organic siloxane compounds are ordinary ones such as those described in JP O.P.I. No. 47-18333/1972, Japanese Patent Examined Publication (JP) Nos. 55-51172/1980 and 51-37538/1976, JP O.P.I. No. 49-62128/1974 and US Pat. No. 3,545,970.

These water-soluble organic siloxane compounds are available from UCC (Union Carbide Co., Ltd.) or Sjin'etsu Kagaku Kogyo Co., Ltd.

Although silver halide contained in a light-sensitive material to be processed may be silver chloride, silver chlorobromide, silver bromide, silver iodobromide, or silver iodide, it is preferable that the light-sensitive material is one having a relatively high silver iodide content of not less than 5 mol % such as a light-sensitive material for phototaking.

The fixing solution relating the invention contains an agent so-called fixing agent.

As the fixing agent, a compound capable of forming a water-soluble complex salt by reaction with silver halide, for example, a thiosulfate such as potassium thiosulfate, sodium thiosulfate or ammonium thiosulfate, a thiocyanate such as potassium thiocyanate, sodium thiocyanate or ammonium thiocyanate, thiourea or a thioether are described. It is preferable that the fixing agent is a thiosulfate, for sufficiently enhancing the effects of the invention. It is particularly preferable that the ratio of ammonium sulfate to the all thiosulfates contained in the fixing solution is not more than 70 mole %. The above ratio of ammonium thiosulfate is more preferably not more than 50 mole %. further breferably not more 20 mole %.

In the invention, the ratio of the total weight of the compound represented by Formula I through IV or V to the weight of thiosulfate contained in the fixing solution is preferably not less than 0.02% and not more than 5% by weight, more preferably not less than 0.1% and not more than 2% by weight.

Other than the fixing agent, ones well known as usual additives for a fixing solution such as a pH buffer including various salts such as boric acid, borax, sodium hydroxide, potassium hydroxide, sodium carbonate, potassium carbonate, sodium bicarbonate, potassium bicarbonate, acetic acid, sodium acetate and ammonium hydroxide, alkylamines and polyethyleneoxide, may be optionally added to the fixing solution.

The fixing agent is used in an amount of 0.1 moles or more, preferably 0.6 to 4 moles, more preferably 0.9 to 3.0 moles, further preferably 1.1 to 2.0 moles, per liter of the processing solution.

In the invention, according to necessity, air or oxygen may be blown into a processing bath or a replenishing tank for raising an activity of the processing solution. An appropriate oxidizing agent such as hydrogen peroxide, bromic acid or persulfate is may be optionally added for the same purpose.

The fixing solution of the invention is preferably used within the range of pH value of 4 to 8.

The fixing solution of the invention may contains a sulfite or a compound capable of releasing sulfite. Such compound includes potassium sulfite, sodium sulfite, ammonium sulfite, ammonium hydrogen sulfite, potassium hydrogen sulfite, sodium hydrogen sulfite, potassium metabisulfite, sodium metabisulfite and ammonium metabisulfite. Further, formaldehyde-sodium bisulfite, acetaldehyde-sodium bisulfite, propionylaldehyde-sodium bisulfite, butylaldehyde-sodium bisulfite, butylaldehyde-sodium bisulfite, succinaldehyde-sodium bisulfite, glutaraldehyde-bis-sodium bisulfite, glutaraldehyde-bis-sodium bisulfite, β-methylglutalaldehydebis-sodium bisulfite and maleicdialdehyde-bis-sodium bisulfite are also usable.

These sulfite or sulfite releasing compound is used in an amount of not more than 0.1 moles, preferably 0.12 to 0.55 moles, more preferably 0.15 to 0.50 moles, particularly preferably 0.20 to 0.40 moles, in terms of sulfite, per liter of the fixing solution.

The number of tanks for stabilizing process may be either one or plural. Replenisher of the fixer may be either in a form of liquid or solid. It is preferable that the replenisher is in a form of solid from the viewpoint of providing a fixing procee in which a stable fixing ability is maintained when a small amount of light-sensitive material is processed per day, and a good storage ability is kept during a prolonged storage under a high temperature condition.

When the composition has a solid form, it is preferable that the ratio of the total weight of at least one compound represented by Formula I to IV or V, to the weight of thiosulfate is not less than 0.05% and not more than 5%, more preferably not less than 0.2% and not more than 2%, in total.

Decomposition and moisture absorption of thiosulfate in the solid processing composition due to storage under a high temperature and high moisture condition can be prevented by making use of sodium thiosulfate and /or potassium thiosulfate, and ammonium thiosulfate as thiosulfate component of the solid processing composition and making the ratio of the sum of the weight of sodium thiosulfate and/or potassium thiosulfate to not less than 2% by weight to the total weight of the thiosulfates contained in the composition.

When the composition is in a form of solid form, it is preferable to make the sum of the weight of sodium thiosulfate and/or potassium thiosulfate to not less than 2% and not more than 70%, particularly not less than 5% and not more than 20%, by weight to the total weight of the thiosulfates contained in the composition.

Although the solid processing composition containing a compound represented by Formula I to IV or V and a thiosulfate is preferably used for a fixer or bleach-fixer, the use of the composition is not limited thereto.

The solid fixer composition may be contained a known component of fixer, other than thiosulfate, such as sulfite, bisulfite, a sulfite-adduct, a mesoionic compound, thiocyanate, a chelating agent, a nonionic or anionic surfactant or a buffering agent. The solid bleach-fixer composition may be contains a known bleaching or fixing composition such as a halide, a ferric organic salt including a ferric complex of aminocarboxylic acid, an organic acid in a solid form, an antimold agent or a rust preventing agent.

In the solid processing composition, the preventing effects on decomposition of thiosulfate and powder formation caused by friction produced after storage for a prolonged period, can be enhanced by addition of a compound selected from polyethylene glycols, polyvinylpyrrolidones, polyvinyl alcohols and sugars.

It is preferable that the above-mentioned polyethylene glycol is a compound represented by the following Formula (I).

Formula (I)

$$HO—(A)n_1—(B)n_2—(D)n_3—H$$

In the above formula, A, B and D represent each $—CH_2CH_2O—$, $—CH_2CH(R)O—$, $—CH_2CH_2CH_2O—$ or $—CH_2CH(R)CH_2O—$, in which R represents a substituted or unsubstituted lower alkyl group (such as a methyl group, an ethyl group and a propyl group) or a hydroxyl group; and $n_1$, $n_2$ and $n_3$ are each an integer of 0 or 1 to 500, provided, however, that the average molecular weight of these compounds is preferably within the range of 2000 to 2000.

The particularly preferable exemplified compounds among those represented by the formula (I) will be given below.

| | | |
|---|---|---|
| A-1 | $HO\text{-}(CH_2CH_2O)_{n1}\text{-}H$ | Average molecular weight 300 |
| A-2 | $HO\text{-}(CH_2CH_2O)_{n1}\text{-}H$ | Average molecular weight 600 |
| A-3 | $HO\text{-}(CH_2CH_2O)_{n1}\text{-}H$ | Average molecular weight 1540 |
| A-4 | $HO\text{-}(CH_2CH_2O)_{n1}\text{-}H$ | Average molecular weight 2000 |
| A-5 | $HO\text{-}(CH_2CH_2O)_{n1}\text{-}H$ | Average molecular weight 3000 |
| A-6 | $HO\text{-}(CH_2CH_2O)_{n1}\text{-}H$ | Average molecular weight 6000 |
| A-7 | $HO\text{-}(CH_2CH_2O)_{n1}\text{-}H$ | Average molecular weight 10000 |
| A-8 | $HO\text{-}(CH_2CH_2O)_{n1}\text{-}H$ | Average molecular weight 15000 |

-continued

| | | |
|---|---|---|
| A-9 | $HO-(CH_2CH_2O)_{n1}-H$ | Average molecular weight 20000 |
| A-10 | $HO-(CH_2CH_2O)_{n1}-H$ | Average molecular weight 30000 |
| A-11 | $HO-(CH_2CH_2CH_2O)_{n1}-H$ | Average molecular weight 3000 |
| A-12 | $HO-(CH_2CH_2CH_2O)_{n1}-H$ | Average molecular weight 6000 |
| A-13 | $HO-(CH_2CH_2CH_2O)_{n1}-H$ | Average molecular weight 10000 |
| A-14 | $HO-(CH_2CH(CH_3)O)_{n1}-H$ | Average molecular weight 3000 |
| A-15 | $HO-(CH_2CH(CH_3)O)_{n1}-H$ | Average molecular weight 6000 |
| A-16 | $HO-(CH_2CH(CH_3)O)_{n1}-H$ | Average molecular weight 10000 |
| A-17 | $HO-(CH_2-CH(OH)CH_2O)_{n}-H$ | Average molecular weight 3000 |
| A-18 | $HO-(CH_2-CH(OH)CH_2O)_{n}-H$ | Average molecular weight 6000 |
| A-19 | $HO-(CH_2-CH(OH)CH_2O)_{n}-H$ | Average molecular weight 10000 |
| A-20 | $HO-(CH_2CH_2O)_{n1}-(CH_2CH(CH_3)O)_{n2}-(CH_2CH_2O)_{n1}-H$ | Average molecular weight 3000 |
| A-21 | $HO-(CH_2CH_2O)_{n1}-(CH_2CH(CH_3)O)_{n2}-(CH_2CH_2O)_{n1}-H$ | Average molecular weight 6000 |
| A-22 | $HO-(CH_2CH_2O)_{n1}-(CH_2CH(CH_3)O)_{n2}-(CH_2CH_2O)_{n1}-H$ | Average molecular weight 10000 |

The sugar means a monosaccharide or a polysaccharide in which plural monosaccharides are glycoside-bonded together.

A monosaccharide is a general term for a single polyhydroxy aldehyde or polyhydroxy ketone and a wide range of the derivatives thereof such as the reduced derivatives, oxidized derivatives, deoxy derivatives, amino derivatives and thio derivatives thereof. Many saccharides are represented by such a formula as $CnH_2nOn$. In the invention, the above-mentioned saccharides including the compounds derived from a saccharide skeleton represented by the formula are defined generically as a monosaccharide. Among the monosaccharides, the preferable ones include, for example, a sugar alcohol in which the aldehyde and ketone groups of sugar are each so reduced as to be the primary and secondary alcohol groups, respectively, and the particularly preferable ones are, for example, hexitol having 6 carbon atoms.

Polysaccharides include, for example, celluloses, starches and glycogens. The celluloses include, for example, derivatives of a cellulose ether of which the whole or a part of the hydroxyl group is etherified. The starches includes, for example, dextrin such as a variety of decomposed products produced in the course between a hydrolysis and a production of malt sugar. The celluloses may also be in a form of an alkali-metal salt from the viewpoint of the solubility. Among the above-mentioned polysaccharides, those preferably applicable include, for example, celluloses and dextrines and, those more preferable include dextrines.

The typically exemplified compounds of the monosaccharides are be given below.

(Exemplified compounds)

| | |
|---|---|
| B-(1) | Glyceraldehyde |
| B-(2) | Dihydroxy acetone (including the dimers) |
| B-(3) | D-erythrose |
| B-(4) | L-erythrose |
| B-(5) | D-threose |

-continued

| | |
|---|---|
| B-(6) | L-threose |
| B-(7) | D-ribose |
| B-(8) | L-ribose |
| B-(9) | D-arabinose |
| B-(10) | L-arabinose |
| B-(11) | D-xylose |
| B-(12) | L-xylose |
| B-(13) | D-lyxose |
| B-(14) | L-lyxose |
| B-(15) | D-xylulose |
| B-(16) | L-xylulose |
| B-(17) | D-ribulose |
| B-(18) | L-ribulose |
| B-(19) | 2-deoxyl-D-ribose |
| B-(20) | D-allose |
| B-(21) | L-allose |
| B-(22) | D-a1trose |
| B-(23) | L-altrose |
| B-(24) | D-glucose |
| B-(25) | L-glucose |
| B-(26) | D-mannose |
| B-(27) | L-mannose |
| B-(28) | D-gulose |
| B-(29) | L-gulose |
| B-(30) | D-idose |
| B-(31) | L-idose |
| B-(32) | D-galactose |
| B-(33) | L-galactose |
| B-(34) | D-talose |
| B-(35) | L-talose |
| B-(36) | D-ouinovose |
| B-(37) | digitalose |
| B-(38) | digitoxose |
| B-(39) | cymarose |
| B-(40) | D-sorbose |
| B-(41) | L-sorbose |
| B-(42) | D-tagatose |
| B-(43) | D-fucose |
| B-(44) | L-fucose |
| B-(45) | 2-deoxy-D-glucose |
| B-(46) | D-psicose |
| B-(47) | D-fructose |
| B-(48) | L-fructose |
| B-(49) | L-rhamnose |
| B-(50) | D-glucosamine |
| B-(51) | D-galactosamine |
| B-(52) | D-mannosamine |
| B-(53) | D-glycero-D-galactoheptose |
| B-(54) | D-glycero-D-mannoheptose |
| B-(55) | D-glycero-L-mannoheptose |
| B-(56) | D-glycero-D-guloheptose |
| B-(57) | D-glycero-D-idoheptose |
| B-(58) | D-glycero-L-glucoheptose |
| B-(59) | D-glycero-L-taloheptose |
| B-(60) | D-altroheptulose |
| B-(61) | D-mannoheptulose |
| B-(62) | D-altro-3-heptulose |
| B-(63) | D-glucoronic acid |
| B-(64) | L-glucoronic acid |
| B-(65) | N-acetyl-D-glucosamine |
| B-(66) | Glycerin |
| B-(67) | D-threitol |
| B-(68) | L-threitol |
| B-(69) | Erithorit |
| B-(70) | D-arabitol |
| B-(71) | L-arabitol |
| B-(72) | Adnite |
| B-(73) | Xylitol |
| B-(74) | D-sorbitol |
| B-(75) | L-sorbitol |
| B-(76) | D-mannitol |
| B-(77) | L-mannitol |
| B-(78) | D-iditol |
| B-(79) | L-iditol |
| B-(80) | D-talitol |
| B-(81) | L-talitol |
| B-(82) | dulcin |
| B-(83) | allodulcitol |

Among the exemplified compounds, B-(66) through (83) are preferably used and B-(74) through (83) are particularly preferable to be used.

The typically exemplified compounds of the polysaccharides of the invention will be given below.

| | |
|---|---|
| C-(1) | malt sugar |
| C-(2) | cellobiose |
| C-(3) | trehalose |
| C-(4) | gentiobiose |
| C-(5) | isomaltose |
| C-(6) | lactose |
| C-(7) | raffinose |
| C-(8) | gentianose |
| C-(9) | stachyose |
| C-(10) | xylan |
| C-(11) | araban |
| C-(12) | glycogen |
| C-(13) | dextran |
| C-(14) | inulin |
| C-(15) | levan |
| C-(16) | galactan |
| C-(17) | agarose |
| C-(18) | amylose |
| C-(19) | sucrose |
| C-(20) | agarobiose |
| C-(21) | α-dextrin |
| C-(22) | β-dextrin |
| C-(23) | γ-dextrin |
| C-(24) | δ-dextrin |
| C-(25) | ϵ-dextrin |
| C-(26) | α-limited-dextrin |
| C-(27) | β-limited-dextrin |
| C-(28) | phosporylase-limited-dextrin |
| C-(29) | soluble starch |
| C-(30) | sizing starch |
| C-(31) | white dextrin |
| C-(32) | yellow dextrin |
| C-(33) | British gum |
| C-(34) | Pineflow (a trade name, produced by Matsutani Kagaku Kogyo Co., Ltd.) |
| C-(35) | Pinedex 100 (Same as above) |
| C-(36) | Pinedex 1 (Same as above) |
| C-(37) | Pinedex 2 (Same as above) |
| C-(38) | Pinedex 3 (Same as above) |
| C-(39) | Pinedex 4 (Same as above) |
| C-(40) | Pinedex 6 (Same as above) |
| C-(41) | Foodtex (Same as above) |
| C-(42) | Max 1000 (Same as above) |
| C-(43) | Glister P (Same as above) |
| C-(44) | TK-16 (Same as above) |
| C-(45) | MPD (Same as above) |
| C-(46) | H-PDX (Same as above) |
| C-(47) | Stucodex (Same as above) |
| C-(48) | Mabit (a trade name, produced by Hayashihara Shoji Co., Ltd.) |
| C-(49) | Pullulan (Same as above) |
| C-(50) | Methyl cellulose |
| C-(51) | Dimethyl cellulose |
| C-(52) | Trimethyl cellulose |
| C-(53) | Ethyl cellulose |
| C-(54) | Diethyl cellulose |
| C-(55) | Triethyl cellulose |
| C-(56) | Carboxymethyl cellulose |
| C-(57) | Carboxyethyl cellulose |
| C-(58) | Aminoethyl cellulose |
| C-(59) | Hydroxymethyl cellulose |
| C-(60) | Hydroxyethylmethyl cellulose |
| C-(61) | Hydroxypropyl cellulose |
| C-(62) | Hydroxypropylmethyl cellulose |
| C-(63) | Hydroxypropylmethyl cellulose acetate succinate |
| C-(64) | Carboxymethyl hydroxyethyl cellulose |

Among the above-given exemplified compounds, C-(21) through (64) are preferable and C-(21) through (48) are more preferable.

These saccharides may be added in an amount within the range of, preferably, 0.5% (W/W) to 30% (W/W) and, more preferably, 1.0% (W/W) to 20% (W/W) of an unit weight of the solid processing composition.

Saccharides are made widely present in nature and are readily available on the market. A variety of derivatives can also readily be synthesized by carrying out a reduction, oxidation, dehydration reaction or the like.

The above mentioned compounds represented by Formula (I), polyvinylpyrrolidones, polyvinyl alcohols and suggars can enhance the effects of the solid processing compositio when they are contained in the composition either in a form of the law material of powder, in a granulated form or in a form granulated together with thiosulfates.

The prevention of formation of the sulfurous substance and of formation of powder after storage under a high temperature condition in the solid processing composition can be further enhanced by addition of a sulfite or a pyrosulfite. The sulfite and pyrosulfite include ammonium salt, sodium salt and potassium salt thereof, and sodium salt and potassium salt are preferable from the view point of the above-mentioned effects. The shape of the solid composition includes a shape of powder, granule and tablet. Among them the preferable shape is a granule and a table, particularly a tablet.

Here, "powder" means a mass of fine crystals. "Granule" means grains having a diameter of 50 to 5,000 μm, which is preferably prepared by granulating a powder. "Tablet" means one which is prepared by shaping a powder or granules in a required tablet form by compression. As the shaping method of the tablet, it is preferable to tablet by compression after granulating the powder or granules, because a stable processing ability can be maintained by thus prepared tablet.

As the granulating methods for preparation of tablet, a known method such as a tumbling granulation method, extrusion granulation method, compression granulation method, crushing granulation method, agitation granulation method, fluid-bed granulation method and spray granulation method can be used. The average size of the granulated particles is preferably 100 to 2,000 μm, more preferably 200 to 1,500 μm, from the viewpoint that a ununiformity or demixing of the composition is hardly formed at the time of mixing and compression of the granulated particles for tableting. The granulated particles preferably has a particle size distribution in which the 50% of the particles each have a particle size falling within the range of ±250 μm. Thus obtained granulated particles are used as granulated composition without any treatment. For compressing the granulated particles, known compressing machines, such as an oil hydraulic pressing machine, single tableting machine, rotary tableting machine and briquetting machine, can be used. The tablet may be prepared by tabulating a mixture of the granulated particles prepared by the above granulating method and crystals of a raw material available on the market.

Although the solid processing composition prepared by compression can be take an optional shape, a cylindrical shape or tablet shape is preferable from the viewpoint of producibility, handling property and dust formation on the user's side.

The replenishing composition for the fixer is preferably one conntaining a small amount of ammonium thiosulfate for improving the working environment. It is preferable that the ratio of ammonium thiosulfate in the total amount of thiosulfates in the fixing solution is not more than 70 mole %, more preferably not more than 30 mole %. The ratio of the sum of the weight of compounds represented by Formula I to IV or V to the weight of thiosulfate contained in the composition is preferabaly within the range of from 0.05% to 5% by weight, more preferably within the range of from 0.2% to 2% by weight.

The interval from the time at which the fixing process of a light-sensitive material is completed, to the time at which the light-sensitive material is touched with the stabilizing solution, is preferably not more than 7 seconds, more preferably not more than 5 seconds, further preferably 1 to 3 seconds.

The number of the stabilizing tank may be one, but the number of the tank may be increased to 2 to 10. Although the replenishing amount of the stabilizing solution can be reduced by increasing the number of stabilizing tank, the number of stabilizing tank is preferably 2 to 6 from the viewpoint of the miniaturization of automatic processor. The replenisher may be separately supplied at several portions, but it is preferable that the replenishing is carried out by a counter-current method (multi-steps counter-current method) in which the replenisher is supplied to a tank provided at a downstream portion with respect to the flow of the light-sensitive material and the overflow solution from the tank (including a solution flowing through a pipe when the tanks are connected by a pipe provided under the surface of the solution) is pour into a tank provided at upperstream of the tank. The counter-current method includes a cascade method. It is further preferable that the replenisher is supplied to the last stabilizing tank among two or more stabilizing tanks and the over flow solution is poured into previous tank in sequence.

The replenishing amount of the stabilizing solution can be considerably reduced by approximately 900 ml or less per square meter of the light-sensitive material processed only by making use of the compound of the invention represented by Formula (1). However, it is made possible to obtain the effects of the invention by using the above-mentioned treatment within the range of the replenishing amount of 50 to 800 ml per square meter of the light-sensitive material. For sufficiently enhancing the effects of the invention, the replenishing amount of the stabilizing solution is preferably 100 to 650 ml, more preferably 150 to 500 ml pre square meter of the light-sensitive material.

The replenishing amount can be further reduced by introducing a processing solution pumped out from the stabilizing tank to the fixing solution in the fixing treatment process.

In the processing method relating the invention, the processes of (1) Color developing→Bleaching→Fixing→Stabilizing, (2) Color developing→Bleaching→Fixing→$1^{st}$ Stabilizing→$2^{nd}$ Stabilizing, and (3) Color developing→Bleaching→Bleach-fixing→$1^{st}$ Stabilizing→$2^{nd}$ Stabilizing, are included.

EXAMPLES

The invention is described in detail by examples below.

Example 1

A processing was run for 20 days until the sum of replenishing amount of stabilizing replenishing solution is attained to 2 times of the volume of the stabilizing tank in which Konica Color Negative Film Super DD100, image-wise exposed in a camera, was processed. Steps and conditions of the processing were described below.

(Processing steps)

| Processing steps | Processing time | Processing Temperature | Replenishing amount |
|---|---|---|---|
| Color develop. | 3 min. 15 sec. | 38° C. | 625 ml/m$^2$ |
| Bleaching | 45 sec. | 37° C. | 250 ml/m$^2$ |
| Fixing | 1 min. 30 sec. | 37° C. | 900 ml/m$^2$ |
| Stabilizing | 60 sec. | 37° C. | 600 ml/m$^2$ |
| Drying | 60 sec. | 70° C. | — |

The fixing step was performed by a two-tank counter-current system (45 seconds for each tank) and the stabilizing step was performed by a four-tank counter-current system (15 seconds for each tank). The cross-over time for each tanks was 3 seconds respectively.

Composition of the processing solutions used are described below.

(Color developer)

| | |
|---|---|
| Sodium carbonate | 30 g |
| Sodium hydrogen carbonate | 2.5 g |
| Potassium sulfite | 4 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl)-aniline sulfate | 4.8 g |
| Potassium hydroxide | 1.2 g |

Make to 1 liter with water and adjust pH value to 10.06 using potassium hydroxide or 50% sulfuric acid.

(Color developer replenisher)

| | |
|---|---|
| Potassium carbonate | 40 g |
| Sodium hydrogen carbonate | 3 g |
| Potassium sulfite | 7 g |
| Potassium bromide | 0.5 g |
| Hydroxylamine sulfate | 3.1 g |
| 4-amino-3-methyl-N-ethyl-N-(β-hydroxyethyl)-aniline sulfate | 6.0 g |
| Potassium hydroxide | 2 g |

Make to 1 liter with water and adjust pH value to 10.06 using potassium hydroxide or 20% sulfuric acid.

(Bleaching solution and bleaching replenisher)

| | |
|---|---|
| Ferric ammonium 1,3-propylenediamine-tetraacetate | 150 g |
| Ammonium bromide | 100 g |

Make to 1 liter with water and adjust pH value to 5.2 using ammonia water or glacial acetic acid.

(Fixer and fixer replenisher)

| | |
|---|---|
| Ammonium thiosulfate | See Table 1 |
| Additive (See Table 1) | See Table 1 |
| Ammonium sulfite | 10 g |
| Disodium ethylenediaminetetraacetate | 2 g |

Make to 1 liter with water and adjust pH value to 8.0 using acetic acid and ammonia water.

(Stabilizer and stabilizer replenisher)

| | |
|---|---|
| Exemplified compound 2-5 | 1 ml |
| Exemplified compound 3-3 | 0.2 g |
| 5-chloro-2-methyl-4-isothiazolidine-3-on | 0.02 g |
| Additive (See Table 1) | See Table 1 |

Make to 1 liter with water and adjust pH value to 7.0 using ammonia water and 50 5 sulfuric acid.

The processing was run in which the mount of ammonium thiosulfate and the additive in the fixer and the fixer replenisher were changed as shown in Table 1, and the additive in the stabilizer and the stabilizer replenisher was also changed as shown in Table 1.

After completion of running of the processing, condition of stain formed on the back side of the film and that of the second stabilizing tank were observed. Further, the amount of silver remained in the unexposed area of the film was determined by a fluorescent X-ray method. Thus obtained results are shown in Table 1.

TABLE 1

| Experiment No. | Thiosulfate and compound in fixer replenisher (added amount) | Formalin in stabilizer replenisher (added amount) | Stain on the back surface of film | Condition in 2nd stabilizing tank | Remaining silver amount (mg/dm$^2$) | Note |
|---|---|---|---|---|---|---|
| 1-1 | Ammonium thiosulfate (250 g/L) | Formalin (5 ml/L) | C | C | 0 | Comparative |
| 1-2 | Ammonium thiosulfate (250 g/L) | Not added | C | A | 0 | Comparative |
| 1-3 | Ammonium thiosulfate (150 g/L) | Formalin (5 ml/L) | B | C | 11 | Comparative |
| 1-4 | Ammonium thiosulfate (150 g/L) | Not added | A | A | 13 | Comparative |
| 1-5 | Ammonium thiosulfate (150 g/L) Exemplified compound (III-10) (1 g/L) | Formalin (5 ml/L) | B | C | 1 | Comparative |
| 1-6 | Ammonium thiosulfate (150 g/L) Exemplified compound (III-10) (1 g/L) | Not added | A | A | 0 | Inventive |

TABLE 1-continued

| Experiment No. | Thiosulfate and compound in fixer replenisher (added amount) | Formalin in stabilizer replenisher (added amount) | Stain on the back surface of film | Condition in 2nd stabilizing tank | Remaining silver amount ($mg/dm^2$) | Note |
|---|---|---|---|---|---|---|
| 1-7 | Ammonium thiosulfate (150 g/L) Exemplified compound (III-13) (1 g/L) | Not added | A | A | 2 | Inventive |

In the above, formalin is an aqueous solution of formaldehyde with a concentration of about 38%. The norm of the evaluation was as follows.

<Evaluation of stain on the back surface of film>

A: No stain was observed on the back surface of film.

B: A little stain was observed on the back surface.

C: A serious stain was observed on the back surface.

<Evaluation of condition of the second stabilizing bath>

A: No change was observed in the second stabilizing tank

B: A little contamination was found in the tank

C: Sulfurization in the tank was apparently observed, which causes a problem in practical use.

The amount of remaining silver not more than 3 $mg/dm^2$ does not cause any problem in practical use.

Example 2

In the followings, the adding amount of the raw materials of the silver halide photographic light-sensitive material is described in terms of gram per square meter except one with specific description. The amount of the silver halide emulsion and the colloidal silver are described in terms of silver.

A multilayered color photographic color light-sensitive material was prepared by forming the layers each having the following compositions on a triacetyl cellulose film support in the following order from the support.

<Light-sensitive material sample>

$1^{st}$ layer: Antihalation layer (HC-1)

| | |
|---|---|
| Black colloidal silver | 0.22 |
| UV absorbent (Uv-1) | 0.20 |
| Colored coupler (CM-1) | 0.05 |
| Colored coupler (CM-2) | 0.05 |
| High-boiling solvent (Oil) | 0.20 |
| Gelatin | 1.3 |

$2^{nd}$ Layer: Interlayer (IL-1)

| | |
|---|---|
| UV absorbent (UV-1) | 0.01 |
| High-boiling solvent (Oil) | 0.01 |
| Gelatin | 1.3 |

$3^{rd}$ layer: Low speed red-sensitive emulsion layer (RL)

| | |
|---|---|
| Silver iodobromide emulsion (Em-1) | 1.0 |
| Silver iodobromide emulsion (Em-2) | 0.5 |
| Sensitizing dye (S-1) | $2.5 \times 10^{-4}$ moles/mole Ag |
| Sensitizing dye (S-2) | $2.5 \times 10^{-4}$ moles/mole Ag |
| Sensitizing dye (S-3) | $0.5 \times 10^{-4}$ moles/mole Ag |
| Cyan coupler (C-4") | 1.2 |
| Cyan coupler (C-2") | 0.06 |
| Colored cyan coupler (CC-1) | 0.05 |
| DIR compound (D-1) | 0.002 |

-continued

| | |
|---|---|
| High-boiling solvent (Oil-1) | 0.5 |
| Gelatin | 1.3 |

$4^{th}$ layer: High speed red-sensitive emulsion layer (RH) Silver

| | |
|---|---|
| iodobromide emulsion (Em-3) | 2.0 |
| Sensitizing dye (S-1) | $2.0 \times 10^{-4}$ moles/mole Ag |
| Sensitizing dye (S-2) | $2.0 \times 10^{-4}$ moles/mole Ag |
| Sensitizing dye (S-3) | $0.1 \times 10^{-4}$ moles/mole Ag |
| Cyan coupler (C-1") | 0.15 |
| Cyan coupler (C-2") | 0.918 |
| Cyan coupler (C-3") | 1.15 |
| Colored cyan coupler (CC-1) | 0.015 |
| DIR compound (D-2) | 0.05 |
| High-boiling solvent (Oil-1) | 0.5 |
| Gelatin | 1.2 |

$5^{th}$ layer: Interlayer (IL-2)

| | |
|---|---|
| Gelatin | 0.4 |

$6^{th}$ Layer: Low speed green-sensitive emulsion layer (GL)

| | |
|---|---|
| Iodobromide emulsion (Em-1) | 0.9 |
| Sensitizing dye (S-4) | $5.0 \times 10^{-4}$ moles/mole Ag |
| Sensitizing dye (S-5) | $1.0 \times 10^{-4}$ moles/mole Ag |
| Magenta coupler (M-1") | 0.3 |
| Magenta coupler (M-2") | 0.2 |
| Colored magenta coupler (CM-1) | 0.05 |
| DIR compound (D-3) | 0.015 |
| DIR compound (D-4) | 0.020 |
| High-boiling soivent (Oil-2) | 0.5 |
| Gelatin | 1.0 |

$7^{th}$ layer: Interlayer (IL-3)

| | |
|---|---|
| Gelatin | 0.8 |
| High-boiling solvent (Oil-1) | 0.2 |

$8^{th}$ Layer: High speed green-sensitive emulsion layer (GH)

| | |
|---|---|
| Iodobromide emulsion (Em-3) | 1.2 |
| Sensitizing dye (S-6) | $1.5 \times 10^{-4}$ moles/mole Ag |
| Sensitizing dye (S-7) | $2.5 \times 10^{-4}$ moles/mole Ag |
| Sensitizing dye (S-8) | $0.5 \times 10^{-4}$ moles/mole Ag |
| Magenta coupler (M-2") | 0.06 |
| Magenta coupler (M-3") | 0.18 |
| Colored magenta coupler (CM-2) | 0.05 |
| DIR compound (D-3) | 0.01 |
| High-boiling solvent (Oil-3) | 0.5 |
| Gelatin | 1.0 |

9th layer: Yellow filter layer (YC)

| | |
|---|---|
| Yellow colloidal silver | 0.1 |
| Color stain preventing agent (SC-1) | 0.1 |
| High-boiling solvent (Oil-3) | 0.1 |
| Gelatin | 0.8 |

10th Layer: Low speed blue-sensitive emulsion layer (BL)

| | |
|---|---|
| Iodobromide emulsion (Em-1) | 0.25 |
| Iodobromide emulsion (Em-2) | 0.25 |
| Sensitizing dye (S-10) | $7.0 \times 10^{-4}$ moles/mole Ag |
| Yellow coupler (Y-1") | 0.6 |
| Yellow coupler (Y-2") | 0.12 |
| DIR compound (D-2) | 0.01 |
| High-boiling solvent (Oil-3) | 0.15 |
| Gelatin | 1.0 |

11th Layer: High speed blue-sensitive emulsion layer (BH)

| | |
|---|---|
| Iodobromide emulsion (Em-4) | 0.45 |
| Iodobromide emulsion (Em-1) | 0.20 |
| Sensitizing dye (S-9) | $1.0 \times 10^{-4}$ moles/mole Ag |
| Sensitizing dye (S-10) | $3.0 \times 10^{-4}$ moles/mole Ag |
| Yellow coupler (Y-1") | 0.36 |
| Yellow coupler (Y-2") | 0.06 |
| High-boiling solvent (Oil-3) | 0.07 |
| Gelatin | 1.1 |

12th layer: 1st protective layer (Pro-1)

| | |
|---|---|
| Silver iodobromide fine grain emulsion average size: 0.08 μm, AgI: 2 mole %) | 0.4 |
| UV absorbent (UV-1) | 0.10 |
| UV absorbent (UV-2) | 0.05 |
| High-boiling solvent (Oil-1) | 0.1 |
| High-boiling solvent (Oil-4) | 0.1 |

-continued

| | |
|---|---|
| Formalin scavenger (HS-1) | 0.5 |
| Formalin scavenger (HS-2) | 0.2 |
| Gelatin | 1.0 |

13th layer: 2nd protective layer (Pro-2)

| | |
|---|---|
| Surfactant (Su-1) | 0.005 |
| Alkali-soluble matting agent (average size: 2 μm) | 0.01 |
| Cyan dye (AIC-1) | 0.005 |
| Magenta dye (AIM-1) | 0.04 |
| Lubricant (WAX-1) | 0.8 |

Other than the above, coating aids Su-2 and Su-3, hardener H-1 and H2, an antimolding agent DI-1, a stabilizer Stab-1, antifoggants AF-1 and AF-2 were added to each the layers. The emulsion used were as follows.

Em-1: A low surface iodide content type monodispersed emulsion having an average size of 0.46 μm and an average iodide content of 7.5%

Em-2: A uniform composition type monodispersed emulsion having an average size of 0.32 μm and an average iodide content of 2.0%

Em-3: A low surface iodide content type monodispersed emulsion having an average size of 0.78 μm and an average iodide content of 6.0%

Em-1: A low surface iodide content type monodispersed emulsion having an average size of 0.95 μm and an average iodide content of 8.0%

Em-1 to Em-3 and Em-4 were each mainly composed of octahedral grains having a multilayer structure, which were prepared in accordance with JP O.P.I. Nos. 60-138538/1985 and 61-245151/1986. In each of Em-1 through Em-4, the average values of the ratio of grain size to grain thickness were 1.0 and the width of grain size distribution (variation coefficient) were 14%, 10%, 12% and 12%, respectively.

S-1

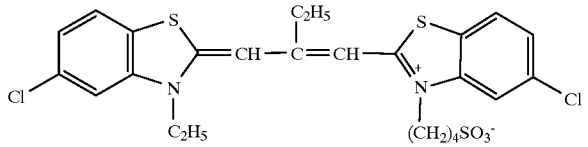

S-2

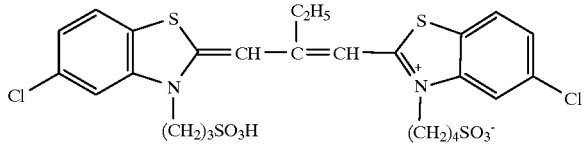

S-3

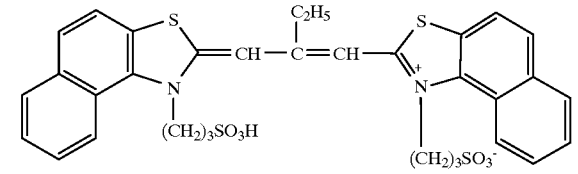

-continued
S-4
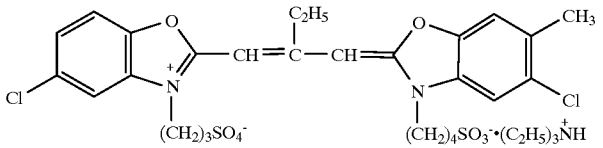
S-5
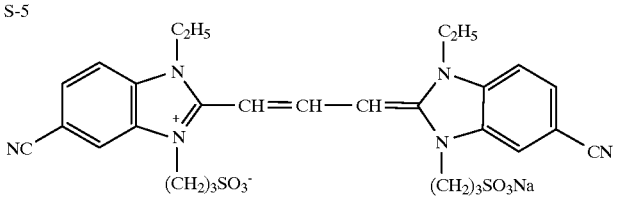
S-6
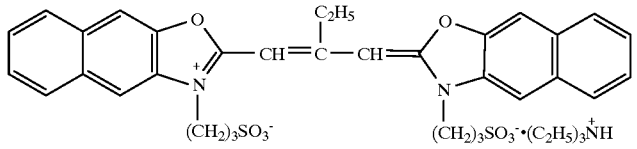
S-7
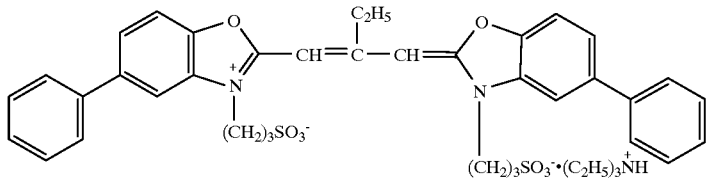
S-8
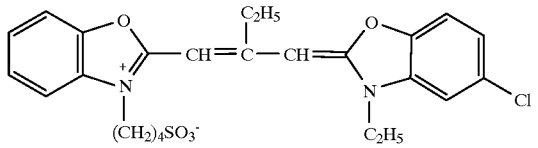
S-9
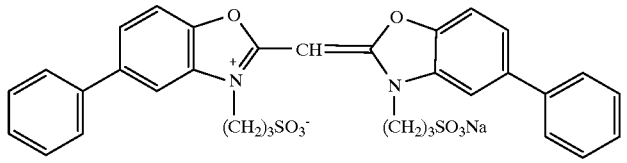
S-10
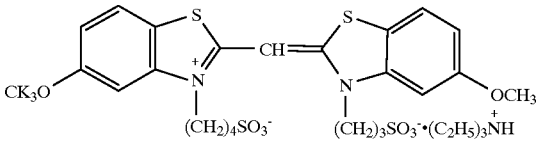
C-1"
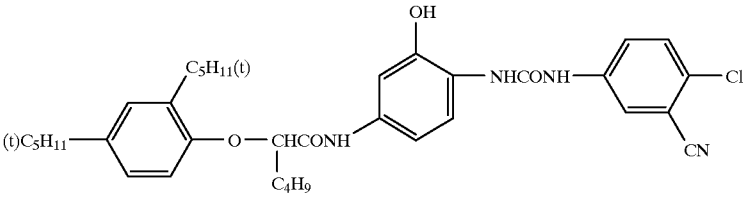

-continued
C-2"
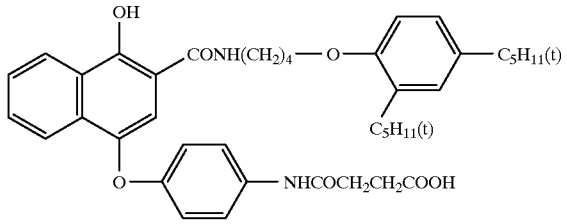
C-3"
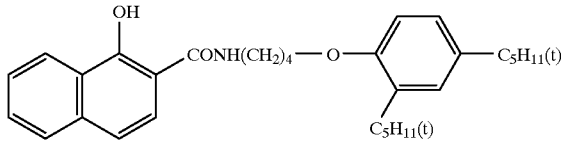
C-4"
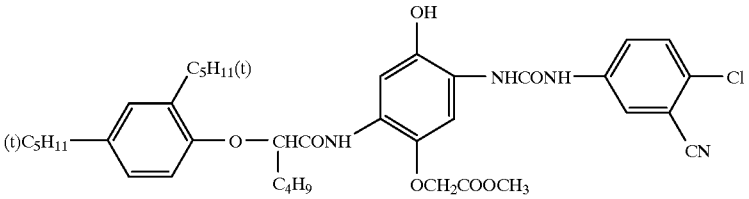
M-1"
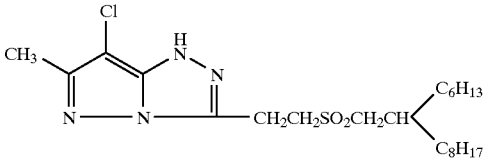
M-2"
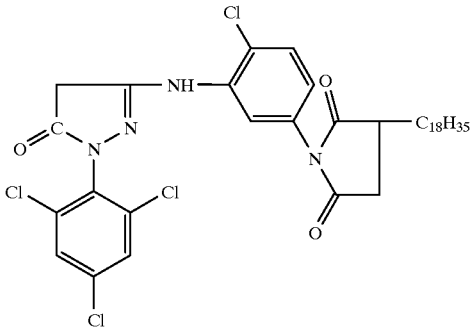
M-3"
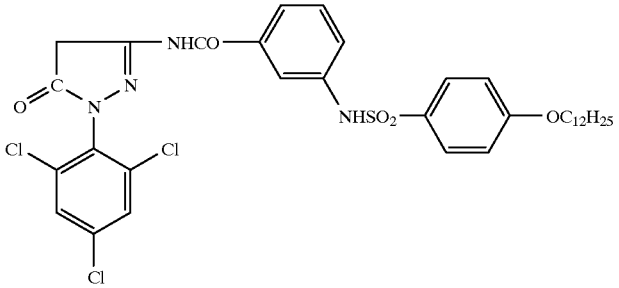

-continued
Y-1"
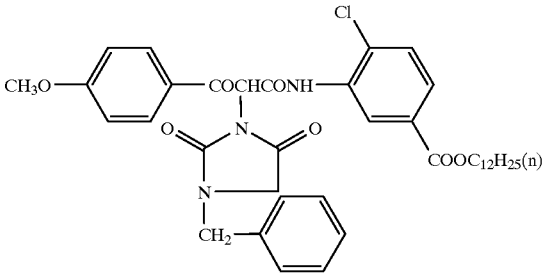
Y-2"
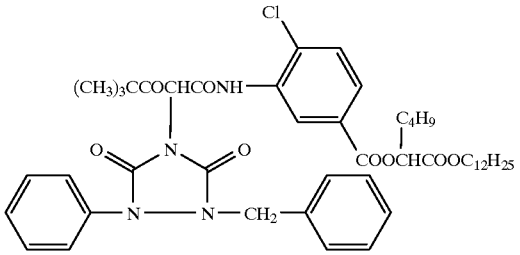
CC-1
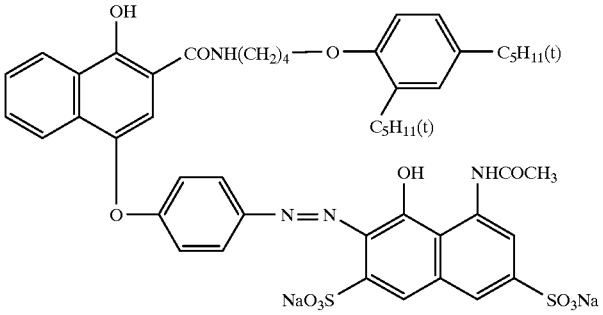
CM-1
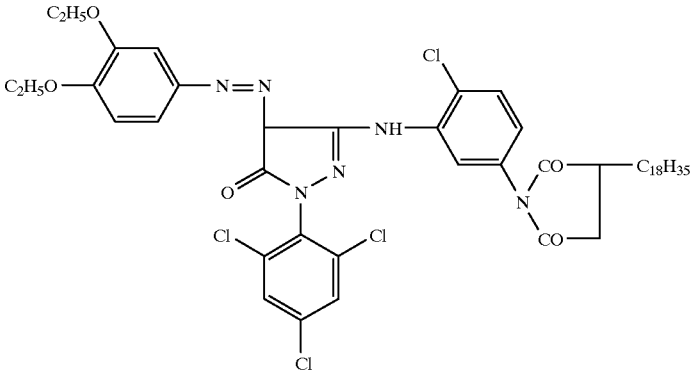
CM-2
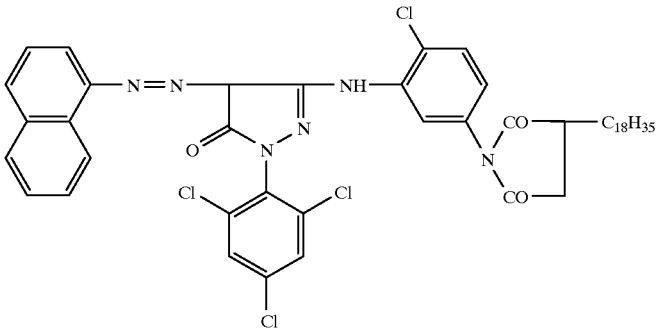

-continued
D-1
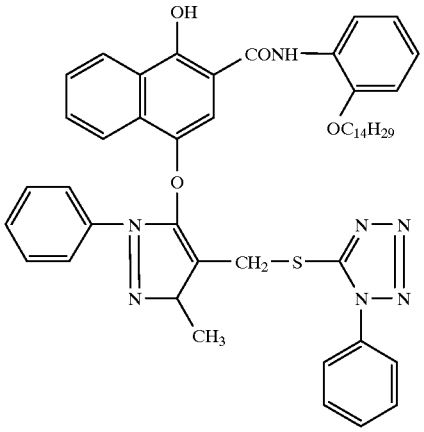
D-2
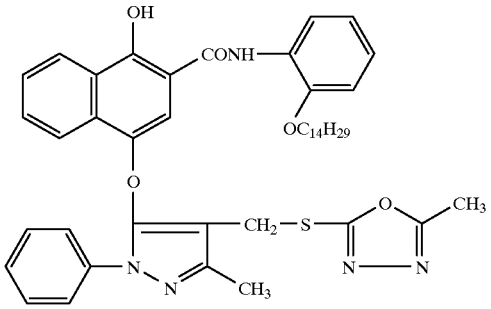
D-3
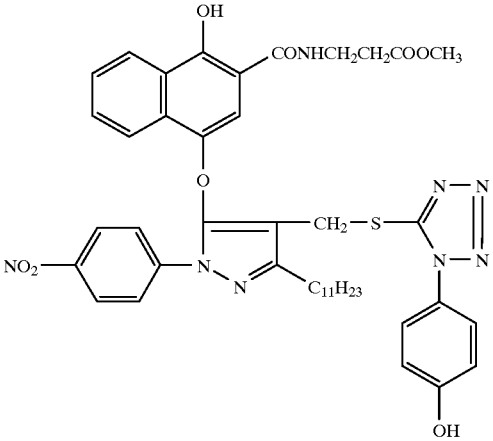

-continued
D-4
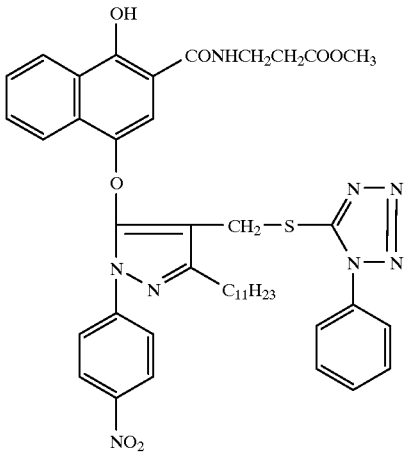
UV-1
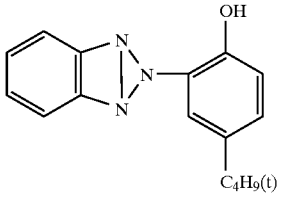
UV-2
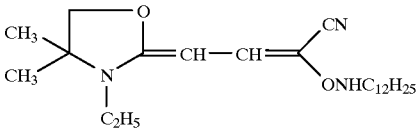
HS-1
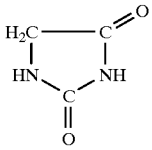
HS-2
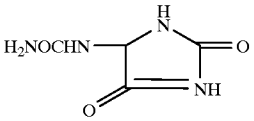
H-1
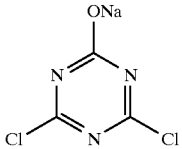
H-2
$((CH_2{=}CHSO_2CH_2)_3CCH_2SO_2(CH_2)_2)_2N(CH_2)_2SO_3K$
Su-1
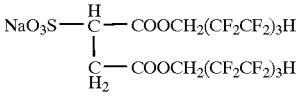
Su-2
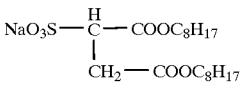

-continued
Su-3
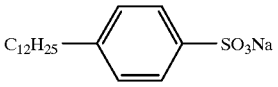
WAX-1
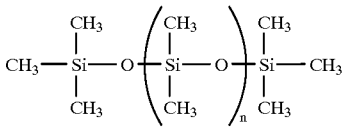
Sc-1
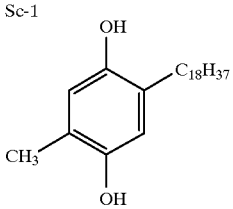
AIC-1
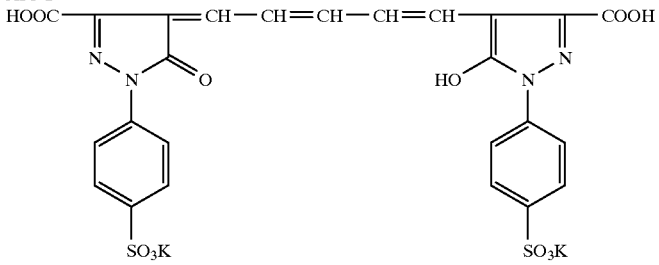
AIM-1
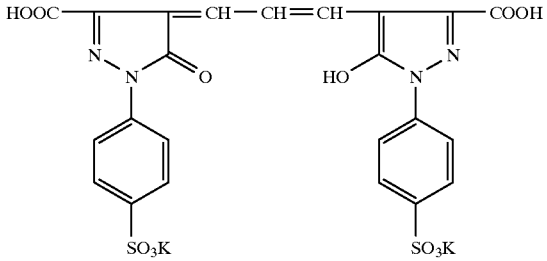
Stab-1
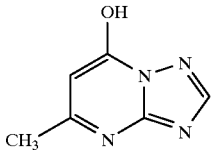
AF-1
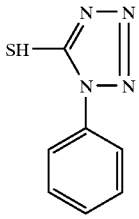
AF-2
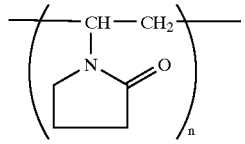

-continued

DI-1

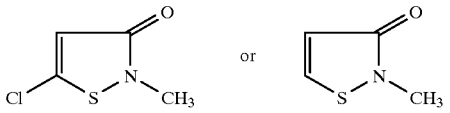

Oil-1

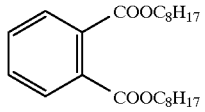

Oil-2

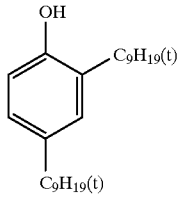

Oil-3

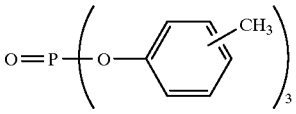

Oil-4

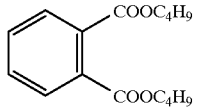

The following experiments were carried out using thus obtained film sample.

The experiments were carried out in the same manner as in Example 1 using the stabilizer and the stabilizer replenisher used in Experiments Nos. 1 to 5 except that formalin (5 ml/l) in the stabilizer and stabilizer replenisher was changed as shown in Table 2.

Processed film was stored in dark for 10 days at 75° C. and a RH of 10%, and the difference of the yellow transfer density at the unexposed area of the film was and that of the film before the storage (or yellow stain) was determined.

Thus obtained results are shown in Table 2.

TABLE 2

| Experiment No. | Additive in stabilizer replenisher (Added amount) | Stain on the back surface of film | Condition in 2nd stabilizing tank | Yellow stain density |
|---|---|---|---|---|
| 2-1 | Formalin (5 ml/l) | B | C | 0.02 |
| 2-2 | Not added | A | A | 0.08 |
| 2-3 | F-1-16 (2 g/l) | A | A | 0.04 |
| 2-4 | F-2-1 (2 g/l) | A | A | 0.04 |
| 2-5 | F-3-1 (2 g/l) | A | A | 0.03 |
| 2-6 | F-4-1 (2 g/l) | A | A | 0.03 |
| 2-7 | F-5-6 (2 g/l) | A | A | 0.04 |
| 2-8 | F-6-12 (2 g/l) | A | A | 0.03 |
| 2-9 | F-7-1 (2 g/l) | A | A | 0.05 |
| 2-10 | F-8-1 (2 g/l) | A | A | 0.04 |
| 2-11 | F-9-2 (2 g/l) | A | A | 0.04 |
| 2-12 | F-10-6 (2 g/l) | A | A | 0.04 |
| 2-13 | F-11-1 (2 g/l) | A | A | 0.04 |
| 2-14 | F-12-3 (2 g/l) | A | A | 0.03 |
| 2-15 | F-13-2 (2 g/l) | A | A | 0.04 |
| 2-16 | F-6-13 (2 g/l) | A | A | 0.04 |

From the above results, it is understood that the formation of yellow stain at the unexposed area is improved by making use of a compound represented by Formulas (F-1) to (F-13) in the stabilizing solution.

Example 3

Experiments were carried out in the same manner as in Example 1 using the stabilizer and the stabilizer replenisher used in Experiments Nos. 1 to 4 except that various amount of sodium thiosulfate was added maintaining the total moles with ammonium thiosulfate at a constant so that the ratio (mole %) of ammonium thiosulfate in the total thiosulfates is varied as shown in Table 3. Further, an odor in the fixing solution in the fixing tank was checked.

TABLE 3

| Experiment No. | Ammonium thiosulfate content in thiosulfates | Additive | Stain on the back surface of film | Remaining silver amount ($mg/dm^2$) | Odor of ammonia |
|---|---|---|---|---|---|
| 3-1 | 0 | Not added | A | 27 | A |
| 3-2 | 20 | Not added | A | 25 | A |
| 3-3 | 40 | Not added | A | 22 | B-A |
| 3-4 | 50 | Not added | A | 20 | B-A |
| 3-5 | 70 | Not added | A | 17 | B |
| 3-6 | 80 | Not added | A | 14 | C |
| 3-7 | 100 | Not added | A | 13 | CC |
| 3-8 | 0 | (III-10) (1 g/l) | A | 2 | A |
| 3-9 | 20 | (III-10) (1 g/l) | A | 1 | A |
| 3-10 | 40 | (III-10) (1 g/l) | A | 0 | B-A |
| 3-11 | 50 | (III-10) (1 g/l) | A | 0 | B-A |
| 3-12 | 70 | (III-10) (1 g/l) | A | 0 | B |
| 3-13 | 80 | (III-10) (1 g/l) | A | 0 | C |
| 3-14 | 100 | (III-10) (1 g/l) | A | 0 | CC |

A: No odor was sensed

B: A little odor of ammonia was sensed

TABLE 3-continued

| Experiment No. | Ammonium thiosulfate content in thiosulfates | Additive | Stain on the back surface of film | Remaining silver amount (mg/dm$^2$) | Odor of ammonia |
|---|---|---|---|---|---|

C: An odor of ammonia was obviously sensed
Larger number of C means stronger order From the results in Table 3, it is understood that the effects of the invention are enhanced when ammonium salt content in the thiosulfates is not more than 70 mole % (particularly not more than 50 mole %, further specifically not more than 20 mole %), and the odor is also improved so as to change the working environment for the better.

Example 4

Experiments were carried out in the same manner as in experiments Nos. 1 to 7 except that 450 ml/m$^2$ of film of the stabilizing solution is pumped by a bellows pump from the stabilizing tank provided at the position nearest to the fixing tank among the four stabilizing tanks and poured into the fixing tank adjacent to the stabilizing tank, and the concentration of the fixing replenisher was raised to two times and the concentrated fixing replenisher was supplied to the second fixing tank in an amount of 450 ml/m$^2$ of film. The processing was run in the same manner as in Example 1. As a result of that, the remaining amount of silver after the running became to zero and a improvement in the stabilizing properties is established. The other properties are the same as those obtained in Example 1. Further it is confirmed that the amount of waste liquid formed by the photographic processing is reduced by about 21%.

Accordingly, it is understood that the effects of the invention are enhanced and the total amount of waste liquid formed by the processing can be reduced by adding a part or all of the stabilizing solution of the invention to the fixing tank.

Example 5

Experiments were carried out in the same manner as in Experiment Nos. 2 to 3 of Example 2 except that compound (1–10) in the fixer and compound (F-1-16) in the stabilizer were was replaced by compounds described in Table 4.

From the above-mentioned, superiority of the method in which the fixing contains a compound of the invention and the stabilizing solution contains substantially no formaldehyde is established.

Example 6

Experiments were carried out in the same manner as in Experiments Nos. 1 to 6 of Example 1 except that the receipts of the fixer and fixer replenisher were changed as follows and the replenishing amount of stabilizer is changed as shown in Table 5. The stain on the back surface of the film was evaluated.

| <Fixer and fixer replenisher> | |
|---|---|
| Ammonium thiosulfate | 380 g |
| Ammonium sulfite | 15 g |
| Sodium diethyleneaminepentaacetate | 2 g |

Make with water to 11 and adjust pH to 7.5 using acetic acid and ammonia water.

Test results are shown in Table 5.

TABLE 5

| Experiment No. | Replenishing amount (ml/m$^2$) | Stain on the back surface of film |
|---|---|---|
| 6-1 | 1500 | A |
| 6-2 | 1000 | A |
| 6-3 | 900 | B |
| 6-4 | 800 | B–C |
| 6-5 | 650 | C |
| 6-6 | 500 | C |
| 6-7 | 300 | CC |
| 6-8 | 150 | CC |
| 6-9 | 100 | CC |
| 6-10 | 50 | CCC |

Next, experiments were carried out in the same manner as in Experiments Nos. 1 to 6 of Example 1 except that the replenishing amount of stabilizer is changed as shown in Table 6 without any change in the receipt of the fixer and fixer replenisher. Test results are shown in Table 6.

TABLE 4

| Experiment No. | Thiosulfate and compound in fixer replenisher (added amount) | Formalin in stabilizer replenisher (added amount) | Stain on the back surface of film | Condition in 2nd stabilizing tank | Remaining silver amount (mg/dm$^2$) | Yellow stain density |
|---|---|---|---|---|---|---|
| 5-1 | Ammonium thiosulfate (150 g/L) Exemplified compound (III-10) (1 g/L) | Not added | A | A | 0 | 0.08 |
| 5-2 | Ammonium thiosulfate (150 g/L) Exemplified compound (III-6) (1 g/L) | Exemplified (F-12-3) (2 g/L) | A | A | 2 | 0.03 |
| 5-3 | Ammonium thiosulfate (150 g/L) Exemplified compound (III-10) (1 g/L) | Exemplified (F-12-8) (1.5 g/L) | A | A | 0 | 0.03 |
| 5-4 | Ammonium thiosulfate (150 g/L Exemplified compound (III-13) (1 g/L) | Exemplified (F-11-2) (2 g/L) | A | A | 2 | 0.04 |
| 5-5 | Ammonium thiosulfate (150 g/L) Exemplified compound (III-31) (1 g/L) | Exemplified (F-6-13) (2 g/L) | A | A | 2 | 0.04 |
| 5-6 | Ammonium thiosulfate (150 g/L) Exemplified compound (III-34) (1 g/L) | Exemplified (F-6-12) (2 g/L) | A | A | 1 | 0.04 |
| 5-7 | Ammonium thiosulfate (150 g/L) Exemplified compound (III-1) (1 g/L) | Exemplified (F-2-1) (1.5 g/L) | A | A | 2 | 0.05 |

TABLE 6

| Experiment No. | Replenishing amount (ml/m$^2$) | Stain on the back surface of film | Remaining silver amount (mg/dm$^2$) | Condition in 2nd stabilizing tank |
|---|---|---|---|---|
| 6-11 | 1500 | A | 2 | A |
| 6-12 | 1000 | A | 2 | A |
| 6-13 | 900 | A | 1 | A |
| 6-14 | 800 | A | 1 | A |
| G-15 | 650 | A | 0 | A |
| 6-16 | 500 | A | 0 | A |
| 6-17 | 300 | A | 0 | A |
| 6-18 | 150 | A | 0 | A |
| 6-19 | 100 | B–A | 0 | B |
| 6-20 | 50 | B | 0 | B |

It is understood by comparing Table 5 and Table 6 that the effects of the invention are enhanced when the replenishing amount of the fixing solution is not more than 900 ml/m$^2$, particularly 50 to 800 ml/m$^2$ and more specifically within the range of 100 to 650 ml/m$^2$.

Example 7

Figure 2:
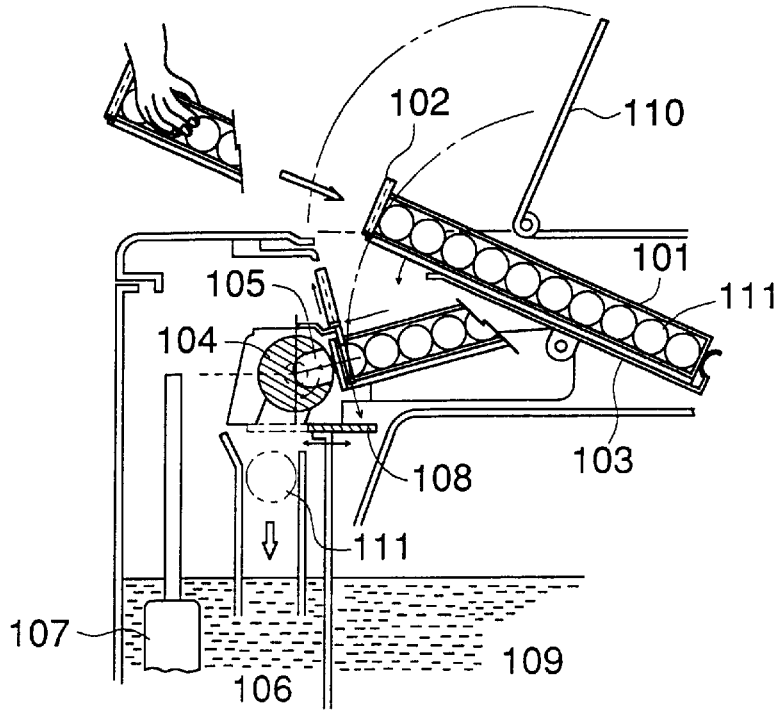
FIG. 2 is a structural drawing of an example of a device or supplying a solid recessing composition, in which a rotatable cylinder, a slidable cap and a cartridge are shown.

The part of replenishing device in Color Negative Film Processor CL-KP-50QA was modified as shown in FIG. 1, in which a supplying device shown in FIG. 2 was used for supplying solid processing composition. A columnar cartridge in which tablets were contained was set on a tablet supplying portion of the processor and imagewise exposed Konicolor Super DD400 film was processed in the processor.

FIG. 1 shows setting positions on KP-500Q (Autoprocessor A) at which solid processing composition supplying devices 2A, 2B, 2C and 2D to be set. In the figure, the above solid processing composition supplying devices 2A, 2B, 2C and 2D are each set at the upper portion of a color developing tank 1A, bleaching tank 1B, fixing tank 1C and stabilizing tank 1D, respectively, which are shown by hatching. FIG. 2 is a scheme showing an embodiment of the above-mentioned solid processing composition supplying devices 2A, 2B, 2C and 2D. A side of each tanks, a dissolving chamber 106 is provided, a solid processing composition 111 is supplied thereto.

In FIG. 2, the solid processing composition (hereinafter referred as tablet or tablet chemical) 111 is contained in a cartridge 101 which has plural divided chambers and is shield up with a slidable cap 102. When the cartridge is set on a cartridge holder 103 provided on the solid processing composition supplying device, the cap 102 is opened and a tablet is rolled down from the diagonally set cartridge into a cut out portion 105 of a rotatable cylinder 104. Plural cut out portions 105 are alternately made on the cylinder 104 so as to prevent simultaneously rolling down of tablets each contained in different chambers of the cartridge.

The cylinder 104 is rotated according to the amount of processed light-sensitive material and a shutter 108 is opened at the same time so that the tablet is supplied one by into a filtering or dissolving tank 106. 107 is a filter.

Treatment processes were as follows.

| Processing | Time | Temperature | Replenishing water (ml/m$^2$) |
|---|---|---|---|
| Color deve. | 3'15" | 38.0° C. | 520 |
| Bleaching | 45" | 38.0° C. | 100 |

-continued

| Processing | Time | Temperature | Replenishing water (ml/m$^2$) |
|---|---|---|---|
| Fixing-1 | 45" | 38.0° C. | |
| Fixing-2 | 45" | 38.0° C. | Shown in Table 7 |
| Stabi.-1 | 20" | 38.0° C. | |
| Stabi.-2 | 20" | 38.0° C. | |
| Stabi.-3 | 20" | 38.0° C. | 860 |
| Drying | 80" | 55° C. | |

The fixer and stabilizer were each counter-flowed 2 to 1, and 3 to 2 and 2 to 1, respectively. In the bleaching tank, aeration of the bleaching solution was performed by an air pump.

The solutions filled in the tanks at the start of processing were prepared by making use of replenishes and starters of processing compositions CNK-4-52 for Konica Color Negative Film.

The following processing compositions for color negative film were prepared.

1) Color developer replenisher tablet for color negative film

Operation (1)

In a hammer mill available on the market, 60 g of a developing agent CD-4, 4-amino-N-ethyl-β-(hydroxy) ethylaniline sulfate, was powdered until the average size of powdered particles was become to 10 μm. The powder is granulated with 10 ml of water for 7 minutes in a stirring granulating machine available on the market. Thus obtained granules were dried at 40° C. for 2 hours so as to almost of moisture contained in the granules. Thus granules (A) for color developer replenisher were prepared.

Operation (2)

In the same manner as in operation (1), 69.4 g of hydroxylamine and 4 g of Pineflow (product of Matsutani Kagaku Kogyo) were powdered, mixed and granulated. The adding amount of water was 3.5 ml. After granulation, the granules were dried at 60° C. for 30 minutes so that almost of moisture contained in the granules was removed. Thus granules (B) for color developer replenisher were prepared.

Operation (3)

In the same manner as in operation (1) or (2), 15 g of sodium 1-hydroxyethane-1,1-disulfonate, 72,8 g of potassium sulfite, 350 g of sodium carbonate, 3 g of sodium hydrogen carbonate, 3.7 g of sodium bromide, 22 g of mannitol and 5.0 g of polyethylene glycol 6000 were powdered, mixed and granulated with 40 ml of water. After granulation, the granules were dried at 70° C. for 60 minutes so that almost of moisture contained in the granules was removed. Thus granules (C) for color developer replenisher were prepared.

The above-obtained granules (A), (B) and (C) were mixed and 2 g of sodium N-myristoylalanine was added thereto. The mixture was uniformly mixed for 10 minutes by a mixer installed in a room conditioned at 25° C. and a RH of 40% or less. The mixture was tableted by a tableting machine, modified Tough Press Collect 1527UH manufactured by Kikusui Seisakusyo in a rate of 10 g per tablet. Thus a tablet for color developer replenisher having a diameter of 30 mm was prepared.

2) Bleaching replenisher tablet for color negative film

Operation (4)

In the same manner as in operation (1), 175 g of ferric ammonium 1,3-propanediaminetetraacetate monohydrate, 2 g of 1,3-propanediaminetetraacetic acid and 17 g of Pineflow (product of Matsutani Kagaku Kogyo) were powdered, mixed and granulated with 8 ml of water. After granulation, the granules were dried at 60° C. for 30 minutes so that almost of moisture contained in the granules was removed.

Operation (5)

In the same manner as in operation (1), 133 g of succinic acid, 200 g of ammonium bromide and 17 g of Pineflow (product of Matsutani Kagaku Kogyo) were powdered, mixed and granulated with 17 ml of water. After granulation, the granules were dried at 70° C. for 60 minutes so that almost of moisture contained in the granules was removed.

Operation (6)

In the same manner as in operation (1), 66.7 g of potassium sulfate, 60 g of sodium hydrogen carbonate and 8 g of mannitol were powdered, mixed and granulated with 13 ml of water. After granulation, the granules were dried at 60° C. for 60 minutes so that almost of moisture contained in the granules was removed.

The granules prepared by the above Operations (4) to (6) were uniformly mixed by a mixer installed in a room conditioned at 25° C. and a RH of 40% or less. Then the mixture of the granules was further mixed for 3 minutes after adding 6 g of sodium N-lauroylsarcosine. The mixture was tableted by a tableting machine, modified Tough Press Collect 1527UH, manufactured by Kikusui Seisakusyo, in a rate of 10 g per tablet. Thus a tablet bleaching solution replenisher for color negative film, having a diameter of 30 mm and a thickness of 10 mm was prepared.

3) Fixer replenisher tablet for color negative film

Operation (7)

In a bantam mill available, 250 g of sodium thiosulfate, 2250 g of ammonium thiosulfate, 180 g of sodium sulfite, 20 g of sodium carbonate, 20 g of disodium ethylenediaminetetraacetate and 70 g of Painflow (Matsutani Kagaku) were powdered so that the average size of the powdered particles become to 30 $\mu$m. To the powder was granulated in a stirring granulating machine spending 10 minutes with 50 ml of water. After granulation, the granules were dried at 60° C. for 120 minutes so that almost of moisture contained in the granules was removed. The dried granules were classified so that average size to be 800 $\mu$m and 50% of the granules to be within a deviation range of ±250 $\mu$m.

Operation (8)

The above obtained granules were mixed with 30 g of sodium N-lauroylsarcosine for 5 minutes in a mixing machine installed in a room conditioned at 25° C. and a RH of 40% or less. The mixture was tableted by a tableting machine, modified Tough Press Collect 1527UH, manufactured by Kikusui Seisakusyo, in a rate of 10 g per tablet. Thus a tablet having a diameter of 30 mm and a thickness of 10 mm was prepared.

4) Stabilizer replenisher tablet for color negative film

In an air jet fine powdering machine, 200 g of m-hydroxybenzaldehyde, hereinafter referred as mHBA, and lithium hydroxide mono-hydrate were powdered until the average size of the powdered particles becomes to 10 $\mu$m.

The powder was uniformly mixed for 10 minutes in a mixing machine installed in a room conditioned at 25° C. and a RH of 40% or less to prepare a powdered mixture.

Operation (10)

The above powdered mixture was granulated in a flow-layer atomizing granulating machine for 7 minutes at room temperature while atomizing 3.0 ml of water, and was dried for 8 hours at 45° C. The granules were further dried under a vacuum for 20 hours so that the moisture content of the granules to be 0.1 to 0.3% by weight. The average size and the bulk density of the granules were 300 to 600 $\mu$m and 0.8 g/cm$^3$, respectively.

Operation (11)

The granules were tableted by a tableting machine, modified Tough Prestcollect 1527UH, manufactured by Kikusui Seisakusyo, in a rate of 9.0 g per tablet. Thus a tablet having a diameter of 30 mm was prepared. The bulk density of the tablet was 1.7 g/cm$^3$.

One of each of the color developer replenisher tablet, the bleaching solution replenisher tablet and the stabilizer replenisher tablet were supplied into each filter tank per 7.1 rolls, 3.6 rolls and 125 rolls of 135 size 24 exposure film processed, respectively.

A running test of processing was performed for 3 weeks under the foregoing processing conditions and the processing compositions. The processed amount of the negative film was 0.5 m$^2$ per day. After the running test of processing was completed, an unexposed light-sensitive material was processed and the silver amount remaining in the light-sensitive material was determined by an X-ray fluorescent method.

On the other hand, the solutions in the first and second fixing tanks were stored for one week at 5° C. after the completion of the running test. The appearance of the solutions were visually observed. The evaluation was carried out according to following ranks.

A: No crystalline precipitation was observed.

B: Although floating substance was slightly observed, no practical problem was occurred.

C: Large crystals of thiosulfate were formed and circulation of the solution was hindered thereby.

Further a sample of light-sensitive material was processed after completion of the running test of processing, for visually observing formation of scratch and smudge on the surface of the sample, and appearance of the rollers arranged between the fixing tanks.

A: A lot of sulfurous substance was precipitated on the rollers and scratches were observed on the surface of the sample.

B: Amount of precipitated substance was a little, and no problem was occurred on the processed sample.

The tests results are shown in Table 7.

The thiosulfate concentration shown in the table is a value of thiosulfate concentration in the solution of the second fixing tank after completion of the running test, which is determined by a reversal iodine titration method.

TABLE 7

| Experiment No. | Addenda | Fixing process: Water supplying amount (ml/m$^2$) | Fixing process: Supplying internal (24EX rolls/tablet) | Thiosulfate concentration in fixer after running (g/l) | Remaining silver amount (mg/100 cm$^2$) | Precipitation at low temperature in fixer after running | Situation of transferring roller | Note |
|---|---|---|---|---|---|---|---|---|
| 7-1 | — | 727 | 1.30 | 270 | 5.5 | C | B | Comparative |
| 7-2 | — | 545 | 1.68 | 285 | 7.0 | C | B | Comparative |
| 7-3 | — | 545 | 2.40 | 180 | 9.5 | B | A | Comparative |
| 7-4 | I-2 | 545 | 2.40 | 178 | 0.7 | A | A | Inventive |
| 7-5 | II-6 | 545 | 2.40 | 182 | 0.6 | A | A | Inventive |
| 7-6 | III-10 | 545 | 2.40 | 177 | 0.2 | A | A | Inventive |
| 7-7 | III-13 | 545 | 2.40 | 179 | 0.4 | A | A | Inventive |
| 7-8 | IV-31 | 545 | 2.40 | 180 | 0.5 | A | A | Inventive |
| 7-9 | IV-7 | 545 | 2.40 | 178 | 0.6 | A | A | Inventive |
| 7-10 | V-1 | 545 | 2.40 | 182 | 0.5 | A | A | Inventive |
| 7-11 | V-3 | 545 | 2.40 | 181 | 0.5 | A | A | Inventive |

As is shown in Table 7, the fixing ability of fixer can be maintained even when the concentration of thiosulfate is lowered by the use of the compound of the invention. Further, the formation of scratch and adhesion of smudge on the surface of light-sensitive material, which are caused by the crystals precipitated during storing the processing solution at a low temperature and the substance precipitated on the surface of transfer rollers provided between the fixing tanks, can also be prevented by making use of the compound.

Example 8

Experiments and evaluations were performed in the same manner as in Example 7 except that the method for supplying a solid composition of fixer was changed, and the addenda to be used, the amount of supplying water and the supplying interval of the solid composition were changed also as shown in Table 8. Test results are shown in Table 8.

Water supplying method for solid fixing composition would be described.

[Powder method]

Fixer replenishing powder

In a bantam mill on the market, 250 g of sodium thiosulfate, 2250 g of ammonium thiosulfate, 180 g of sodium sulfite, 20 g of potassium carbonate, 20 g of disodium ethylenediaminetetraacetate, 70 g of Painflow (Matutani Kagaku) and 20 g of the compound described in Table 8 were powdered and mixed so that the average particle size of the powdered particles to be 30 $\mu$m. Thus a fixer replenishing powder was prepared.

Figure 3:
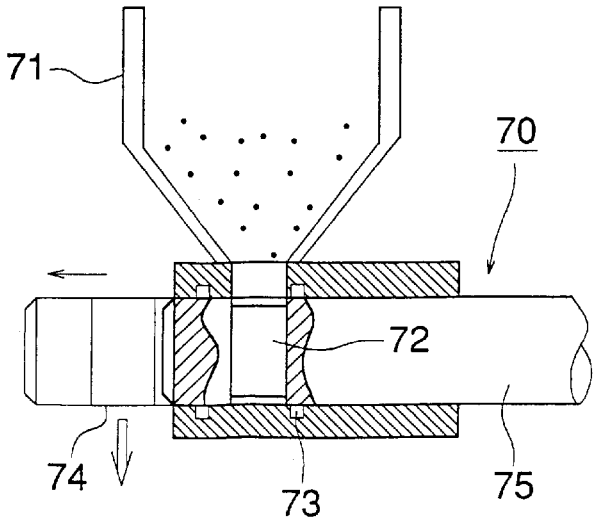
FIG. 3 is a cross section of a supplying device for a powdered or granulated composition.

The supplying device of FIG. 1 used in Example 7 was replaced by that shown in FIG. 3.

FIG. 3 shows a cross section of another supplying device for a solid processing composition, which can be used processing composition in a form of granule or powder. In the supplying device 70, a processing composition in a form of granule or powder is put into a hopper 71. A piston 75 is moved for horizontal (right) direction, according to the amount of light-sensitive material processed, to put a prescribed amount of granules or powder of processing composition into an amount measuring hole 72. Then the piston 75 is moved for reverse (left) direction to supply the powdered or granulated processing composition to a filter chamber through an exit hole 74. The device is adjusted so as to supply 10 g of the powdered composition per time of supply.

[Granule method]

Granules prepared in operation (7) in Example 7 was used as fixer replenishing granules.

Supplying device for fixer replenishing granules

The supplying device of FIG. 1 used in Example 7 was replaced by that shown in FIG. 3. The device is adjusted so as to supply 10 g of the granulated composition per time of supply.

[Tablet method]

The same tablet and supplying device as in Example 7 were used.

TABLE 8

| Experiment No. | Replenishing method | Addenda* | Fixing process: Water supplying amount (ml/m$^2$) | Fixing process: ** Supplying internal | Thiosulfate concentration in fixer after running (g/l) | Remaining silver amount (mg/100 cm$^2$) | Precipitation at low temperature in fixer after running | Situation of transferring roller | Note |
|---|---|---|---|---|---|---|---|---|---|
| 8-1 | Powder | — | 545 | 1.68 | 280 | 8.4 | C | B | Comparative |
| 8-2 | Powder | — | 545 | 2.40 | 165 | 10.5 | C | A | Comparative |
| 8-3 | Powder | III-10 | 545 | 2.40 | 168 | 0.7 | B | A | Inventive |
| 8-4 | Granule | — | 545 | 1.68 | 283 | 8.0 | .C | B | Comparative |
| 8-5 | Granule | — | 545 | 2.40 | 170 | 9.8 | C | A | Comparative |
| 8-6 | Granule | III-10 | 545 | 2.40 | 175 | 0.4 | B | A | Inventive |
| 8-7 | Tablet | — | 545 | 1.68 | 285 | 7.0 | C | B | Comparative |

TABLE 8-continued

| Experiment No. | Replenishing method | Ad-* denda | Fixing process: Water supplying amount (ml/m²) | Fixing process: ** Supplying internal | Thiosulfate concentration in fixer after running (g/l) | Remaining silver amount (mg/100 cm²) | Precipitation at low temperature in fixer after running | Situation of transferring roller | Note |
|---|---|---|---|---|---|---|---|---|---|
| 8-8 | Tablet | — | 545 | 2.40 | 175 | 9.5 | C | A | Comparative |
| 8-9 | Tablet | III-10 | 545 | 2.40 | 177 | 0.2 | A | A | Inventive |

*The adding amount f addenda was the same as in Example 1.
**The supplying interval of solid composition is expressed by a number of roll film box 24EX by one tablet or one unit of weighed solid processing composition.

As is shown in Table 8, the fixing ability of fixer can be maintained by the use of the compound of the invention even when the concentration of thiosulfate is lowered. Further, the formation of scratch and adhesion of smudge on the surface of the light-sensitive material, which are caused by the crystals precipitated during storing the processing solution at a low temperature and the substance precipitated on the surface of the transfer roller between the fixing tanks, can also be prevented by the use of the compound.

Example 9

Solid fixer replenishing compositions for color light-sensitive material were prepared as follows.

(I) Granulated fixer replenishing composition

In a bantam mill on the market, 250 g of sodium thiosulfate, 2250 g of ammonium thiosulfate, 180 g of sodium sulfite, 20 g of potassium carbonate, 20 g of disodium ethylenediaminetetraacetate, 70 g of Painflow (Matutani Kagaku) and 20 g of the compound described in Table 9 were powdered and mixed so that the average particle size of the powder to be 30 μm. The powder was granulated with 50 ml of water in a stirring granulating machine at a room temperature for about 10 minutes. After granulation, the granules were dried at 60° C. for 120 minutes so that almost moisture contained in the granules was removed. The dried granules were classified so that average size to be 800 μm and 50% of the granules to be within a deviation range of ±200 μm to ±250 μm.

(II) Tableted fixer replenishing composition

The above obtained granules were mixed with 30 g of sodium N-lauroylsarcosine for 5 minutes in a mixing machine installed in a room conditioned at 25° C. and a RH of 40% or less. The mixture was tableted by a tableting machine, modified Tough Press Collect 1527UH, manufactured by Kikusui Seisakusyo, in a rate of 10 g per tablet. Thus a tablet having a diameter of 30 mm and a thickness of 10 mm was prepared.

Thirty grams the above powder and granules, and three of the tablets were each sampled, and the samples were each enclosed and shielded in a high-density polyethylene bag having a size of 10 cm×10 cm. The bags containing these samples were stored for one month at 50° C. and a RH of 50%.

Each of the samples was dissolved in water after the storage and was made to 100 ml. Thus obtained solutions were visually observed after stirring. Further the solutions were filtered and the concentration of $S_2O_3^{2-}$ in the filtrates were determined by reversal iodine titration method.

The above granulated processing composition stored for one month at 50° C. and a HR of 50% was taken out from the bag and sieved to remove particles each having a diameter of not more than 149 μm and remained granules were weighed. The remained granules were enclosed again in a polyethylene bag and shaken by a vibration testing machine BF-UA manufactured by TDEX Co. with a shaking condition in which the sample was shaked for 5 minutes while varying the shaking cycles 5 to 67 Hz and the shaking was repeated for 24 times, 120 minutes in total. After the shaking test, the granules were sieved again for removing particles of not more than 194 μm and remained granules were weighed. The degree of powder formation during the storage in the granulated composition was evaluated by the following equation. The tableted processing composition was evaluated in the same manner in the above after storage at 50° C. and a RH of 50% for 1 month.

$$\text{Powder formation degree} = 100\% \times \frac{(\text{Weight before shaking} - \text{weight after shaking})}{\text{Weight of solid composition before shaking test}}$$

The followings are evaluation ranks of the appearance of the solution in which the solid processing composition after stored at the high temperature was dissolved, and the powder formation degree in the solid processing composition after stored at the high temperature.

(Appearance of the solution after the sorage at the high temperature)

A: Neither precipitated nor floating substance was observed.

B: No precipitated substance was observed

C: Large amount of sulfurous substance was floating on the surface of the solution (Powder formation degree after the storage at the high temperature)

A: than 0.2%

B: 0.2% to less than 0.5%

C: 0.5% or less than 1.0%

D: 1.0% to less than 2.0%

E: 2% to less than 4%

F: 4% to 6%

Thus obtained test results are shown in Table 9.

TABLE 9

| Experiment No. | Form of solid processing composition | Addenda | Situation after storage at 50° C. for 1 month: Remaining ratio of $S_2O_3^{2-}$ in filtrate of solution after storage | Appearanse of solution after storage | Situation of powder formation in solid composition after storage | Note |
|---|---|---|---|---|---|---|
| 9-1 | Granule | — | 74 | C | F | Comparative |
| 9-2 | Granule | I-2 | 89 | B | C | Inventive |
| 9-3 | Granule | II-6 | 90 | B | D | Inventive |
| 9-4 | Granule | III-10 | 97 | A | B | Inventive |
| 9-5 | Granule | III-13 | 95 | A | B | Inventive |
| 9-6 | Granule | III-31 | 95 | A | B | Inventive |
| 9-7 | Granule | IV-7 | 90 | B | D | Inventive |
| 9-8 | Granule | V-1 | 94 | A | C | Inventive |
| 9-9 | Granule | V-3 | 95 | A | B | Inventive |
| 9-10 | Tablet | — | 76 | C | F | Comparative |
| 9-11 | Tablet | I-2 | 95 | A | B | Inventive |
| 9-12 | Tablet | II-6 | 95 | A | C | Inventive |
| 9-13 | Tablet | III-10 | 100 | A | A | Inventive |
| 9-14 | Tablet | III-13 | 98 | A | A | Inventive |
| 9-15 | Tablet | III-31 | 98 | A | B | Inventive |
| 9-16 | Tablet | IV-7 | 95 | A | C | Inventive |
| 9-17 | Tablet | V-1 | 97 | A | B | Inventive |
| 9-18 | Tablet | V-3 | 97 | A | B | Inventive |

As is shown in Table 9, the formation of insoluble substance in the solid fixer replenishing composition caused by decomposition of $S_2O_3^{2-}$ during the prolonged storage can be prevented and deterioration in the solubility of the composition and powder formation in the composition can also be prevented by applying the compound of the invention.

Example 10

A solid bleach-fixer composition for color paper was prepared as follows.

(I) Granulated bleach-fixing composition

Operation (12)

In a bantam mill available on the market, 720 g of ammonium ferric diethylenetriaminepentaacetate, 70 g of diethylene-triaminepentaacetic acid and 80 g of Painflow (Matutani Kagaku) were powdered and granulated with 50 ml of water in a stirring granulating machine at a room temperature for about 10 minutes. After the granulation, the granules were dried at 60° C. for 2 hours so that almost moisture contained in the granules was removed. The dried granules were classified so that average size to be 800 μm and 50% of the granules to be within a deviation range of ±250 μm.

Operation (13)

Eight hundreds gram of thiosulfate (described in Table 9), 160 g of sodium sulfite, 60 g of sodium bisulfite and 60 g of Pineflow (Matutani Kagaku) were powdered, mixed and granulated in the same manner as in operation (1). Added amount of water was 40 ml. After the granulation, the granules were dried at 60° C. for 2 hours so that almost moisture contained in the granules was removed. The dried granules were classified so that average size to be 800 μm and 50% of the granules to be within a deviation range of ±250 μm.

The granules obtained by perations (12) and (13) were mixed by a mixing machine in a room conditioned at 25° C. and a RH of 40%. Thus glanulated bleach-fixing composition was prepared.

(II) Tableted bleach-fixing composition

The above-prepared granulated bleach-fixing composition was mixed with 30 g of sodium N-lauroylsarcosine for 5 minutes by a mixer in a room conditioned at 25° C. and a HR of not more than 45%. The mixture was tableted by a tableting machine, modified Tough Press Collect 1527UH, manufactured by Kikusui Seisakusyo, in a rate of 10 g per tablet. Thus a tablet having a diameter of 30 mm and a thickness of 10 mm was prepared.

Thirty grams of the granulated composition and 3 tablets of the tableted composition were sampled and tested in the same manner as in Example 3. Thus obtained test results are shown in Table 10.

TABLE 10

| Experiment No. | Form of solid processing composition | Addenda | Situation after storage at 50° C. for 1 month: Remaining ratio of $S_2O_3^{2-}$ in filtrate of solution after storage | Appearanse of solution after sotrage | Situation of powder formation in solid composition after storage |
|---|---|---|---|---|---|
| 10-1 | Granule | — | 70 | C | F |
| 10-2 | Granule | I-2 | 87 | B | D |
| 10-3 | Granule | II-6 | 86 | B | D |
| 10-4 | Granule | III-10 | 94 | B | B |
| 10-5 | Granule | III-13 | 93 | A | C |
| 10-6 | Granule | III-31 | 92 | B | C |
| 10-7 | Granule | IV-7 | 86 | B | D |
| 10-8 | Granule | V-1 | 91 | B | D |
| 10-9 | Granule | V-3 | 91 | B | C |
| 10-10 | Tablet | — | 73 | C | F |
| 10-11 | Tablet | I-2 | 93 | A | C |
| 10-12 | Tablet | II-6 | 92 | B | C |
| 10-13 | Tablet | III-10 | 98 | A | A |
| 10-14 | Tablet | III-13 | 95 | A | B |
| 10-15 | Tablet | III-31 | 96 | A | B |
| 10-16 | Tablet | IV-7 | 91 | B | C |
| 10-17 | Tablet | V-1 | 94 | A | B |
| 10-18 | Tablet | V-3 | 95 | A | B |

As is shown in Table 10, the formation of insoluble substance in the solid fixer replenishing composition caused by decomposition of $S_2O_3^{2-}$ during the prolonged storage can be prevented and deterioration in the solubility of the composition and power formation in the composition can also be prevented by applying the compound of the invention.

Example 11

Experiments and evaluations were carried out in the same manner as in Example 7 except that the supplying amount of water, the supplying interval of solid composition and the weight ratio of the addenda of the invention to thiosulfate were changed as shown in Table 11. Thus obtained test results are shown in Table 11.

TABLE 11

| Experiment No. | Fixing process: Water supplying amount (ml/m$^2$) | Fixing process: Supplying internal of solid processing composition (24 EX rolls/tablet) | Fixing process: Thiosulfate concentration in fixer after running (g/l) | Weight of addenda (III-10) / Total weight of thiosulfate ×100(%) | Remaining silver amount (mg/100 cm$^2$) | Precipitation at low temperature in fixer after running | Situation of transferring roller | Note |
|---|---|---|---|---|---|---|---|---|
| 11-1 | 545 | 1.68 | 285 | 0 | 7.0 | C | B | Comparative |
| 11-2 | 545 | 2.40 | 180 | 0 | 9.5 | B | A | Comparative |
| 11-3 | 545 | 2.40 | 170 | 0.03 | 0.7 | B | A | Inventive |
| 11-4 | 545 | 2.40 | 172 | 0.05 | 0.4 | B | A | Inventive |
| 11-5 | 545 | 2.40 | 180 | 0.2 | 0.2 | A | A | Inventive |
| 11-6 | 545 | 2.40 | 178 | 1.0 | 0.2 | A | A | Inventive |
| 11-7 | 545 | 2.40 | 178 | 2.0 | 0.2 | A | A | Inventive |
| 11-8 | 545 | 2.40 | 182 | 5.0 | 0.5 | B | A | Inventive |
| 11-9 | 545 | 2.40 | 180 | 7.0 | 0.9 | B | A | Inventive |

As is shown in Table 11, the fixing ability of fixer can be maintained by making use of the compound of the invention and adjusting the ratio of the weight of the compound to the weight of thiosulfate in the composition to the preferable rage, even when the concentration of thiosulfate is lowered. Further, the formation of scratch and adhesion of smudge on the surface of the light-sensitive material, which are caused by the crystals precipitated during storing the processing solution at a low temperature and the substance precipitated on the surface of the transfer roller between the fixing tanks, can also be prevented by making use of the compound of the invention and adjusting the ratio of the weight of the compound to the weight of thiosulfate in the composition.

Example 12

Experiments and evaluations were carried out in the same manner as in Example 7 except that the supplying amount of water, the supplying interval of solid composition and the weight ratio of the addenda of the invention to thiosulfate were changed as shown in Table 12, further the tableted fixing replenisher compositions used in Example 7 were replaced each with those which has been stood for 2 weeks at 50° C. and a RH of 80% in a high-density polyethylene bag.

TABLE 12

| Experiment No. | Addenda | Weight of sodium thiosulfate / Total weight of thiosulfate ×100(%) | Fixing process: Water supplying amount (ml/m$^2$) | Fixing process: Supplying internal of solid processing composition (24 EX rolls/tablet) | Fixing process: Thiosulfate concentration in fixer after running (g/l) | Remaining silver amount (mg/100 cm$^2$) | Precipitation at low temperature in fixer after running | Situation of transferring roller | Note |
|---|---|---|---|---|---|---|---|---|---|
| 12-1 | — | 10 | 545 | 1.68 | 285 | 7.0 | C | B | Comp. |
| 12-2 | — | 10 | 545 | 2.40 | 173 | 9.5 | B | A | Comp. |
| 12-3 | III-10 | 1 | 545 | 2.40 | 162 | 0.8 | B | A | Inv. |
| 12-4 | III-10 | 2 | 545 | 2.40 | 168 | 0.5 | B | A | Inv. |
| 12-5 | III-10 | 5 | 545 | 2.40 | 176 | 0.2 | A | A | Inv. |
| 12-6 | III-10 | 10 | 545 | 2.40 | 178 | 0.2 | A | A | Inv. |
| 12-7 | III-10 | 20 | 545 | 2.40 | 177 | 0.2 | A | A | Inv. |
| 12-8 | III-10 | 70 | 545 | 2.40 | 175 | 0.6 | B | A | Inv. |
| 12-9 | III-10 | 80 | 545 | 2.40 | 180 | 0.9 | B | A | Inv. |

Comp.: Comparative Inv.: Inventive

As is shown in Table 12, the fixing ability of fixer can be maintained by making use of the compound of the invention and adjusting the ratio of the weight of the compound to the weight of thiosulfate in the composition to the preferable range, even when the concentration of thiosulfate is lowered. Further, the formation of scratch and adhesion of smudge on the surface of the light-sensitive material, which are caused by the crystals precipitated during storing the processing solution at a low temperature and the substance precipitated on the surface of the transfer roller between the fixing tanks, can also be prevented by making use of the compound of the invention and adjusting the ratio of the weight of the compound to the weight of thiosulfate in the composition.

Example 13

Konica Color Super DD Film exposed by an ordinary method was processed for 3 weeks in a rate of 10 rolls per day with the following starting solution and replenisher by a color negative film processor L-KP-50QA having the following processing steps, and is evaluated (Color developer starting solution)

| | |
|---|---|
| Sodium carbonate | 30 g |
| Sodium hydrogencarbonaate | 2.5 g |
| Potassium sulfite | 3.0 g |
| Sodium bromide | 1.2 g |
| Potassium iodide | 0.6 mg |
| Hydroxylamine sulfate | 2.5 g |
| Sodium chloride | 0.6 g |
| 4-amino-3-methyl-N-ethyl-N-(β-hydroxyethyl)-aniline sulfate | 4.6 g |
| Diethylenetriarninepentaacetic acid | 3.0 g |
| Potassium hydroxide | 1.2 g |

Make to 1 liter with water and adjust pH value to 10.0 using potassium hydroxide or 20% sulfuric acid.

(Color developer replenisher)

| | |
|---|---|
| Potassium carbonate | 40 g |
| Sodium hydrogencarbonate | 3 g |
| Potassium sulfite | 7 g |
| Potassium bromide | 0.5 g |
| Hydroxylamine sulfate | 3.1 g |
| 4-amino-3-methyl-N-ethyl-N-(β-hydroxyethyl)-aniline sulfate | 6.5 g |
| Diethylenetriaminepentaacetic acid | 3.0 g |
| Potassium hydroxide | 2 g |

Make to 1 liter with water and adjust pH value to 10.12 using potassium hydroxide or 20% sulfuric acid.

(Bleaching starting solution)

| | |
|---|---|
| Ferric ammonium 1,3-propylenediamine-tetraacetate | 133 g |
| Disodium ethylenediaminetetraacetic acid | 10 g |
| Ammonium bromide | 100 g |
| Succinic acid | 30 g |
| Maleic acid | 70 g |
| Ammonium nitrate | 40 g |

Make to 1 liter with water and adjust pH value to 4.4 using ammonia water.

(Bleaching replenisher)

| | |
|---|---|
| Ferric ammonium 1,3-propylenediamine-tetraacetate | 175 g |
| Disodium ethylenediaminetetraacetic acid | 2 g |
| Ammonium bromide | 120 g |
| Succinic acid | 40 g |
| Maleic acid | 80 g |

Make to 1 liter with water and adjust pH value to 3.4 using ammonia water.

(Fixer starting solution and replenisher)

| | |
|---|---|
| Sodium thiosulfate | See Table 13 |
| Ammonium thiosulfate | See Table 13 |
| Sodium sulfite | 18 g |
| Potassium carbonate | 2 g |
| Disodium ethylenediaminetetraacetate | 2 g |
| Compound of the invention (see Table 13) | 1 g |

Make to 1 liter with water.

(Stabilizer starting solution and replenisher)

| | |
|---|---|
| m-hydroxybenzaldehyde | 1.5 g |
| Sodium laurylsulfate | 0.2 g |
| Disodium ethylenediaminetetraacetate | 0.6 g |
| Lithium hydroxide monohydrate | 0.7 g |

Make to 1 liter with water.

(Processing steps)

| | Processing time | Processing Temperature | Replenishing amount |
|---|---|---|---|
| Color develop. | 3 min. 15 sec. | 38° C. | 520 ml/m$^2$ |
| Bleaching | 45 sec. | 38° C. | 100 ml/m$^2$ |
| Fixing-1 | 45 sec. | 38° C. | |
| Fixing-2 | 45 sec. | 38° C. | 510 ml/m$^2$ |
| stabilizing-1 | 20 sec. | 38° C. | |
| stabilizing-2 | 20 sec. | 38° C. | |
| stabilizing-3 | 20 sec. | 38° C. | 860 ml/m$^2$ |
| Drying | 80 sec. | 38° C. | |

The fixer was flowed to Fixing-2 to Fixing-1, and the stabilizer was flowed to Stabilizing-3 to Stabilizing-2, and Stabilizing-2 to Stabilizing-1 each by a counter-current method.

<Evaluation Items>

(Remaining silver amount)

After running of the processing, an unexposed sample was processed and the amount of remaining silver was determined by a fluorescent X-ray method.

(Observation of precipitated substance adhered on inter-tank rollers)

After running of the processing, appearance of the rollers in the transferring racks provided between the first and second fixing tanks, and the second fixing to the first stabilizing tanks, respectively, was observed and evaluated according to the following ranks.

A: A little amount of adhered crystals is observed, and the crystals can be easily wiped off by hand.

B: Although a slight amount of crystals is remained on the rollers after wiping by hand, the remaining crystals does not cause any problem.

C: A part of crystals adhered on the rollers is remained after wiping by hand and the remained crystals probably cause some damage on the film.

D: A large amount of crystals is strongly adhered on the rollers which can be hardly wiped off by hand. Accordingly, the crystals probably cause serious damage on the film.

(Precipitation at a low temperature)

A part of the fixer was sampled after the running of processing and is stored at 0° C.

A: No precipitation is observed.

B: A slight amount of crystals is precipitated at the bottom of bottle.

C: A lot of large crystals is precipitated.

Test results are shown in Table 13.

TABLE 13

| Experiment No. | Mole rator of ammonium thiosulfate in total thiosulfates | Concentration of thiosulfates (mol/l) | Compound of the invention | Remaining silver amount (mg/100 cm$^2$) | Condition of inter-tank rollers | Precipitation at low temperature | Note |
|---|---|---|---|---|---|---|---|
| 13-1 | 100 | 1.7 | — | 0.4 | D | B | Comp. |
| 13-2 | 70 | 1.7 | — | 0.6 | D | B | Comp. |
| 13-3 | 50 | 1.7 | — | 0.6 | D | B | Comp. |
| 13-4 | 30 | 1.7 | — | 0.8 | D | C | Comp. |
| 13-5 | 10 | 1.7 | — | 0.8 | D | C | Comp. |
| 13-6 | 0 | 1.7 | — | 1.0 | D | C | Comp. |
| 13-7 | 100 | 1.2 | — | 5.2 | C | A | Comp. |
| 13-8 | 70 | 1.2 | — | 6.5 | B | A | Comp. |
| 13-9 | 50 | 1.2 | — | 6.9 | B | A | Comp. |
| 13-10 | 30 | 1.2 | — | 7.5 | A | A | Comp. |
| 13-11 | 10 | 1.2 | — | 7.8 | A | A | Comp. |
| 13-12 | 0 | 1.2 | — | 8.5 | A | A | Comp. |
| 13-13 | 100 | 1.2 | III-10 | 0.2 | C | A | Comp. |
| 13-14 | 70 | 1.2 | III-10 | 0.3 | B | A | Inv. |
| 13-15 | 50 | 1.2 | III-10 | 0.3 | B | A | Inv. |
| 13-16 | 30 | 1.2 | III-10 | 0.4 | A | A | Inv. |
| 13-17 | 10 | 1.2 | III-10 | 0.4 | A | A | Inv. |
| 13-18 | 0 | 1.2 | III-10 | 0.4 | A | A | Inv. |

Comp.: Comparative
Inv.: Invention

It is apparent from Table 13 that the thiosulfate concentration can be lowered by making use of the compound of the invention even when the mole ratio of ammonium thiosulfate to the total amount of thiosulfates is set to not more than 70 mole %. As a result of that, the adhesion of precipitation on the rollers in the transferring rack and crystal precipitation during storage at a low temperature can be prevented.

Example 14

Experiments was carried out in the same manner as in Example 13 except that the mole ratio of ammonium salt was fixed at 10 mole % and the whole concentration of thiosulfate in the fixer replenisher and the kind of compound of the invention were changed as shown in Table 14. Processing and evaluation were carried out in the same manner in Example 13.

Thus obtained results are shown in Table 14.

TABLE 14

| Experiment No. | Concentration of thiosulfates (mol/l) | Compound of the invention | Remaining silver amount (mg/100 cm$^2$) | Condition of inter-tank rollers | Precipitation at low temperature | Note |
|---|---|---|---|---|---|---|
| 14-1 | 1.7 | — | 0.8 | D | C | Comparative |
| 14-2 | 1.2 | — | 7.8 | A | A | Comparative |
| 14-3 | 1.2 | I-2 | 0.7 | A | A | Invention |
| 14-4 | 1.2 | II-6 | 0.6 | A | A | Invention |
| 14-5 | 1.2 | III-10 | 0.4 | A | A | Invention |
| 14-6 | 1.2 | III-13 | 0.4 | A | A | Invention |
| 14-7 | 1.2 | III-31 | 0.5 | A | A | Invention |
| 14-8 | 1.2 | IV-7 | 0.7 | A | A | Invention |
| 14-9 | 1.2 | V-1 | 0.4 | A | A | Invention |
| 14-10 | 1.2 | V-3 | 0.5 | A | A | Invention |

It is apparent from Table 14 that the thiosulfate concentration can be lowered by making use of the compound of the invention even when the mole ratio of ammonium thiosulfate to the total amount of thiosulfates is set to not more than 70 mole %. As a result of that, the adhesion of precipitation on the rollers in the transferring rack and crystal precipitation during storage at a low temperature can be prevented and a good fixing ability can be maintained. It is further understood that the compounds represented by Formula III or V are particularly effective.

Example 15

Experiments was carried out in the same manner as in Example 13 except that the mole ratio of ammonium salt and the kind of compound of the invention were fixed at 10 mole % and III-10, respectively, and the whole concentration of thiosulfate in the fixer replenisher and the weight ratio of the compound of the invention to that of the thiosulfates were changed as shown in Table 15. Processing and evaluation were carried out in the same manner in Example 13.

TABLE 15

| Experiment No. | Concentration of thiosulfates (mol/l) | Added weight / Thiosulfate weight × 100% | Remaining silver amount (mg/100 cm$^2$) | Condition of inter-tank rollers | Precipitation at low temperature | Note |
|---|---|---|---|---|---|---|
| 15-1 | 1.7 | 0 | 0.8 | D | C | Comp. |
| 15-2 | 1.2 | 0 | 7.8 | A | A | Comp. |
| 15-3 | 1.2 | 0.03 | 0.8 | A | A | Inv. |
| 15-4 | 1.2 | 0.05 | 0.6 | A | A | Inv. |
| 15-5 | 1.2 | 0.2 | 0.4 | A | A | Inv. |
| 15-6 | 1.2 | 1.0 | 0.4 | A | A | Inv. |
| 15-7 | 1.2 | 2.0 | 0.4 | A | A | Inv. |
| 15-8 | 1.2 | 5.0 | 0.6 | A | A | Inv. |
| 15-9 | 1.2 | 6.0 | 1.0 | B | A | Inv. |

Comp.: Comparative
Inv.: Invention

From the above, it is understood that the compound of the invention is effective when the ratio of the using amount by weight of the compound to the weight of thiosulfates is within the range of 0.05 to 5.0.

Example 16

A modified color Negative Film Processor CL-KP-50QA (produced by Konica Corporation) shown in FIG. 1 was use, and replenishing was carried out by making use of a solid processing composition supplying device shown in FIG. 2. Pillar-shaped packages each including tables were set on the tablet supplying portions of the processor, and Konica Color Super DD100 Film imagewise exposed was process in a rate of 20 rolls per day.

Treatment processes were as follows.

| Processing | Time | Temperature | Replenishing water |
|---|---|---|---|
| Color deve. | 3'15" | 38.0° C. | 520 ml/m$^2$ |
| Bleaching | 45" | 38.0° C. | 100 ml/m$^2$ |
| Fixing-1 | 45" | 38.0° C. | |
| Fixing-2 | 45" | 38.0° C. | 510 ml/m$^2$ |
| Stabi.-1 | 20" | 38.0° C. | |
| Stabi.-2 | 20" | 38.0° C. | |
| Stabi.-3 | 20" | 38.0° C. | 860 ml/m$^2$ |
| Drying | 80" | 55° C. | |

The fixer and stabilizer were each counter-flowed 2 to 1, and 3 to 2 and 2 to 1, respectively.

Compensation for evaporation of water at the period in which the temperature of the solutions were controlled at the prescribed value, was performed according to a program by which 10 ml, 6.5 ml, 7 ml, 7 ml, 8.6 ml, 8.6 ml and 9.3 ml per hour of water was replenished to the tanks of developing, bleaching, fixing-1, fixing-2, stabilizing-1, stabilizing-2 and stabilizing-3, respectively. For non-operative period, 7.5 ml, 5 ml, 6 ml, 6 ml, 5 ml, 5 ml and 5 ml per hour of water was replenished at the start of operation according to sum of the non-operative time. The solutions filled in the tanks at the start of processing were prepared by making use of replenishes and starters of processing compositions CNK-4-52 for Konica Color Negative Film.

The following processing compositions for color negative film were prepared.

1) Color developer replenisher tablet for color negative film

Operation (1)

In a hammer mill available on the market, 60 g of a developing agent CD-4, 4-amino-N-ethyl-β-(hydroxy) ethylaniline sulfate, was powdered until the average size of powdered particles was become to 10 μm. The powder is granulated with 10 ml of water for 7 minutes in a stirring granulating machine available on the market. Thus obtained granules were dried at 40° C. for 2 hours so as to almost of moisture contained in the granules. Thus granules (1) for color developer replenisher were prepared.

Operation (2)

In the same manner as in operation (1), 69.4 g of hydroxylamine and 4 g of Pineflow (product of Matsutani Kagaku Kogyo) were powdered, mixed and granulated. The adding amount of water was 3.5 ml. After granulation, the granules were dried at 60° C. for 30 minutes so that almost of moisture contained in the granules was removed. Thus granules (2) for color developer replenisher were prepared.

Operation (3)

In the same manner as in operation (1), 15 g of sodium 1-hydroxyethane-1,1-disulfonate, 72,8 g of potassium sulfite, 350 g of sodium carbonate, 3 g of sodium hydrogen carbonate, 3.7 g of sodium bromide, 22 g of mannitol and 5.0 g of polyethyleneglycol 6000 were powdered, mixed and granulated with 40 ml of water. After granulation, the granules were dried at 70° C. for 60 minutes so that almost of moisture contained in the granules was removed. Thus granules (3) for color developer replenisher were prepared.

The above-obtained granules (1) to (3) were mixed and 2 g of sodium N-myristoylalanine was added thereto. The mixture was uniformly mixed for 10 minutes by a mixer installed in a room conditioned at 25° C. and a RH of 40% or less. The mixture was tableted by a tableting machine, modified Tough Prestcollect 1527UH manufactured by Kikusui Seisakusyo in a rate of 10 g per tablet. Thus a tablet for color developer replenisher having a diameter of 30 mm was prepared.

2) Bleaching replenisher tablet for color negative film

Operation (4)

In the same manner as in operation (1), 175 g of ferric ammonium 1,3-propanediaminetetraacetate monohydrate, 2 g of 1,3-propanediaminetetraacetic acid and 17 g of Pineflow (product of Matsutani Kagaku Kogyo) were powdered, mixed and granulated 8 ml of water. After granulation, the granules were dried at 60° C. for 30 minutes so that almost of moisture contained in the granules was removed.

Operation (5)

In the same manner as in operation (H), 133 g of succinic acid, 200 g of ammonium bromide and 17 g of Pineflow (product of Matsutani Kagaku Kogyo) were powdered, mixed and granulated with 17 ml of water. After granulation, the granules were dried at 70° C. for 60 minutes so that almost of moisture contained in the granules was removed.

Operation (6)

In the same manner as in operation (1), 66.7 g of potassium sulfate, 60 g of sodium hydrogen carbonate and 8 g of mannitol were powdered, mixed and granulated with 13 ml of water. After granulation, the granules were dried at 60° C. for 60 minutes so that almost of moisture contained in the granules was removed.

The granules prepared by the above Operations (4) to (6) were uniformly mixed by a mixer installed in a room conditioned at 25° C. and a RH of 40% or less. Then the mixture of the granules was further mixed for 3 minutes after adding 6 g of sodium N-lauroylsarcosine. The mixture was tableted by a tableting machine, modified Tough Press Collect 1527UH, manufactured by Kikusui Seisakusyo, in a rate of 10 g per tablet. Thus a tablet bleaching solution replenisher for color negative film, having a diameter of 30 mm and a thickness of 10 mm was prepared.

3) Fixer replenisher tablet for color negative film

Operation (7)

In a bantam mill available, 1700 g of sodium thiosulfate, 180 g of ammonium thiosulfate, 180 g of sodium sulfite, 20 g of sodium carbonate, 20 g of disodium ethylenediaminetetraacetate and 70 g of Painflow (Matsutani Kagaku) were powdered so that the average size of the powdered particles become to 30 $\mu$m. To the powder was granulated in a stirring granulating machine spending 10 minutes with 50 ml of water. After granulation, the granules were dried at 60° C. for 120 minutes so that almost of moisture contained in the granules was removed. The dried granules were classified so that average size to be 800 $\mu$m and 50% of the granules to be within a deviation range of ±250 $\mu$m.

Operation (8)

The above obtained granules were mixed with 30 g of sodium N-lauroylsarcosine for 5 minutes in a mixing machine installed in a room conditioned at 25° C. and a RH of 40% or less. The mixture was tableted by a tableting machine, modified Tough Press Collect 1527UH, manufactured by Kikusui Seisakusyo, in a rate of 10 g per tablet. Thus a tablet having a diameter of 30 mm and a thickness of 10 mm was prepared.

4) Stabilizer replenisher tablet for color negative film

In the same manner as in operation (1), 150 g of m-hydroxybenzaldehyde, 20 g of sodium laurylsulfate, 60 g of ethylenediaminetetraacetic acid, 65 g of lithium hydroxide monohydrate and 10 g of Pineflow were powdered, mixed and granulated. The granules were dried at 60° C. for 120 minutes so that almost of moisture contained in the granules was removed.

Thus obtained granules were tableted in a rate of 10 g per tablet by a tableting machine, modified Tough Press Collect 1527UH, manufactured by Kikusui Seisakusyo, in a room conditioned at 25° C. and a RH of not more than 40%. Thus a stabilizer replenisher tablet for color negative film having a diameter of 30 mm and thickness of 10 mm was prepared.

The above replenisher tables were supplied to the processing tanks at the following interval.

TABLE 16

| | Supplying interval of replenishing tablet |
|---|---|
| Developer replenisher tablet | 1 tablet per 8.3 roles of color negative film (24EX) |
| Bleaching replenisher tablet | 1 tablet per 5.2 roles of color negative film (24EX) |
| Fixer replenisher tablet | 1 tablet per 2.5 roles of color negative film (24EX) |
| Stabilizer replenisher tablet | 1 tablet per 131 roles of color negative film (24EX) |

The replenishing method using the tables, which is referred as method 1, and the method using the replenishing solutions described in Examples 1 to 3, which is referred as method 2, were evaluated in which the composition of fixing solution was changed as shown in Table 17.

TABLE 17

| Experiment No. | Supplying method | Concentration of thiosulfates (mol/l) | Compound of the invention | Remaining silver amount (mg/100 cm$^2$) | Condition of inter-tank rollers | Precipitation at low temperature | Note |
|---|---|---|---|---|---|---|---|
| 16-1 | Method 1 | 1.7 | — | 0.8 | D | C | Comp. |
| 16-2 | Method 1 | 1.2 | — | 7.8 | A | A | Comp. |
| 16-3 | Method 1 | 1.2 | III-10 | 0.4 | A | A | Inv. |
| 16-4 | Method 2 | 1.2 | — | 7.2 | A | A | Comp. |
| 16-5 | Method 2 | 1.2 | III-10 | 0.2 | A | A | Inv. |

Comp.: Comparative
Inv.: Invention

From the above, it is understood that the adhesion of precipitation on the rolls of the transferring rack and the crystal precipitation at a low temperature can be prevented by making use of the compound of the invention and a replenishing method using tablets.

A processing method for silver halide photographic light-sensitive material which is suited for environment protection can be provided by the present invention, in which the replenishing amount of a stabilizing solution can be reduced without stain formation on the back surface of film and sulfurization of the stabilizing solution, and a stable processing during a prolonged period can be realized.

The fixing ability of a fixer can be maintained even when the concentration of thiosulfate is lowered and adhesion of insoluble substance on a transferring rollers can be prevented by making use of the solid processing composition for silver halide photographic material of the invention. The solid processing composition of the invention has a good storage ability during a prolonged storage under a high temperature condition.

By the present invention, adhesion of precipitation on the rolls of transferring rack and the crystal precipitation at a low temperature can be prevented and a good fixing ability can be maintained. Accordingly, a good working environment can be provided.

What is claimed is:

1. A method for producing a silver halide photographic light-sensitive material comprising the steps of fixing a silver halide photographic light-sensitive material with a fixing solution containing a thiosulfate and a compound represented by Formula I, II, III, IV or V, wherein said thiosulfate is present in said fixing solution in an amount of about 0.6 to about 4 moles/liter of fixing solution, and wherein said compound represented by Formula I, II, III, IV or V is contained in said mixing solution in an amount of from 0.02% to 5% by weight of said thiosulfate contained in said fixing solution;and stabilizing said light-sensitive material just after the fixing step with a stabilizing solution which contains a compound represented by Formula F-1, F-2, F-3, F-4, F-5, F-6, F-7, F-8, F-9, F-10, F-11, F-12 or F-13, and substantially no formaldehyde; wherein Formula I

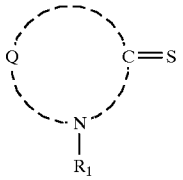

wherein Q is a group of atoms necessary for forming a nitrocen-containing heterocyclic ring, including one being condensed with a five- or six-member unsaturated ring; $R_1$ is a hydrogen atom, a substituted or unsubstituted alkyl group having 1 to 6 carbon atoms, a cycloalkyl group, an aryl group, a heterocyclic group including one being condensed wi five- or six-member unsaturated ring or an amino group;

Formula II

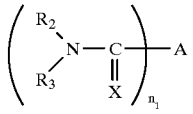

wherein $R_2$ and $R_3$ are each a hydrogen atom, an alkyl group having 1 to 6 carbon atoms, a hydrocyl group, a carboxyl group, an amino group, an acyl group having 1 to 3 carbon atoms, an aryl group or an alkenyl group; A is

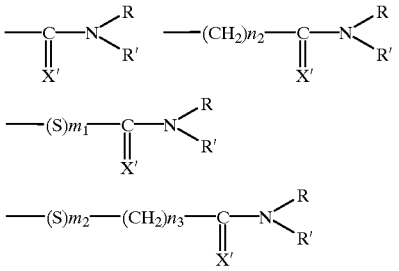

-continued

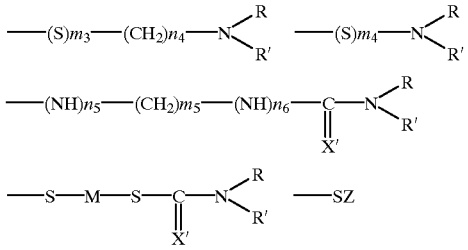

or an $n_1$-valent residue of heterocyclic ring including one being condensed with a five- or six-member unsaturated ring; X is =S, =O or =NR"; in the above R and R' are synonymous with $R_2$ and $R_3$, respectively; X' is synonymous with X, Z is a hydrogen atom, an alkali metal atom, an ammonium group, an amino group, a residue of heterocyclic ring, an alkyl group or an —S—B—Y—($R_4$) ($R_5$) group; M is a divalent metal atom; R" is a hydrogen atom, an alkyl group having 1 to 6 carbon atoms, a cycloalkyl group, an aryl group, a residue of heterocyclic ring including one being condensed with a five- or six-member unsaturated ring, or an amino group; $n_1$ through $n_6$ and $m_1$ through $m_5$ are each an integer of 1 to 6; B is an alkylene group, having 1 to 6 carbon atoms; Y is an —N<, =C< or —CH< group; $R_4$ and $R_5$ are synonymous with $R_2$ and $R_3$, respectively, provided that $R_4$ and $R_5$ each may be a —B—SZ group; $R_2$ and $R_3$, R and R', or $R_4$ and $R_5$ may be linked to form a ring; and a compound represented by the above formula include alcoholized one and salt thereof;

Formula III

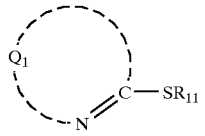

wherein $Q_1$ is a group of atoms necessary for forming a nitrogen-containing heterocyclic ring including one being condensed with a five- or six-member saturated or unsaturated ring; $R_{11}$ is a hydrogen atom or an alkali metal atom

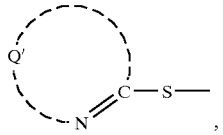

or an alkyl group; and Q' is synonymous with $Q_1$;

Formula IV

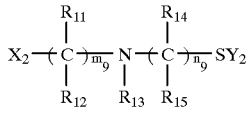

wherein $X_2$ is —COOM', —H, —OH, —$SO_3$M', —$CONH_2$, —$SO_2NH_2$, —$NH_2$, —SH, —CN, —$CO_2R_{16}$, —$SO_2R_{16}$, —$OR_{16}$, —$NP_{16}R_{17}$, —$SR_{16}$, —$SO_3R_{16}$, —$NHCOR_{16}$, —$NHSO_2R_{16}$, —$OCOR_{16}$ or —$SO_2R_{16}$; $Y_2$ is

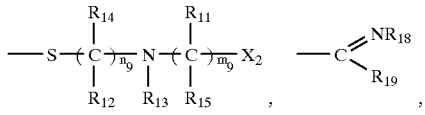

or a hydrogen atom; $m_9$ and $n_9$ are each an integer of 1 to 10; $R_{11}$, $R_{12}$, $R_{13}$, $R_{14}$, $R_{15}$, $R_{16}$, $R_{17}$ and $R_{18}$ are each a hydrogen atom, a lower alkyl group having 1 to 3 carbon atoms, an acyl group or

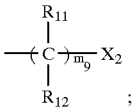

$R_{19}$ is —$NR_2OR_{21}$, —$OR_{22}$ or —$SR_{22}$; $R_{20}$ and $R_{21}$ are each a hydrogen atom or a lower alkyl group having 1 to 3 carbon atoms; $R_{22}$ is a group of atoms necessary for forming a ring by linking with $R_{18}$; $R_{20}$ or $R_{21}$ each may form a ring by linking with $R_{18}$; and M' is a hydrogen atom or a cation;

Formula V

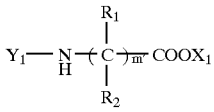

wherein $X_1$ is a hydrogen atom or an alkali metal atom; $Y_1$ is a hydrogen atom, an alkyl group or an acyl group; $R^1$ and $R^2$ are each a hydrogen atom, an alkyl group or an aryl group and at least one of them contains a sulfur atom, $R^1$ and $R^2$ may be the same or different; and m' is an integer of 1 to 5;

Formula F-1

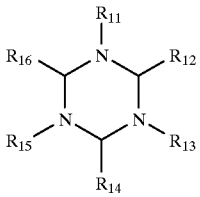

wherein $R_{11}$ to $R_{16}$ represent each a hydrogen atom or a monovalent organic group;

Formula F-2

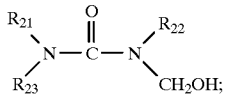

Formula F-3

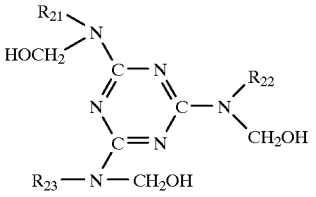

;

-continued

Formula F-4

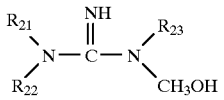

wherein $R_{21}$ to $R_{23}$ represent each a hydrogen atom or a methylol group;

Formula F-5

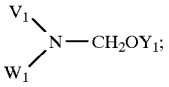

Formula F-6

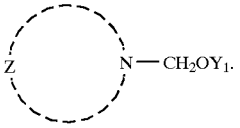

where $V_1$ and $W_1$ represent each an electron withdrawing group, $V_1$ and $W_1$ may be link with together to form a 5- or 6-member nitrogen-containing heterocyclic ring. $Y_1$ represents a hydrogen atom or a group capable of releasing by a hydrolysis reaction. Z represents a group of atoms necessary to form a single or condensed nitrogen-containing heterocyclic ring together with the nitrogen atom;

Formula F-7

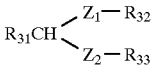

wherein $R_{31}$ represents a hydrogen atom or an aliphatic group; $R_{32}$ and $R_{33}$ represent each an aliphatic group or an aryl group, $R_{32}$ and $R_{33}$ may be linked with together to form a ring. $Z_1$ and $Z_2$ represent each an oxygen atom, a sulfur atom or —$N(R_{34})$—, provided that $Z_1$ and $Z_2$ are not oxygen atoms or —$N(R_{34})$— groups at the same time. $R_{34}$ represents a hydrogen atom, a hydroxyl group, an aliphatic group or an aryl group;

Formula F-8

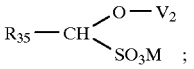

Formula F-9

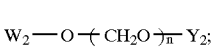

Formula F-10

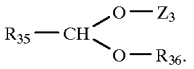

wherein $R_{35}$ represents a hydrogen atom or an aliphatic hydrocarbon group; $V_2$ represents a group capable of releasing by a hydrolysis reaction; M represents a cation; $W_2$ and $Y_2$ represent each a hydrogen atom or a group capable of releasing by a hydrolysis reaction; n represents an integer of 1 to 10; $Z_3$ represents a hydrogen atom, an aliphatic hydrocarbon group, an aryl group or a group capable of releasing by a hydrolysis reaction; $R_{36}$ represents an aliphatic hydrocarbon group or an aryl group. $Z_3$ may be linked with $R_{36}$ to form a ring;

Formula F-11

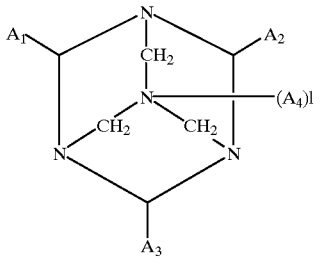

wherein $A_1$ to $A_4$ represent each a hydrogen atom, an alkyl group, an alkenyl group or a pyridyl group. 1 represents 0 or 1;

Formula F-12

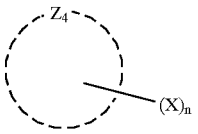

wherein $Z_4$ is a group of atoms necessary to form a hydrocarbon or a heterocyclic ring; and X represents an aldehyde group,

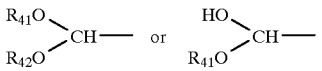

in which $R_{41}$ and $R_{42}$ represent each a lower alkyl group; n represents an integer of 1 to 4; and Formula F-13

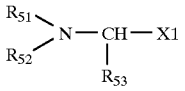

wherein $R_{51}$ to $R_{53}$ represent each a hydrogen atom, an alkyl group or an aryl group; X represents a nitrogen-containing heterocyclic group, wherein said compound represented by Formula F-1 is present in an amount from 0.05 g to 50 g per liter, said compound represented by F-2 through F-4 is presented in an amount from 0.05 g ato 20 g per liter, said compound represented by F-5 through F-11 is present in an amount from 0.01 g to 20 g per liter, and the compound represented by F-12 and F-13 is present in an amount from 0.05 g to 20 g per liter.

2. The method of claim 1, wherein at least a part of said stabilizing solution is added to said fixing solution.

3. The method of claim 1, wherein the replenishing amount of a stabilizer replenishing solution to said stabilizing solution is substantially not more than 900 ml pre square meter of the light-sensitive material processed.

4. The method of claim 1, wherein said fixing solution contains a compound represented by Formula III or V.

5. The method of claim 1, wherein the ratio of ammonium thiosulfate to all thiosulfates contained in said fixing solution is not more than 70 mol %.

6. The method of claim 1, wherein said fixing solution is one prepared from a solid processing composition.

7. The method of claim 6, wherein said solid processing composition contains potassium thiosulfate and/or sodium thiosulfate and ammonium thiosulfate and the ratio of the sum of the weight of said potassium thiosulfate and/or sodium thiosulfate to the total weight of thiosulfates contained in said solid processing composition is within the range of from 2% to 70% by weight.

8. The method of claim 6, wherein said solid processing composition is one being in a form of granules or tablet.

9. The method of claim 6, wherein said solid processing composition is one being in a form of tablet.

10. The method of claim 6, wherein the ratio of the weight of the sum of the compound or compounds represented by Formula I, II, III, IV or V to the weight of thiosulfate contained in said solid processing composition is within the range of from 0.05% to 5% by weight.

11. The method of claim 1, wherein said fixing solution is replenished by a replenishing composition comprising a thiosulfate and a compound represented by Formula I, II, III, IV or V, and not more than 70 mole % of said thiosulfate is ammonium thiosulfate.

12. The method of claim 11, wherein the ratio of the weight of the sum of the compound or compounds represented by Formula I, II, III, IV or V to the weight of thiosulfate contained in said replenishing composition is within the range of from 0.05% to 5% by weight.

13. The method of claim 1, wherein the silver iodide content in the silver halide emulsion of said silver halide photographic light-sensitive material is not less than 5 mole %.

* * * * *